US009033478B2

(12) United States Patent
Nozawa et al.

(10) Patent No.: US 9,033,478 B2
(45) Date of Patent: May 19, 2015

(54) LIQUID ACCOMMODATION BODY AND ACCOMMODATION BODY UNIT

(71) Applicant: SEIKO EPSON CORPORATION, Tokyo (JP)

(72) Inventors: Izumi Nozawa, Matsumoto (JP); Atsushi Kobayashi, Matsumoto (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/900,488

(22) Filed: May 22, 2013

(65) Prior Publication Data

US 2013/0314480 A1 Nov. 28, 2013

(30) Foreign Application Priority Data

May 23, 2012 (JP) ..... 2012-117059
Jul. 23, 2012 (JP) ..... 2012-162701

(51) Int. Cl.
*B41J 2/175* (2006.01)

(52) U.S. Cl.
CPC ..... *B41J 2/17503* (2013.01)

(58) Field of Classification Search
CPC ..... B41J 2/17503; B41J 2/17513; B41J 2/17506; B41J 2/17523; B41J 2/17556
USPC ..... 347/84–87
See application file for complete search history.

(56) References Cited

U.S. PATENT DOCUMENTS 5,980,032 A 11/1999 Pawlowski, Jr. et al.
6,007,191 A 12/1999 Fujii et al.
6,086,193 A 7/2000 Shimada et al.
6,145,974 A 11/2000 Shinada et al.
6,196,671 B1 3/2001 Breemes, Sr. et al.
6,203,148 B1 3/2001 Kishida
6,250,750 B1 6/2001 Miyazawa et al.
6,254,226 B1 7/2001 Lengyel et al.
6,290,348 B1 9/2001 Becker et al.
6,585,007 B2 7/2003 Kubokawa
6,623,104 B1 9/2003 Kotaki et al.
6,776,479 B2 8/2004 Ardito
6,824,258 B2 11/2004 Yamamoto et al.

(Continued)

FOREIGN PATENT DOCUMENTS

EP 0655336 A1 5/1995
EP 0684136 A2 11/1995

(Continued)

OTHER PUBLICATIONS

Search Report issued on Jul. 23, 2014 in European Patent Application No. 13168812.9.

*Primary Examiner* — An Do

(74) *Attorney, Agent, or Firm* — Stroock & Stroock & Lavan LLP

(57) ABSTRACT

A liquid container includes an container main body provided with a liquid accommodation portion for accommodating a liquid in an inner portion and a liquid supply portion which communicates with the liquid accommodation portion and has an opening for causing the liquid of the liquid accommodation portion to flow to the outside; a cap member which is mounted on the container main body in a detachable manner so as to seal the opening of the liquid supply portion and, together with the liquid supply portion, forms an inner chamber by partitioning; and a first communication path which communicates the inner chamber with the outside.

20 Claims, 33 Drawing Sheets

(56) References Cited

U.S. PATENT DOCUMENTS

| | | | |
|---|---|---|---|
| 6,848,776 | B2 | 2/2005 | Nishioka et al. |
| 6,976,753 | B2 | 12/2005 | Kuwabara et al. |
| 7,237,881 | B2 | 7/2007 | Hayasaki et al. |
| 7,293,866 | B2 * | 11/2007 | Miyazawa et al. ..... 347/86 |
| 7,325,909 | B2 | 2/2008 | Yuen |
| 7,393,088 | B2 | 7/2008 | Sasaki |
| 7,445,323 | B2 | 11/2008 | Anderson, Jr. et al. |
| 7,470,008 | B2 | 12/2008 | Yan |
| 7,735,983 | B2 | 6/2010 | Pearson et al. |
| 7,918,547 | B2 | 4/2011 | Hatasa et al. |
| 7,938,523 | B2 | 5/2011 | Aldrich |
| 8,142,000 | B2 | 3/2012 | Ishizawa et al. |
| 8,177,342 | B2 | 5/2012 | Wanibe et al. |
| 8,366,250 | B2 | 2/2013 | Wanibe et al. |
| 8,366,251 | B2 | 2/2013 | Wanibe et al. |
| 8,684,505 | B2 | 4/2014 | Campbell-Brown et al. |
| 2002/0104578 | A1 | 8/2002 | Kubokawa |
| 2004/0100540 | A1 | 5/2004 | Hatasa et al. |
| 2005/0041076 | A1 | 2/2005 | Katayama |
| 2005/0179750 | A1 | 8/2005 | Hayasaki et al. |
| 2005/0185034 | A1 | 8/2005 | Anma et al. |
| 2005/0219303 | A1 | 10/2005 | Matsumoto et al. |
| 2005/0275699 | A1 | 12/2005 | Sasaki |
| 2007/0024683 | A1 | 2/2007 | Yan |
| 2007/0139492 | A1 | 6/2007 | Anderson, Jr. et al. |
| 2007/0195141 | A1 | 8/2007 | Anma et al. |
| 2007/0195144 | A1 | 8/2007 | McNestry |
| 2008/0204529 | A1 | 8/2008 | Matsumoto et al. |
| 2008/0231672 | A1 | 9/2008 | Mano |
| 2008/0239037 | A1 | 10/2008 | Inoue |
| 2009/0128609 | A1 | 5/2009 | Matsumoto et al. |
| 2009/0322832 | A1 | 12/2009 | Wanibe et al. |
| 2009/0322838 | A1 | 12/2009 | Wanibe et al. |
| 2009/0322839 | A1 | 12/2009 | Ishizawa et al. |
| 2010/0073438 | A1 | 3/2010 | Wanibe et al. |
| 2010/0208015 | A1 | 8/2010 | Matsumoto et al. |
| 2010/0302291 | A1 | 12/2010 | Matsumoto et al. |
| 2010/0309265 | A1 | 12/2010 | Matsumoto et al. |
| 2010/0309266 | A1 | 12/2010 | Matsumoto et al. |
| 2011/0037815 | A1 | 2/2011 | Anma et al. |
| 2011/0169899 | A1 | 7/2011 | Nozawa et al. |
| 2012/0127247 | A1 | 5/2012 | Anma et al. |
| 2012/0133713 | A1 | 5/2012 | Camp |
| 2013/0208044 | A1 | 8/2013 | Matsumoto et al. |

FOREIGN PATENT DOCUMENTS

| | | | |
|---|---|---|---|
| EP | 0712727 | A2 | 5/1996 |
| EP | 1053881 | A1 | 11/2000 |
| EP | 1095777 | A2 | 5/2001 |
| EP | 1125747 | A2 | 8/2001 |
| EP | 1170135 | A1 | 1/2002 |
| EP | 2103435 | A2 | 9/2009 |
| EP | 2380744 | A2 | 10/2011 |
| JP | 06-106729 | A | 4/1994 |
| JP | 08-112915 | A | 5/1996 |
| JP | 10-095129 | A | 4/1998 |
| JP | 10-250091 | A | 9/1998 |
| JP | 2000-203053 | A | 7/2000 |
| JP | 2001-063085 | A | 3/2001 |
| JP | 2001-130022 | A | 5/2001 |
| JP | 2002-036590 | A | 2/2002 |
| JP | 2002-120376 | A | 4/2002 |
| JP | 2002-225306 | A | 5/2002 |
| JP | 2005-170027 | A | 6/2005 |
| JP | 2005-349786 | A | 12/2005 |
| JP | 2007-112150 | A | 5/2007 |
| JP | 2008-246896 | A | 10/2008 |
| JP | 2009-061785 | A | 3/2009 |
| JP | 2009-241608 | A | 10/2009 |
| JP | 2010-005957 | A | 1/2010 |
| JP | 2011-140189 | A | 7/2011 |
| JP | 2011-207066 | A | 10/2011 |
| JP | 2012-035489 | A | 2/2012 |
| JP | 2012-126100 | A | 7/2012 |
| JP | 2012-136039 | A | 7/2012 |

* cited by examiner

LIQUID ACCOMMODATION BODY AND ACCOMMODATION BODY UNIT

Priority is claimed under 35 U.S.C. §119 to Japanese Application No. 2012-117059 filed on May 23, 2012, No. 2012-162701 filed on Jul. 23, 2012 which are hereby incorporated by reference in its entirety.

BACKGROUND

1. Technical Field

The present invention relates to a liquid accommodation body and an accommodation body unit.

2. Related Art

In the related art, as technology to supply an ink to a printer, which is an example of a liquid ejecting apparatus, technology is known which uses an ink cartridge (also referred to simply as a "cartridge") that accommodates an ink (for example, refer to JP-A-8-112915, JP-A-2011-207066, JP-A-2003-191488, US-A-2012-0133713, JP-A-2012-35479). The cartridge is provided with an ink supply portion having an opening to cause the ink to flow to the outside. When the cartridge is mounted in the printer, the ink is supplied from the ink supply portion to the printer side.

In an initial state before the cartridge is mounted in the printer during shipping or the like, there is a case in which the cartridge is provided with a cap member in order to prevent the ink from leaking out from the opening of the ink supply portion to the outside (for example, refer to JP-A-8-112915). However, in a case in which a cap member is attached so as to block the opening of the ink supply portion, a space (also referred to as "the inner chamber") partitioned by the ink supply portion and the cap member is compressed, and there is a case in which the air of the inner chamber may flow into the ink accommodation portion which accommodates the ink within the cartridge. In addition, in a case in which the inner chamber is maintained in a high-pressure state, when the cap member is removed in this state, the pressure of the inner chamber drops suddenly and the ink may leak out from the ink supply portion with the pressure fluctuation.

In addition, when the cartridge is mounted in the printer, in order to stop the ink from leaking out from the opening of the ink supply portion of the cartridge, the periphery of the opening of the ink supply portion is sealed using a seal member of the printer. In this case, there is a concern that the space (the inner chamber) partitioned by the ink supply portion and the elastic member of the printer is compressed. When the pressure of the inner chamber becomes high, the air of the inner chamber may flow into the ink accommodation portion. In addition, in a case in which the inner chamber is maintained in a high-pressure state, when the cartridge is removed from the printer in this state, the pressure of the inner chamber drops suddenly and the ink may leak out from the ink supply portion with this pressure fluctuation.

In addition, according to a type of cartridge, in the initial state, in order to obtain a reduction of the amount of dissolved gas in the ink of the ink accommodation portion, there is a case in which the cartridge is accommodated in a decompressed packaging material (also referred to as a "reduced pressure pack") for distribution. For example, there is a case in which a so-called half-sealed type of cartridge where the outside air is intermittently introduced into the ink accommodation portion with the consumption of the ink of the ink accommodation portion (JP-A-2003-191488), or a so-called sealed type of cartridge where the ink accommodation portion is a sealed space that does not communicate with the atmosphere (US-A-2012-0133713) is accommodated in a decompressed packaging material for distribution in this manner. In the half-sealed type of cartridge disclosed in JP-A-2003-191488 and the sealed type of cartridge disclosed in US-A-2012-0133713, a portion of the ink accommodation portion is fabricated from a deformable sheet member and is arranged so as to make contact with the air chamber that communicates with the outside.

However, in a case in which the opening of the ink supply portion is blocked by the cap member, when the cartridge is accommodated in the packaging material and the inner portion is decompressed, there is a concern that air will flow into the ink accommodation portion from the inner chamber.

The problems described above are not limited to an ink cartridge, and are common problems to any cartridge that accommodates a type of liquid other than ink.

Furthermore, in order to solve such problems, a technology is known in which, as in JP-A-2012-35479, a flow path is provided that communicates from the inner chamber to a liquid accommodation portion, and the inner chamber is made to communicate with the atmosphere via the flow path. However, this technology assumes the use of a so-called open type of cartridge in which the liquid accommodation portion is always open in relation to the atmosphere and may not be applied to the so-called half-sealed type of cartridge such as that of JP-A-2003-191488 or the so-called sealed type of cartridge such as that of US-A-2012-0133713.

SUMMARY

The invention may be realized as the below aspects or application examples.

Application Example 1

A liquid accommodation body includes an accommodation body main body provided with a liquid accommodation portion for accommodating a liquid in an inner portion and a liquid supply portion which communicates with the liquid accommodation portion and has an opening for causing the liquid of the liquid accommodation portion to flow to the outside; a cap member which is mounted on the accommodation body main body in a detachable manner so as to block the opening of the liquid supply portion and, together with the liquid supply portion, forms an inner chamber by partitioning; and a first communication path which communicates the inner chamber with the outside.

In this case, since the inner chamber communicates with the outside via the first communication path, when the cap member is mounted to the accommodation body main body so as to block the opening of the liquid supply portion, the air of the inner chamber may flow through the first communication path out to the outside. Accordingly, since the air of the inner chamber is not compressed, it is possible to prevent the air from flowing into the liquid accommodation portion.

Application Example 2

The liquid accommodation body according to Application Example 1, further includes a second communication path which communicates the liquid accommodation portion and the outside in order to introduce air to the liquid accommodation portion; in which the first communication path includes a first portion including an end portion connected to the inner chamber, and a second portion which is positioned further to an outside air side than the first portion in a direction along a flow path of the first communication path, communicates the first portion with the outside, and configures a portion of the second communication path.

In this case, it is possible to cause the air of the inner chamber to flow out to the outside using a portion of the second communication path provided for introducing the air to the liquid accommodation portion.

Application Example 3

In the liquid accommodation body according to Application Example 1, the first communication path is formed in the cap member.

In this case, the first communication path may be formed easily by the cap member. For example, the first communication path may be easily formed by providing a groove or a through hole in the cap member for communicating the inner chamber with the outside.

Application Example 4

In the liquid accommodation body according to any one of Application Examples 1 to 3, the first communication path has a narrow flow path which is a portion in which a flow path cross-sectional area is smaller than that of other portions within the first communication path.

In this case, the evaporation of the liquid of the liquid accommodation portion through the first communication path may be reduced due to the first communication path having a narrow flow path.

Application Example 5

The liquid accommodation body according to any one of Application Examples 1 to 4, further includes a container main body member of a concave shape having an opening in a wall on one side; and a lid memberlid member attached to the container main body so as to cover the opening of the container main body member; in which, an inner portion communication path which is a portion of the first communication path is formed on a confronting surface side which is opposite the sheet member within the lid memberlid member.

In this case, since the inner portion communication path may be formed on the confronting surface side of the lid memberlid member, the damage to the aesthetics of the exterior of the liquid accommodation body may be suppressed.

Application Example 6

In the liquid accommodation body according to any one of Application Examples 1 to 5, the first communication path is formed after the liquid accommodation portion is filled with the liquid.

In this case, the likelihood of the liquid leaking out to the outside via the first communication path when filling the liquid accommodation portion with the liquid may be reduced.

Application Example 7

An accommodation body unit includes the liquid accommodation body according to any one of Application Examples 1 to 6; and packaging material which accommodates the liquid accommodation body in an inner portion at a lower pressure than the atmospheric pressure.

In this case, since the liquid accommodation body is provided with the first communication path, an accommodation body unit in which the air of the inner chamber does not flow into the liquid accommodation portion may be provided. In addition, according to the accommodation body unit of Application Example 5, since the packaging material accommodates the liquid accommodation body in the inner portion at a lower pressure than the atmospheric pressure, a reduction in the amount of dissolved gas in the liquid of the liquid accommodation portion may be obtained. In addition, a portion of the liquid accommodation portion is, for example, formed by a deformable sheet member, and, even in a case in which the outer surface of the sheet member communicates with the outside, the pressures of a region in contact with the outside surface and the inner chamber may be substantially the same due to the inner chamber being in communication with the outside. Accordingly, the inflow of the air of the inner chamber to the liquid accommodation portion may be prevented.

Application Example 8

A liquid accommodation body includes an outer shell; a liquid accommodation portion provided in an inner portion of the outer shell; an air chamber provided in the inner portion of the outer shell and an outside of the liquid accommodation portion; a liquid supply portion having an opening which is provided on a plane of the outer shell and is for causing the liquid of the liquid accommodation portion to flow to the outside; and a ventilation port provided on the plane of the outer shell; in which, within the liquid supply portion, an inner chamber is formed by partitioning due to an opening of the liquid supply portion being blocked, and in which, the inner chamber communicates with the outside due to a communication path which passes from a communication port provided in the inner chamber, through the air chamber, and reaches the ventilation port.

In this case, since the inner chamber communicates with the outside due to the communication path which passes from the communication port provided in the inner chamber, through the air chamber, and reaches the ventilation port, it is possible for the air of the inner chamber to flow out to the outside even when the opening of the liquid supply portion is blocked by the cap or the like. Accordingly, since the air of the inner chamber is no longer compressed, the air may be prevented from flowing into the liquid accommodation portion, and the ink may be prevented from leaking out due to pressure fluctuation of the inner chamber. In addition, since the communication path does not pass through the liquid accommodation portion, this configuration can be favorably applied to the so-called half-sealed or sealed type of cartridge. Naturally, this configuration can also be applied to an open type of cartridge.

Application Example 9

In the liquid accommodation body according to Application Example 8, the outer shell includes a container main body member of a concave shape having an opening in a wall on one side; and a lid memberlid member attached to the container main body member so as to cover the opening of the container main body member; in which the ventilation port is formed in the lid memberlid member, and in which an inner portion communication path is formed on an confronting surface, which is opposite the liquid accommodation portion within the lid memberlid member, one end communicates with the ventilation port and the other end communicates with the air chamber.

In this case, since the inner portion communication path may be formed on the confronting surface side of the lid memberlid member, the damage to the aesthetics of the exterior of the liquid accommodation body may be suppressed.

Application Example 10

In the liquid accommodation body according to Application Example 9, the liquid accommodation portion is configured by attaching a first sheet member having flexibility to the container main body member; in which the lid memberlid member is attached to the container main body member so as to cover the first sheet member; in which the inner portion communication path is configured by a groove portion and a second sheet member which is attached to the confronting surface so as to cover the groove portion; and in which at least a portion of the second sheet member is provided in a position opposite the first sheet member.

In this case, since at least a portion of the second sheet member for forming the inner portion communication path is interposed between the lid memberlid member and the first sheet member, the likelihood of the first sheet member directly making contact with the lid memberlid member may be reduced. Accordingly, the likelihood of the first sheet member being broken may be reduced. In addition, hypothetically, even in a case in which the first sheet member makes contact with the lid member, the second sheet member acts as a buffer material and the likelihood of the first sheet member being broken may be reduced.

Application Example 11

In the liquid accommodation body according to Application Example 10, a connection portion configured by a concave portion provided on the confronting surface is provided on the other end of the inner portion communication path; the second sheet member extends to a position opposite the connection portion; and in which, within the second sheet member, the extending portion is not attached to the confronting surface.

In this case, while the air may be caused to flow smoothly via the connection portion, the likelihood of the printing material flowing from the connection portion, through the inner portion communication path, and out to the outside may be reduced by an extending portion within the second sheet member.

Application Example 12

In the liquid accommodation body according to Application Example 11, a flow path cross-sectional area of the connection portion is greater than the flow path cross-sectional area of the inner portion communication path.

In this case, the flow of the air to and from the outside may be performed more smoothly.

Application Example 13

In the liquid accommodation body according to any one of Application Examples 9 to 12, the inner portion communication path is a meandering path having a portion which is curved by 180°.

In this case, the distance of the inner portion communication path within a narrow region may be lengthened. Therefore, it is possible to suppress the flowing out of the printing material to the outside through the inner portion communication path.

Application Example 14

In the liquid accommodation body according to any one of Application Examples 8 to 13, a path connecting a communication port provided in the inner chamber with the air chamber is formed after the liquid accommodation portion is filled with the liquid.

In this case, the likelihood of the liquid leaking out to the outside via the communication path when filling the liquid accommodation portion with the liquid may be reduced.

Application Example 15

In the liquid accommodation body according to any one of Application Examples 8 to 14, the liquid accommodation portion includes an air introduction port for introducing air of the outside and a valve mechanism urged so as to close the air introduction port; and in which the valve mechanism is configured so as to temporarily open the air introduction port at a predetermined timing with consumption of a liquid within the liquid accommodation portion.

In this case, the liquid accommodation body is a so-called half-sealed type of liquid accommodation body. As described previously, since the communication path which communicates the inner chamber with the outside does not pass through the liquid accommodation portion, even in a half-sealed type of cartridge, the air may be favorably prevented from flowing into the liquid accommodation portion, and the ink may be favorably prevented from leaking out due to pressure fluctuation of the inner chamber.

Application Example 16

In the liquid accommodation body according to any one of Application Examples 8 to 14, the liquid accommodation portion is a sealed space not in communication with an atmosphere.

In this case, the liquid accommodation body is a so-called sealed type of liquid accommodation body. As described previously, since the communication path which communicates the inner chamber with the outside does not pass through the liquid accommodation portion, even in a sealed type of cartridge, the air may be favorably prevented from flowing into the liquid accommodation portion, and the ink may be favorably prevented from leaking out due to pressure fluctuation of the inner chamber.

Furthermore, the invention may be realized using various embodiments, and in addition to the liquid accommodation body or the accommodation body unit described above, may be realized using a form of the manufacturing method of the liquid accommodation body or the accommodation body unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, the embodiments of the invention will be described in the following order.

A to E. Various Examples:

F. Modification Examples:

A. First Example

A-1. Overall Configuration of Printing Apparatus

Figure 1:
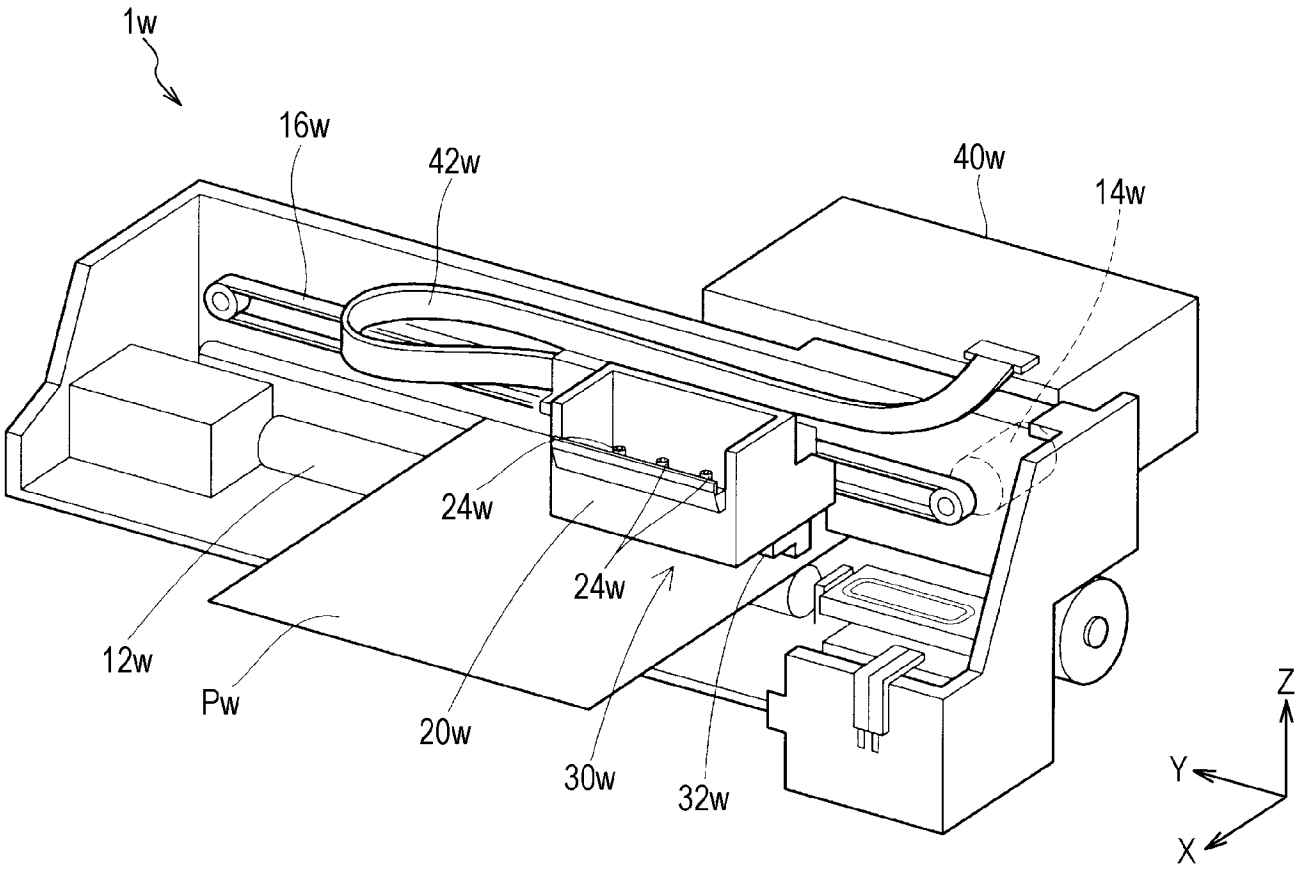
FIG. 1 is a perspective view showing a configuration of a printing apparatus as the liquid ejecting apparatus.

FIG. 1 is a perspective view showing a configuration of a printing apparatus 1*w* as the liquid ejecting apparatus according to an embodiment of the present invention. The printing apparatus 1*w* is a miniature ink jet printer for personal use and includes a sub-scanning feed mechanism, a main scanning feed mechanism and a head drive mechanism. The sub-scanning feed mechanism transports a printing paper P in the sub-scanning direction using a feed roller 12*w* that is powered by a feed motor (not shown). The main scanning feed mechanism reciprocally moves a carriage 30*w* connected to a drive belt 16*w* in the main scanning direction using the power of a carriage motor 14*w*. The main scanning direction of the printing apparatus is the Y axis direction, and the sub-scanning direction is the X axis direction. The head drive mechanism executes the ink discharging and the dot formation by driving a print head 32*w* that is provided on the carriage 30*w*. The printing apparatus 1*w* is further provided with a control unit 40*w* for controlling each of the mechanisms described above. The control unit 40*w* is connected to the carriage 30*w* via a flexible cable 42*w*.

The carriage 30*w* is provided with a holder 20*w* and a print head 32*w*. The holder 20*w* is configured such that a plurality of cartridges may be mounted therein, and is arranged on the upper side of the print head 32*w*. Hereinafter, the holder 20*w* is also referred to as the "cartridge mounting portion 20*w*". In the example shown in FIG. 1, it is possible to mount four cartridges independently in the holder 20*w*, and for example, four types of cartridges of black, yellow, magenta and cyan are mounted one at a time. Furthermore, in addition to these types, it is possible to use a holder which can mount cartridges of an arbitrary plurality of types as the holder 20*w*. A liquid supply tube 24*w* for supplying an ink from the cartridge to the print head 32*w* is arranged on the upper portion of the print head 32*w*. The print head 32*w* functions as a liquid ejecting unit which ejects the ink by discharging the ink. The type of the printing apparatus 1*w* in which, as in the printing apparatus 1*w*, a cartridge changed by the user is mounted in a cartridge mounting portion (a holder) 20*w* on the carriage of the print head is referred to as an "on carriage type".

A-2. Schematic Configuration of Cartridge

Figure 2:
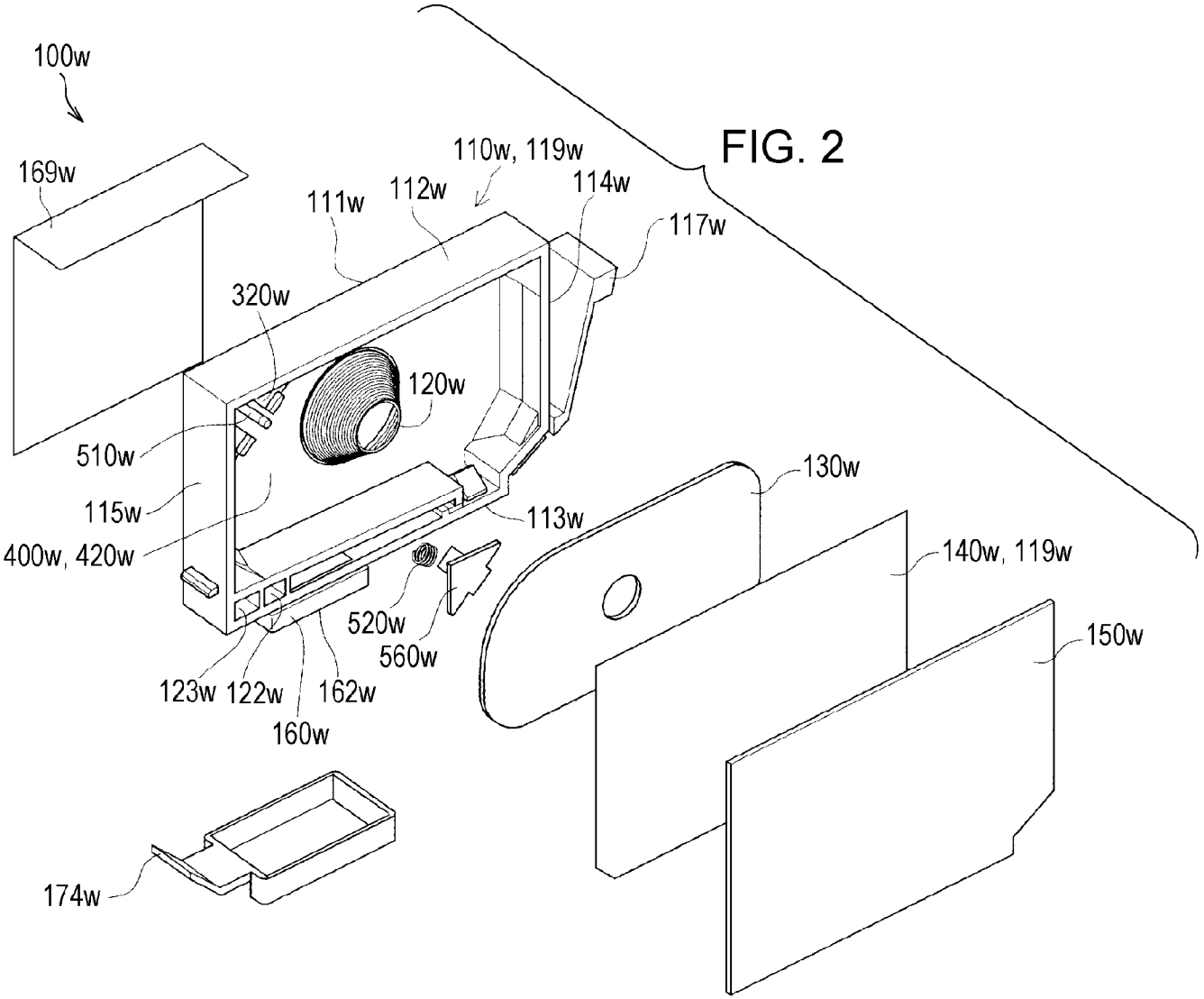
FIG. 2 is a first exploded perspective view of a cartridge.
Figure 3:
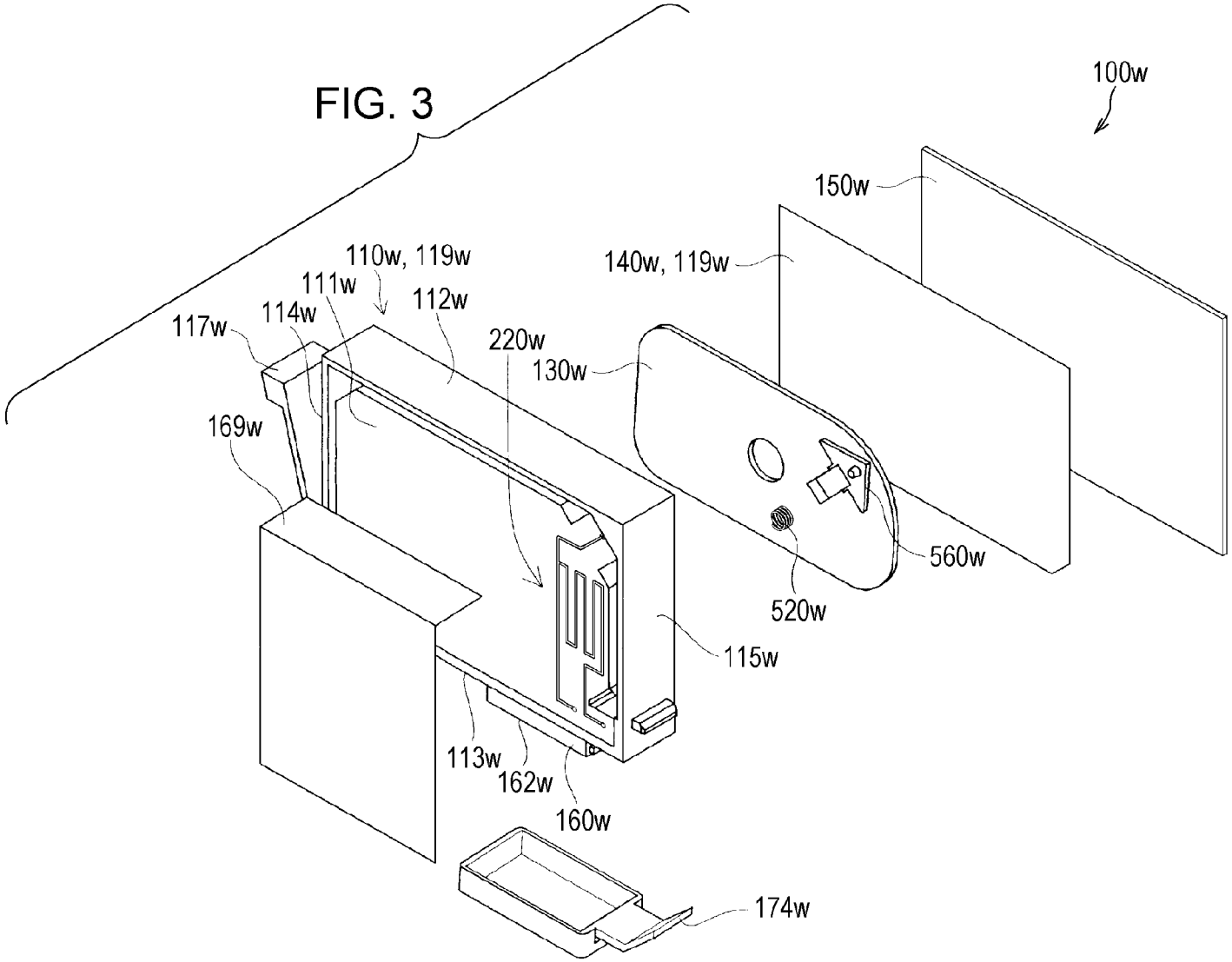
FIG. 3 is a second exploded perspective view of the cartridge.

FIG. 2 is a first exploded perspective view of a cartridge 100*w*. FIG. 3 is a second exploded perspective view of the cartridge 100*w*. FIG. 2 is a view of the cartridge 100*w* as seen from the front side and FIG. 3 is a view of the cartridge 100*w* as seen from the rear side. As shown in FIG. 2 and FIG. 3, the cartridge 100*w* is provided with a container main body 110*w* and a cap member 174*w*. The cartridge 100*w* is further provided with a spring member 120*w* as an energizing member, a pressure plate 130, a first sheet member (a first film member) 140*w*, a lid member 150*w* and a second sheet member (a second film member) 169*w*.

The container main body 110*w* is fabricated from a synthetic resin (for example, polypropylene). The container main body 110*w* has a plate-shaped portion 111*w* of a substantially flat plate shape, and four wall portions 112*w* to 115*w* provided to stand in a substantially perpendicular manner in relation to the plate-shaped portion 111*w* from the four sides of the periphery of the plate-shaped portion 111*w*. In addition, the container main body 110*w* is of a concave shape and forms a concave portion 400*w* for accommodating the ink using the plate-shaped portion 111*w* and the four wall portions 112*w* to 115*w*. The first wall portion 112*w* forms the upper plane of the cartridge 100*w*. The second wall portion 113*w* opposes the first wall portion 112*w* and forms the lower plane of the cartridge 100*w*. The third wall portion 114*w* forms the side of the cartridge 100*w*. The third wall portion 114*w* is provided with a lever 117*w* that is used for mounting and dismounting the cartridge 100*w* from the holder 20*w*. The fourth wall portion 115*w* opposes the third wall portion 114*w* and forms the side of the cartridge 100*w*. In addition, the side opposing the plate-shaped portion 111*w* is open. The spring member 120*w* is accommodated in the inner portion of the container main body 110*w*. An end portion of the spring member 120*w* makes contact with the container main body 110*w* (more specifically, the plate-shaped portion 111*w*).

The pressure plate 130*w* is fabricated from a synthetic resin (for example, polypropylene) or a metal (for example, stainless steel). The pressure plate 130*w* makes contact with the other end portion of the spring member 120*w*. The first sheet member 140*w* is fabricated from a synthetic resin having flexibility. For example, the first sheet member 140*w* is fabricated from a material which is a mixture of nylon and polypropylene. The first sheet member 140*w* is joined to the end plane of the opening side of the container main body 110*w* so as to cover the side of the container main body 110*w* which is open. A liquid accommodation portion 420*w* which accommodates the ink is formed by the first sheet member 140*w* sealing the concave portion 400*w*. That is, a portion of the liquid accommodation portion 420*w* is formed of the deformable first sheet member 140*w*. Here, since the liquid accommodation body 420*w* is formed from the container main body 110*w* and the first sheet member 140*w*, the container main body 110*w* and the first sheet member 140*w* may also be referred to collectively as a "accommodation body main body 119*w*".

One of the planes of the first sheet member 140*w* makes contact with the liquid accommodation portion 420*w*, and the other plane makes contact with the air chamber described below (outside). The lid member 150*w* is fabricated from a synthetic resin (for example, polypropylene). The lid member 150*w* is attached to the container main body 110*w* so as to cover the container main body 110*w* from above the sheet member 140*w*. A space is formed between the lid member 150*w* and the first sheet member 140*w*, and this space functions as the air chamber described below.

The container main body 110*w* is provided with a liquid supply portion 160*w* for causing the ink of the liquid accommodation portion 420*w* to flow to the outside. That is, the liquid accommodation portion 420*w* and the liquid supply portion 160*w* communicate with one another. The liquid supply portion 160*w* is formed so as to protrude from the second wall portion 113*w* to the outside. In addition, an end portion (a lower end portion) 162*w* of the liquid supply portion 160*w* is open. In addition, a porous member (a foam) is arranged in the flow path of the liquid supply portion 160*w*.

The cap member 174*w* is fabricated from a synthetic resin (for example, polypropylene). In the initial state, which is the state before the cartridge 100*w* is mounted in the printing apparatus 1*w*, the cap member 174*w* is mounted detachably to the accommodation body main body 119*w*. Specifically, the cap member 174*w* is attached to the accommodation body main body 119*w* so as to cover an opening 162*w* of the liquid supply portion 160*w*. Accordingly, in the initial state, it is possible to reduce the likelihood of the ink leaking out to the outside, and to reduce the likelihood of the liquid supply portion 160*w* being damaged.

The container main body 110*w* has a valve chamber 320*w* which is adjacent to the liquid accommodation portion 420*w* and communicates with the liquid accommodation portion 420*w*. The valve chamber 320*w* is used for intermittently introducing air from the outside to the liquid accommodation portion 420*w* with the consumption of the ink of the liquid accommodation portion 420*w*. A portion of an arm member 510*w* and a spring member 520*w* as the energizing member are arranged in the valve chamber 320*w*. In addition, a spring seat 560*w* is arranged on the spring member 520*w*. Furthermore, the valve chamber 320*w* and the related members will be described in detail below.

The second sheet member 169*w* covers the rear side of the container main body 110*w*. Specifically, as shown in FIG. 2, the second sheet member 169*w* forms a portion of the flow path for introducing air from the outside to the inner portion of the cartridge 100*w* by covering a groove 220 that is formed on the rear of the container main body 110*w*.

A-3. Details of Flow Path of Cartridge

Figure 4:
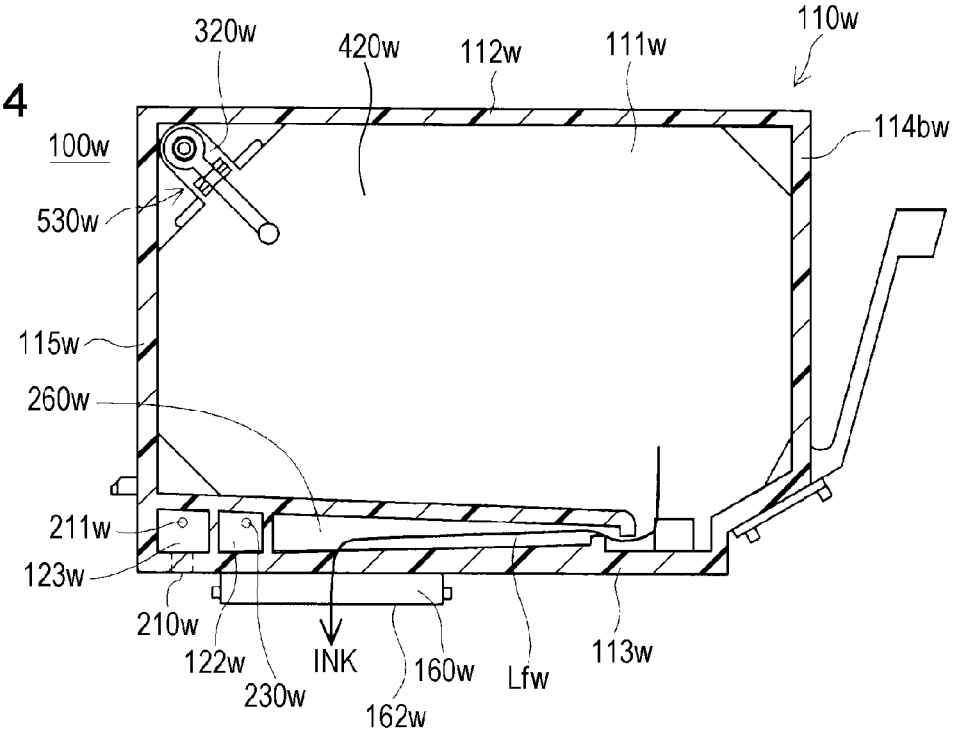
FIG. 4 is a plan view of the front side of a container main body.
Figure 5:
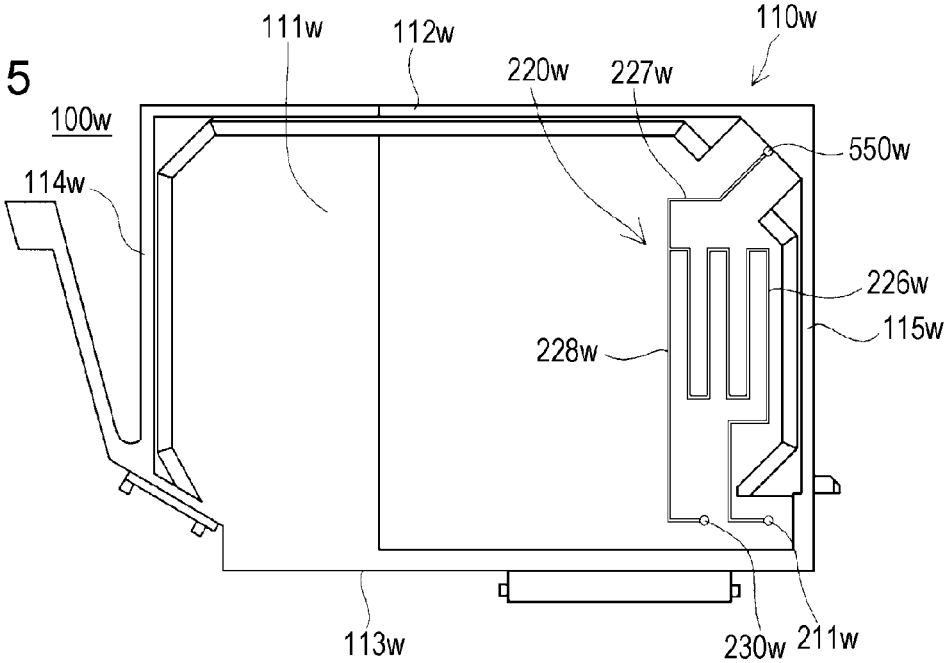
FIG. 5 is a plan view of the rear side of the container main body.
Figure 6:
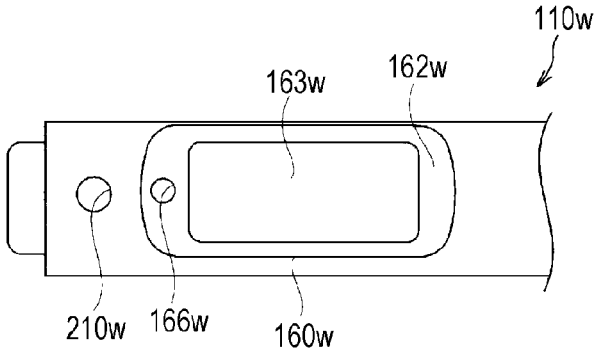
FIG. 6 is a plan view of the lower side of the container main body.
Figure 7:
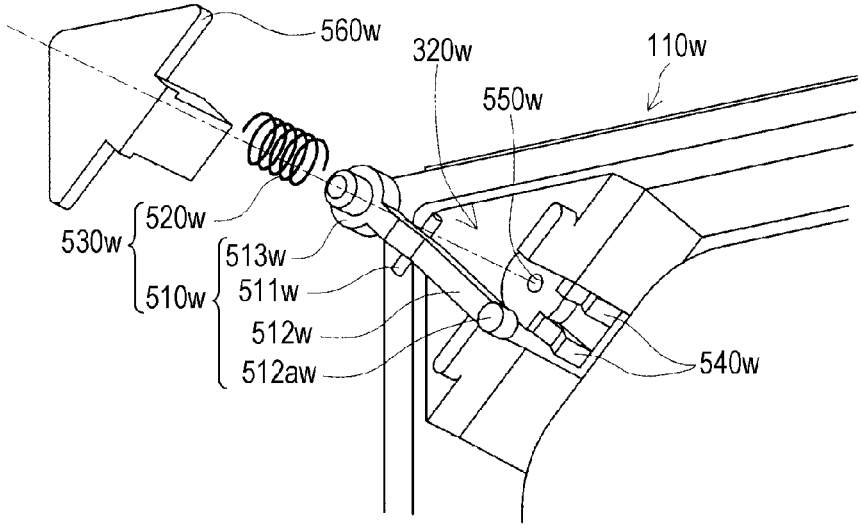
FIG. 7 is an exploded perspective view of the vicinity of a valve chamber.
Figure 8:
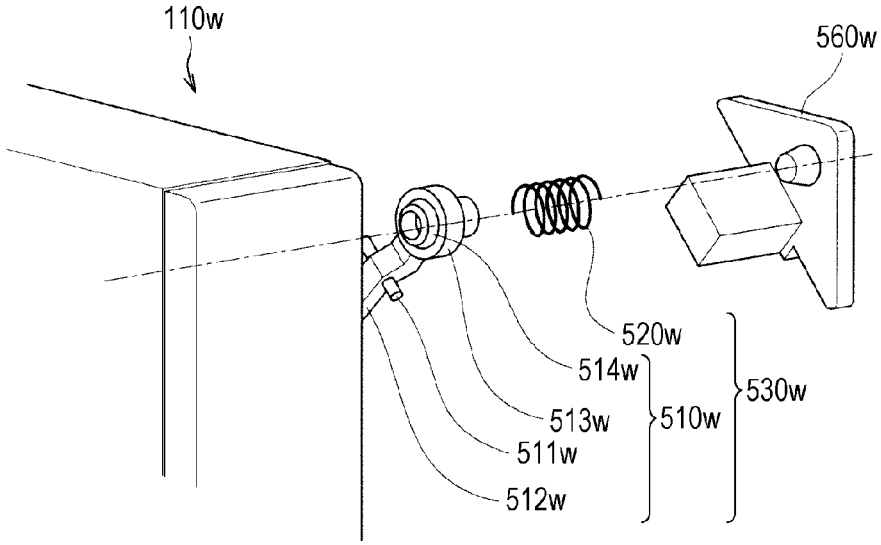
FIG. 8 is a view of the perspective view of FIG. 7 seen from the rear side.

Next, each type of the flow paths formed in the cartridge 100*w* is described using FIGS. 4 to 8. FIG. 4 is a plan view of the front side of the container main body 110*w*. FIG. 5 is a plan view of the rear side of the container main body 110*w*. FIG. 6 is a plan view of the lower side of the container main body 110*w*. Furthermore, FIG. 6 shows the vicinity of the liquid supply portion 160*w* within the container main body 110*w*. FIG. 7 is an exploded perspective view of the vicinity of the valve chamber 320*w*. FIG. 8 is a view of the perspective view of FIG. 7 seen from the rear side. Furthermore, in FIG. 4, to facilitate comprehension, the portion onto which the first sheet member 140*w* (FIG. 2) is bonded is shaded with single hatching.

As shown in FIG. 4, a flow path (a liquid flow path) Lf of the ink which flows from the liquid accommodation portion 420*w* to the liquid supply portion 160*w* is represented by an arrow. In other words, the ink of the liquid accommodation portion 420*w* flows through an outlet chamber 260*w* partitioned by the container main body 110*w* and the first sheet member 140*w* (FIG. 2) to the liquid supply portion 160*w*.

Next, description will be given of the flow path (the gas flow path) of the air (the outside air) which flows through the cartridge 100*w*. As shown in FIG. 4, the cartridge 100*w* is provided with a first chamber 123*w* and a second chamber 122*w* partitioned by the container main body 110*w* and the first sheet member 140*w*. The first chamber 123*w* communicates with an atmosphere-open port 210*w* formed on a second wall portion 113*w* and is configured such that the outside air can be introduced. Furthermore, within the first sheet member 140*w*, a portion which covers the second chamber 122*w* is broken after the first sheet member 140*w* is attached to the container main body 110*w*. Accordingly, the space (the air chamber) between the first sheet member 140*w* and the lid member 150*w* communicates with the outside and it is possible to introduce air into the air chamber.

As shown in FIG. 5, a groove (an air flow path) 220*w* and through holes 211*w*, 230*w* and 550*w* are formed on the rear of the plate-shaped portion 111*w*. The groove 220*w* and the through holes 211*w*, 230*w* and 550*w* are covered by the second sheet member 169*w* (FIG. 2). The air that is introduced to the first chamber 123*w* (FIG. 4) via the atmosphere-open port 210*w* (FIG. 4) flows through the through hole 211*w*. The air which passed through the through hole 211*w* flows through the groove 220*w*. The groove 220*w* branches off into two part way down. Of the two branched-off grooves, the groove which leads to the through hole 550*w* is also known as a first branch groove 227*w*, and the groove which leads to the through hole 230*w* is also known as a second branch groove 228*w*. The air which flows through the groove 220*w* flows through the through holes 230*w* and 550*w*. The air that flows into the through hole 230*w* passes through the second chamber 122*w* (FIG. 4) and flows into the space (the air chamber) between the first sheet member 140*w* and the lid member 150*w*. The through hole 550*w* opens within the valve chamber

320*w* and is configured such that it is possible to introduce the air (the outside air) into the liquid accommodation portion 420*w* via the valve chamber 320*w*. Here, a portion of the groove 220*w* forms a meandering flow path 226*w* that meanders. Here, the groove 220*w* has a smaller flow path cross-sectional area in comparison with the through hole 211*w* and the first chamber 123*w*. Therefore, the groove 220*w* is also referred to as the narrow flow path 220*w*.

As shown in FIG. 6, the liquid supply portion 160*w* has a liquid supply flow path 163*w*, through which the ink of the liquid accommodation portion 420*w* flows toward the outside, and the through hole 166*w*. The through hole 166*w* communicates with the second chamber 122*w*. That is, the through hole 166*w* communicates the outside with the inner portion of the liquid supply portion 160*w* via the second chamber 122*w* and the groove 220*w*. Furthermore, it is preferable to form the through hole 166*w* after filling the liquid accommodation portion 420*w* with the ink. By doing so, it is possible to reduce the likelihood of the ink leaking out to the outside via the through hole 166*w* when filling the liquid accommodation portion 420*w* with the ink.

As shown in FIG. 7 and FIG. 8, a portion of the arm member 510*w* and the spring member (the energizing member) 520*w* are accommodated in the valve chamber 320*w*, and the spring seat 560*w* is arranged on the spring member 520*w*. The upper portion of the spring seat 560*w* is covered with the first sheet member 140*w*. The arm member 510*w* has a fulcrum 511*w*, and a first arm 512*w* and a second arm 513*w* provided on both sides of the fulcrum 511*w*. The end portion of the first arm 512*w* has a protrusion 512*aw*. The protrusion 512*aw* is pressed by the pressure plate 130*w* that is arranged on the liquid accommodation portion 420*w* and the arm member 510*w* rotates accordingly around the fulcrum 511*w*. The fulcrum 511*w* is accommodated in the fulcrum reception portion 540*w* (FIG. 7) which is provided in the container main body 110*w*. The spring member 520*w* is inserted into the distal end of the second arm 513*w*. That is, the spring member 520*w* is arranged between the second arm member 513*w* and the spring seat 560*w*. The seal member 514*w* (FIG. 8) is provided on the rear side of the second arm 513*w*. Due to the spring member 520*w*, the seal member 514*w* of the second arm 513*w* makes contact with the periphery of the through hole 550*w* which is provided on the container main body 110*w*. Accordingly, it is possible to prevent the flow of the air via the through hole 550*w*. That is, a state in which the second arm 513*w* makes contact with the periphery of the through hole 550*w* is a closed valve state, and a state in which the second arm 513*w* is separated from the periphery of the through hole 550*w* is an open valve state. In other words, the arm member 510*w* and the spring member 520*w* function as a valve member 530*w*.

Figure 9:
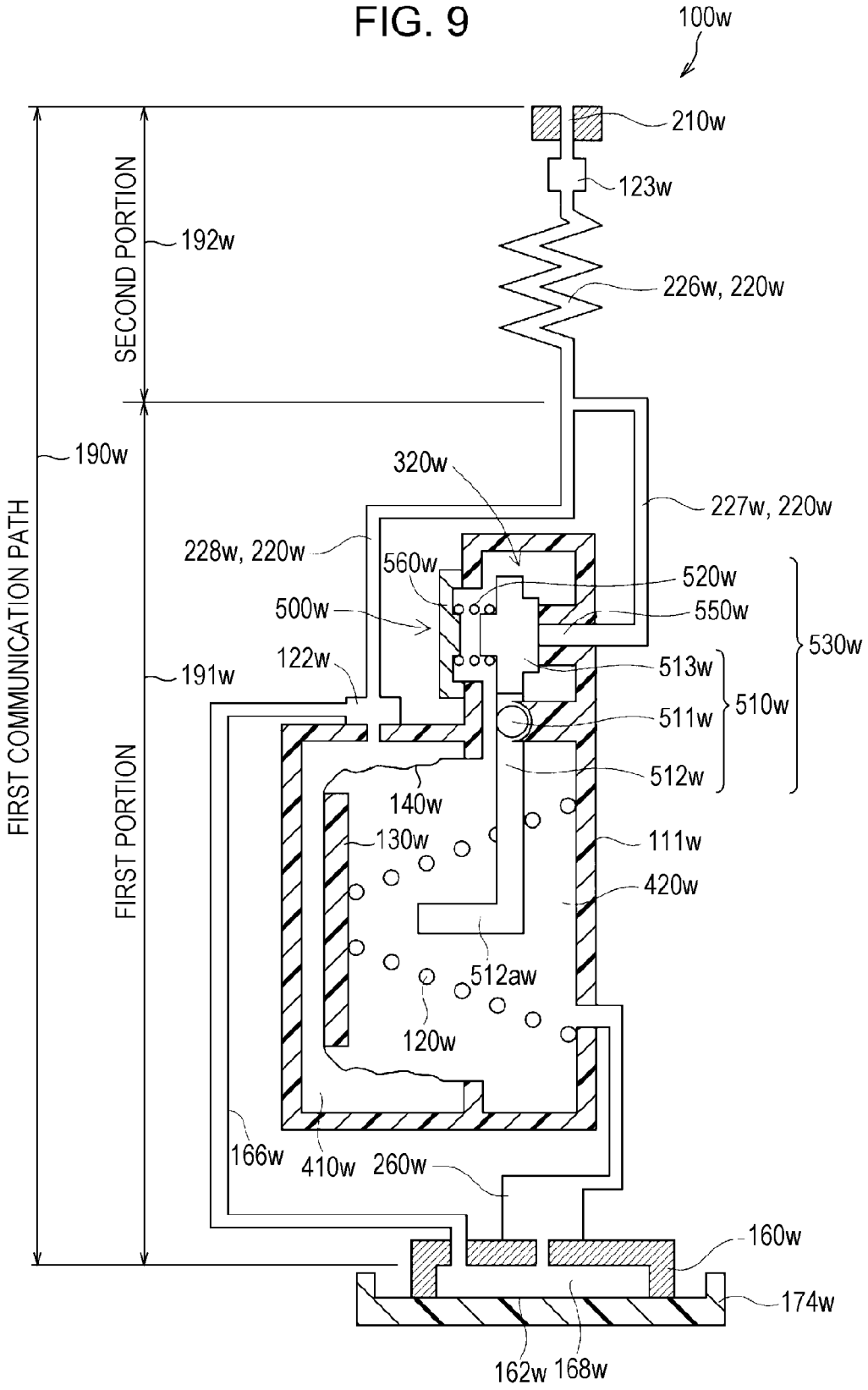
FIG. 9 is a schematic view showing the flow paths of the air and the ink in the cartridge.

FIG. 9 is a schematic view showing the flow path of the air and the ink in the cartridge. The atmosphere-open port 210*w* is depicted in the upper edge of FIG. 9, and the liquid supply portion 160*w* and the cap member 174*w* are depicted in the lower edge. Furthermore, in FIG. 9, the ink is omitted from the drawing, however, in the initial state of the cartridge 100*w*, the liquid accommodation portion 420*w*, the outlet chamber 260*w* and the valve chamber 320*w* are filled with the ink.

The air introduced from the atmosphere-open port 210*w* passes through the first chamber 123*w*, the air flow path 220*w* (specifically, the second branch groove 228*w*) and the second chamber 122*w*, and is introduced into an air chamber 410*w*. In addition, the cartridge 100*w* is configured such that the air introduced from the atmosphere-open port 210*w* passes through the air flow path 220*w* (specifically, the first branch groove 227*w*) and the valve flow path 550*w*, and can be introduced into the valve chamber 320*w* and the liquid accommodation portion 420*w*. In addition, in a state in which the cap member 174*w* is mounted in the accommodation body main body 119*w*, the cap member 174*w* seals the opening 162*w* of the liquid supply portion 160*w* and forms the inner chamber 168*w* with the liquid supply portion 160*w*. In other words, the inner chamber 168*w* is a space partitioned by the liquid supply portion 160*w* and the cap member 174*w*. The inner chamber 168*w* communicates with the outside via the through hole 166*w*, the second chamber 122*w*, the air flow path 220*w*, the first chamber 123*w* and the atmosphere-open port 210*w*. Here, the through hole 166*w*, the second chamber 122*w*, the air flow path 220*w*, the first chamber 123*w* and the atmosphere-open port 210*w* correspond to the "first communication path 190*w*" disclosed in the application examples.

A first communication path 190*w* includes a first portion 191*w*, which includes an end portion connected to the inner chamber 168*w*, and a second portion 192*w* which is positioned further to the outside air side than the first portion 191*w* in a direction along the flow path of the first communication path 190*w*. The second portion 192*w* communicates the first portion 191*w* with the outside. In addition, the second portion 192*w* is a portion of the second communication path for communicating the outside with the liquid accommodation portion 420*w*.

In a state in which the liquid accommodation portion 420*w* is filled with the ink, the through hole 550*w* is shut to a closed state due to the spring member 520*w* pushing the second arm 513*w* to the through hole 550*w* side against the atmospheric pressure. The spring member 120*w* of the liquid accommodation portion 420*w* applies a force to the pressure plate 130*w* so as to press the pressure plate 130*w* in the volume expanding direction of the liquid accommodation portion 420*w* covered by the first sheet member 140*w*. As a result, the pressure inside the liquid accommodation portion 420*w* is maintained within a suitable pressure range for supplying the ink to the print head 32*w*. The suitable pressure range is a lower pressure than the atmospheric pressure (a negative pressure).

The ink within the liquid accommodation portion 420*w* is supplied to the printing apparatus 1*w*, and when the ink within the liquid accommodation portion 420*w* is consumed, the volume of the liquid accommodation portion 420*w* decreases. That is, the pressure plate 130*w* moves to the plate-shaped portion 111*w* side. When the pressure plate 130*w* moves to the plate-shaped portion 111*w* side, the applied force of the spring member 120*w* increases and the negative pressure of the liquid accommodation portion 420*w* increases. Furthermore, when the ink of the liquid accommodation portion 420*w* is consumed and the pressure plate 130*w* moves to the plate-shaped portion 111*w* side, the pressure plate 130*w* pushes the first arm 512*w* (specifically, the protrusion 512*aw*) to the plate-shaped portion 111*w* side. Accordingly, the second arm 513*w* moves to the spring seat 560*w* side against the applied force of the spring member 520*w*, and the valve member 530*w* is temporarily in an open valve state. When the valve member 530*w* is in the open valve state, the air passes through the air flow path 220*w* and the valve flow path 550*w*, and is introduced to the valve chamber 320*w* and the liquid accommodation portion 420*w*.

When the air is introduced to the liquid accommodation portion 420*w*, the volume of the liquid accommodation portion 420*w* increases by the amount of the air introduced. At the same time, the negative pressure within the liquid accommodation portion 420*w* lowers slightly (approaches the atmospheric pressure). When a certain degree of the air is introduced to the liquid accommodation portion 420*w*, the pressure plate 130*w* separates from the first arm 512*w* and the valve member 530*w* becomes a closed valve state. In this manner, the pressure within the liquid accommodation portion 420*w* can be maintained within the suitable pressure range due to the valve member 530*w* temporarily entering an open state when the negative pressure within the liquid accommodation portion 420*w* increases with the consumption of the ink of the liquid accommodation portion 420*w*. Here, the valve chamber 320*w*, the valve flow path 550*w*, the air flow path 220*w*, the first chamber 123*w* and the atmosphere-open port 210*w* correspond to the "second communication path" disclosed in the application examples.

A-4. Effects

As described above, the cartridge 100*w* of the first example is provided with a first communication path 190*w* that connects the inner chamber 168*w* to the ambient atmosphere (FIG. 9). Accordingly, when the cap member 174*w* is attached to the accommodation body main body 119*w* so as to seal the opening 162*w*, it is possible to prevent the air of the inner chamber 168*w* from being compressed and flowing into the liquid accommodation portion 420*w* via the outlet chamber 260*w*. That is, the air of the inner chamber 168*w* can escape to the outside using the first communication path 190*w*. Accordingly, when the cartridge 100*w* is mounted in the printing apparatus 1*w* and printing is executed, the occurrence of issues such as an air shot may be reduced.

In addition, in the cartridge 100*w* of the first example, a portion of the first communication path 190*w* is configured by the second communication path. Accordingly, it is possible to cause the air of the inner chamber 168*w* to escape to the outside using a portion of the second communication path which has the atmosphere-open port 210*w* on an end portion thereof. That is, it is possible for the first communication path 190*w* and the second communication path to use a common opening in order to be communicated with the atmosphere.

In addition, in the cartridge 100*w* of the first example, the first communication path 190*w* has a narrow flow path 220*w*. Accordingly, it is possible to reduce the evaporation of the ink of the liquid accommodation portion 420*w* through the outlet chamber 260*w*, the inner chamber 168*w* and the first communication path 190*w*. Furthermore, since the flow path length of a portion of the narrow flow path 220*w* can be lengthened by using a meandering flow path 226*w*, it is possible to further reduce the evaporation of the ink of the liquid accommodation portion 420*w*.

B. Second Example

Figure 10:
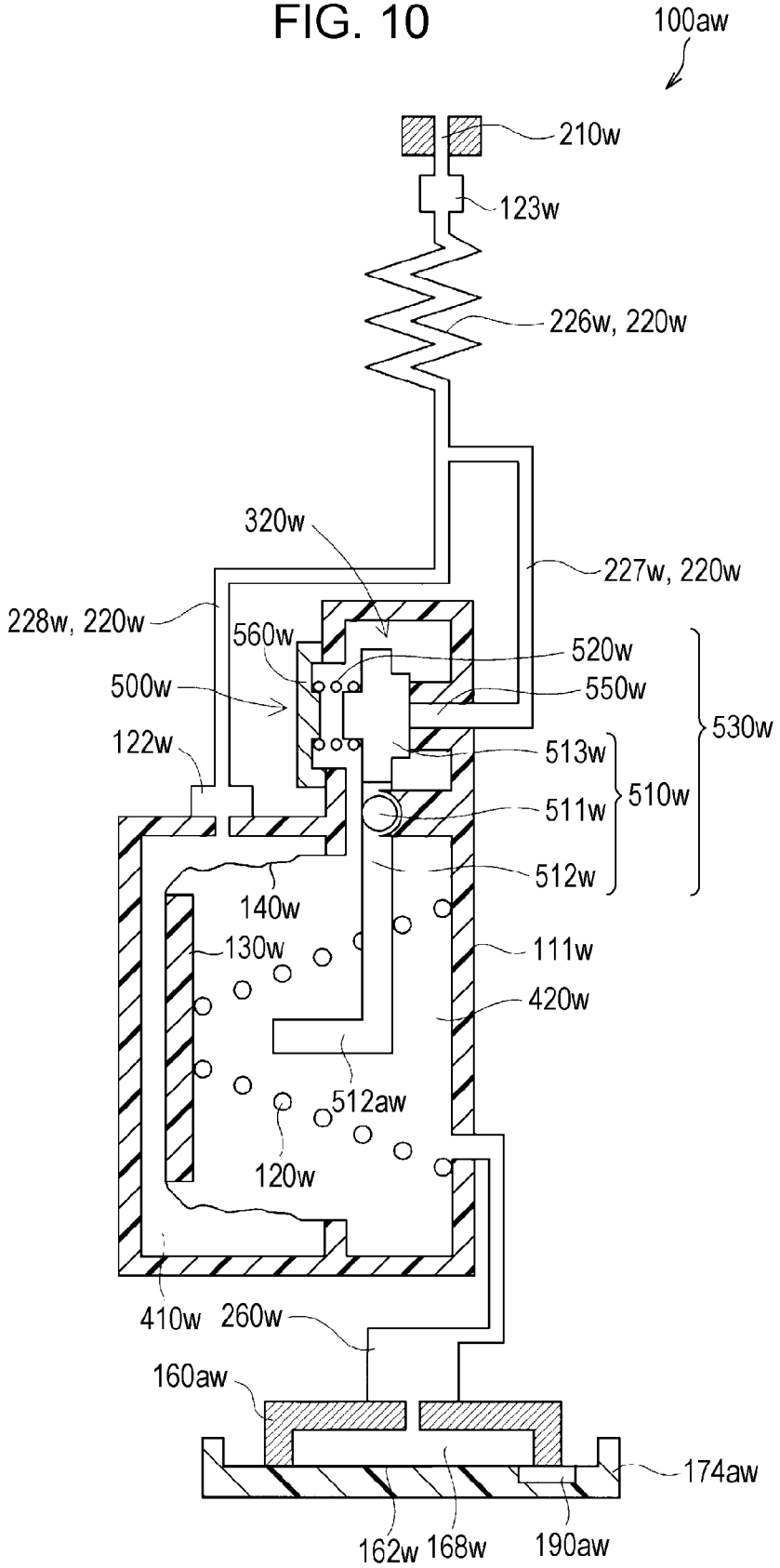
FIG. 10 is a view for illustrating the cartridge of the second example.

FIG. 10 illustrates a cartridge 100*aw* of the second example. FIG. 10 is a schematic view showing the flow path of the air and the ink in the cartridge 100*aw*, in the same manner as FIG. 9. The difference between the first example and the second example is the configuration of a cap member 174*aw*, a first communication path 190*aw* and a liquid supply portion 160*aw*. Since the configuration of the other elements is the same as in the cartridge 100*w* of the first example, the configurations which are the same as in the first example will be given the same reference numerals and description thereof will be omitted.

In the cartridge 100*aw* of the second example, the first communication path is formed by providing a groove 190*aw* in the cap member 174*aw*. Specifically, a groove 190*aw* is provided in a portion of the part of the cap member 174*aw* which makes contact with the liquid supply portion 160*w* and blocks the opening 162*w*. The groove 190*aw* communicates the inner chamber 168*w* with the outside. Furthermore, the liquid supply portion 160*aw* of the second example, unlike in the first example, does not have the through hole 166*w* (FIG. 9).

Whether using the configuration according to the first or the second example, when the cap member 174*aw* is attached to the container main body 110*w* so as to seal the opening 162*w*, it is possible to prevent the air of the inner chamber 168*w* from being compressed and flowing into the liquid accommodation portion 420*w* via the outlet chamber 260*w*. That is, it is possible to cause the air of the inner chamber 168*w* to escape to the outside using the first communication path 190*aw*. In addition, in the second example, since the first communication path 190*aw* is provided in the cap member 174*aw* which is separate from the accommodation body main body 119*w*, it is possible to easily form the first communication path 190*aw*.

Furthermore, the first communication path 190*aw* may also be obtained by forming a through hole in the cap member 174*aw* in order to communicate the inner chamber 168*w* with the outside. By doing so, the same effect may be obtained as in the cartridge 100*aw* of the second example.

In addition, even in a case in which the first communication path 190*aw* is formed by providing a groove or a through hole in the cap member 174*aw*, similarly to the first example, it is preferable that a portion of the first communication path 190*aw* be a narrow flow path. By doing so, it is possible to further reduce the likelihood of the ink of the liquid accommodation portion 420*w* evaporating. Furthermore, it is preferable that a portion of the first communication path 190*aw* be a meandering flow path. By doing so, it is possible to reduce the evaporation of the ink of the liquid accommodation portion 420*w*.

C. Third Example

Figure 11:
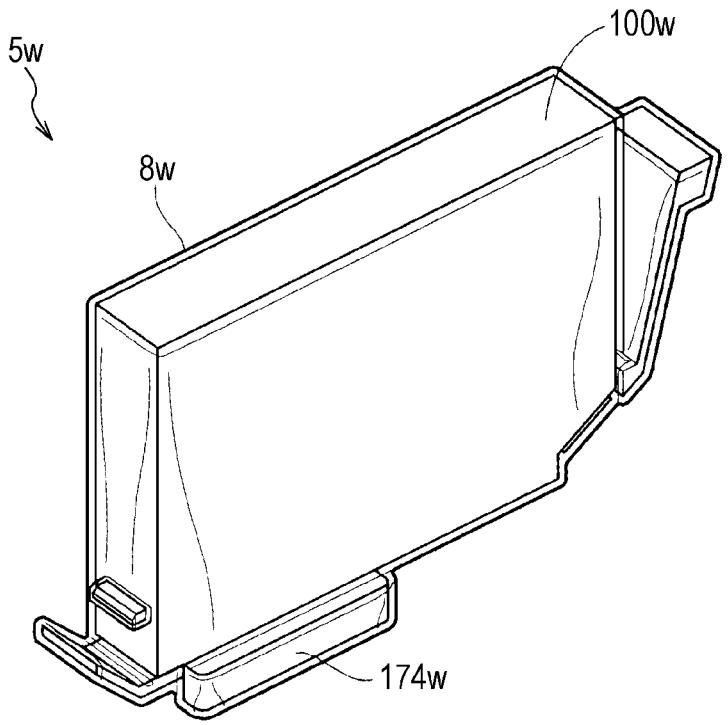
FIG. 11 is a view for illustrating an accommodation body unit.

FIG. 11 illustrates an accommodation body unit 5*w*. The accommodation body unit 5*w* is provided with the cartridge 100*w*, the inner portion of which is filled with ink, and a packaging material (a reduced pressure pack) 8*w*. The accommodation body unit 5*w* is boxed and the like in this state and is shipped. The packaging material 8*w* is fabricated, for example, from a synthetic resin such as polyethylene or nylon. The packaging material 8*w* accommodates the ink cartridge 100*w* in the inner portion at a lower pressure than the atmospheric pressure. Specifically, the cartridge 100*w* is accommodated in the packaging material 8*w*, and the inner portion of the packaging material is subsequently decompressed by removing the air of the inner portion.

As described above, since in the accommodation body unit 5*w* of the third example, the inner portion of the packaging material 8*w* is decompressed to a lower pressure than the atmospheric pressure, it is possible to obtain a reduction in the amount of dissolved gas in the ink of the inner portion of the cartridge 100*w*. In addition, the cartridge 100*w* of the accommodation body unit 5*w* of the third example is provided with the first communication path 190*w* (FIG. 9). Accordingly, even in a case in which the inner portion of the packaging material 8*w* is decompressed, it is possible to substantially maintain the same pressure between the inner chamber 168*w* and the air chamber 410*w* (FIG. 9) which is a region in contact with the outer surface of the first sheet member 140*w*. Accordingly, it is possible to prevent the air of the inner chamber 168*w* from flowing into the liquid accommodation portion 420*w*. That is, in a case in which the cartridge 100*w* is not provided with the first communication path 190*w* and the inner chamber 168*w* is in an airtight state, when the cartridge

100*w* is accommodated in the packaging material 8*w* and the inner portion of the packaging material 8*w* is decompressed, the air within the inner chamber 168*w* expands due to the air chamber 410*w* that communicates with the outside being decompressed. When the air within the inner chamber 168*w* expands, the air of the inner chamber 168 passes through the outlet chamber 260*w* and is sucked into the liquid accommodation portion 420*w*. However, when the cartridge 100*w* is provided with the first communication path 190*w*, since not only the air chamber 410*w*, but also the inner chamber 168*w*, is decompressed with the decompression of the inner portion of the packaging material 8*w*, the pressures of both the air chamber 410*w* and the inner chamber 168*w* which interpose the liquid accommodation portion 420*w* are balanced. Accordingly, it is possible to prevent the air of the inner chamber 168*w* from being sucked into the liquid accommodation portion 420*w*. Furthermore, the cartridge 100*aw* and the packaging material 8*w* of the second example may also be combined and used as the accommodation body unit.

D. Fourth Example

D-1: Configuration of Printing Material System

Figure 12:
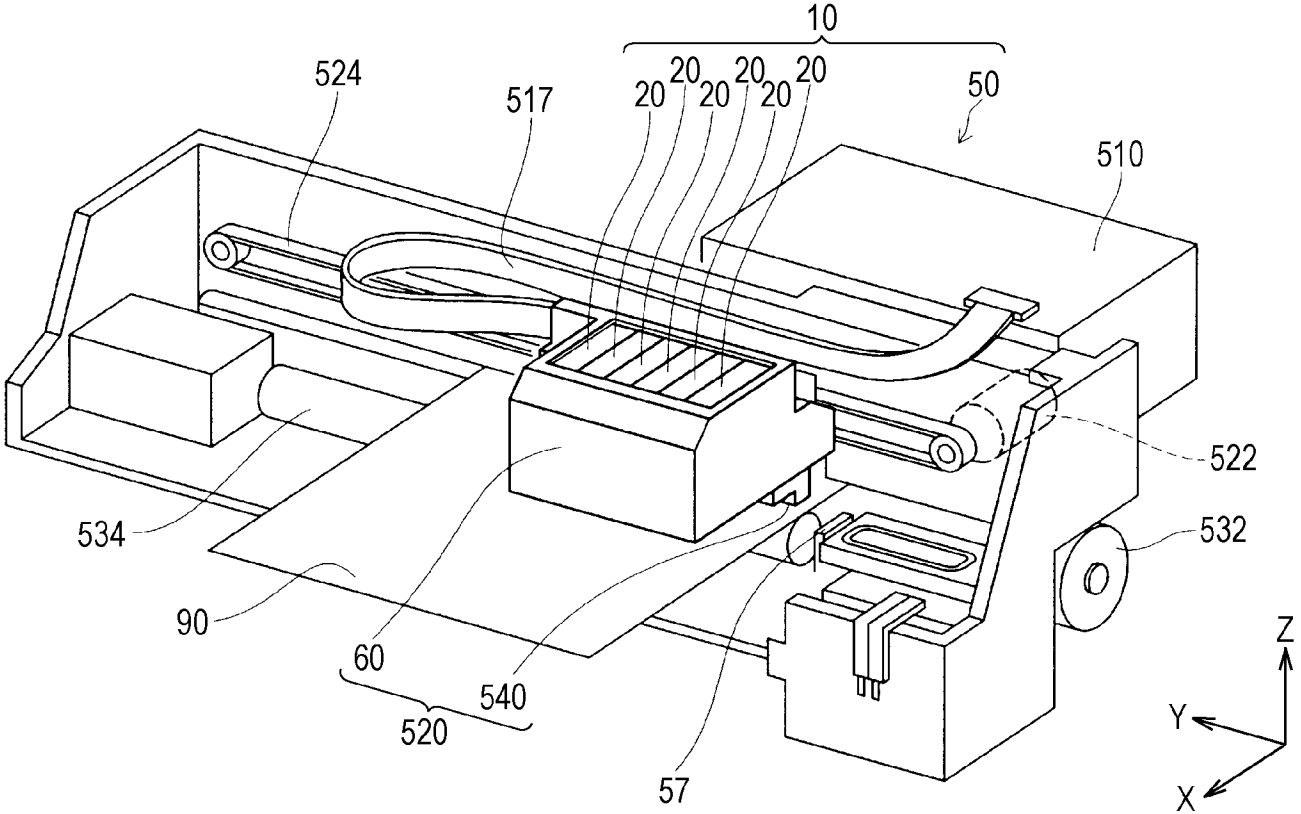
FIG. 12 is a perspective view showing the configuration of a printing material supply system.

FIG. 12 is a perspective view showing the configuration of the printing material supply system 10. In FIG. 12, the orthogonal X, Y and Z axis are depicted. The X, Y and Z axis in FIG. 12 correspond to the X, Y and Z axis in the other diagrams. The printing material supply system 10 is provided with a cartridge 20 and a printer 50 as the printing apparatus. In the printing material supply system 10, the cartridge 20 is mounted to the holder 60 of the printer 50 by the user in a detachable manner.

The cartridge 20 of the printing material supply system 10 accommodates the ink in the inner portion thereof as the printing material (the liquid). The ink accommodated in the cartridge 20 is supplied to a head 540 via the printing material supply port and the printing material supply tube described below. In the present example, a plurality of the cartridges 20 are mounted to the holder 60 of the printer 50 in a detachable manner. In the present example, six types of cartridge 20 corresponding to six colors (black, yellow, magenta, light magenta, cyan and light cyan) of ink, in other words a total of six cartridges 20, are mounted to the holder 60 one at a time.

In the other examples, the number of cartridges mounted in the holder 60 may be six or less, and may also be six or more. In the other examples, the number of types of ink of the cartridge 20 may be six or less, and may also be six or more. In the other examples, two or more cartridges 20 may be mounted to the holder 60 corresponding to one color of the ink. The configuration of the cartridge 20 and the holder 60 will be described in detail below.

The printer 50 of the printing material supply system 10 is a miniature ink jet printer for personal use. Other than the holder 60, the printer 50 may be provided with a carriage 520 that has a control unit 510 and the holder 60. The carriage 520 is provided with the head 540. The printer 50 causes the ink to flow from the cartridge 20 mounted in the holder 60 into the head 540 via the printing material supply tube described below, and discharges (supplies) the ink from the head 540 onto a printing medium 90 such as paper, labels, or the like. Accordingly, data such as printed characters, drawings and images is printed onto the printing medium 90 using the head 540.

The control unit 510 of the printer 50 controls each part of the printer 50. The carriage 520 of the printer 50 is configured so as to be able to move the head 540 relatively to the printing medium 90. The head 540 of the printer 50 is provided with an ink discharging mechanism which discharges the ink accommodated in the cartridge 20 onto the printing medium 90. There is an electrical connection between the control unit 510 and the carriage 520 via a flexible cable 517 and the ink discharging mechanism of the head 540 operates on the basis of control signals from the control unit 510.

A detection unit 57 for optically detecting whether the ink is present within the cartridge 20 or not is provided in a position outside of the printing region of the printer 50. A light emitting portion and a light receiving portion are provided in the inner portion of the detection unit 57. The control unit 51 emits light using the light emitting portion of the detection unit 57 when the cartridge 20 passes over the detection unit 57 with the movement of the carriage 52, and the presence of the ink within the cartridge 20 is detected according to whether the light receiving portion of the detection unit 57 receives the light or not.

In the present example, the carriage 520 is configured with a holder 60 in addition to the head 540. In this manner, the type of the printer 50 in which the cartridge 20 is mounted in the holder 60 above the carriage 520 that moves the head 540 is also referred to as "on-carriage type". In the other examples, a static holder 60 is configured in a position different to the carriage 520, and the ink from the cartridge 20 mounted in the holder 60 may be supplied to the head 540 of the carriage 520 via the flexible tube. Such a type of printer is also referred to as "off-carriage type".

In the present example, the printer 50 is provided with a main scanning feed mechanism and a sub-scanning feed mechanism for moving the carriage 520 and the printing medium 90 relative to each other to realize the printing in relation to the printing medium 90. The main scanning feed mechanism of the printer 50 is provided with a carriage motor 522 and a drive belt 524, and reciprocally moves the carriage 520 in the main scanning direction by transmitting the power from the carriage motor 522 to the carriage 520 via the drive belt 524. The sub-scanning feed mechanism of the printer 50 is provided with a transport motor 532 and a platen 534, and transports the printing medium 90 in the sub-scanning direction orthogonal to the main scanning direction by transmitting the power from the transport motor 532 to the platen 534. The carriage motor 522 of the main scanning feed mechanism and the transport motor 532 of the sub-scanning feed mechanism operate on the basis of control signals from the control unit 510.

In the present example, in the usage state (also referred to as the "usage position") of the printing material supply system 10, the axis along the sub-scanning direction (the front-rear direction) in which the printing medium 90 is transported is the X axis, the axis along the main scanning direction (the left-right direction) in which the carriage 520 is reciprocally moved is the Y axis, and the axis along the gravity direction (the vertical direction) is the Z axis. Furthermore, the usage state of the printing material supply system 10 is a state in which the printing material supply system 10 is arranged on a horizontal plane, and in the present example, a horizontal plane is a plane parallel with the X axis and the Y axis (an XY plane).

In the present example, the sub-scanning direction (the forward direction) is the +X axis direction, the opposite direction (the rearward direction) is the −X axis direction, the direction from below to above in the gravity direction (the upward direction) is the +Z axis direction, and the opposite direction (the downward direction) is the −Z axis direction. In the present example, the +X axis direction side (the front side) is the front of the printing material supply system 10. In the present example, the direction from the right side plane toward the left side plane of the printing material supply system 10 is the +Y axis direction (the left direction), and the opposite direction is the −Y axis direction (the right direction). In the present example, the arrangement direction of the plurality of the cartridges 20 mounted in the holder 60 is a direction along the Y axis (the left-right direction, also referred to as the "Y axis direction"). Furthermore, the direction along the X axis (the front-rear direction) is also referred to as the "X axis direction" and the direction along the Z axis (the vertical direction) is also referred to as the "Z axis direction".

D-2. Configuration of Holder

Figure 13:
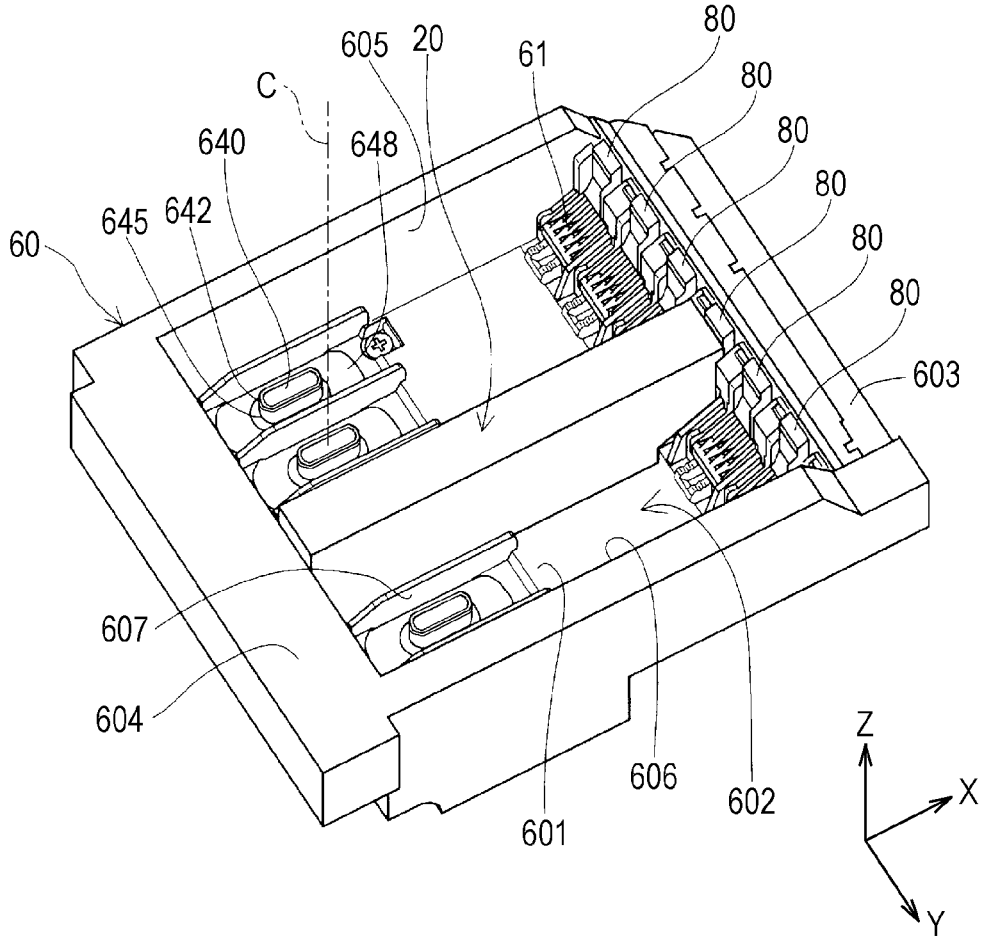
FIG. 13 is a first perspective view showing a holder to which a cartridge is mounted.
Figure 14:
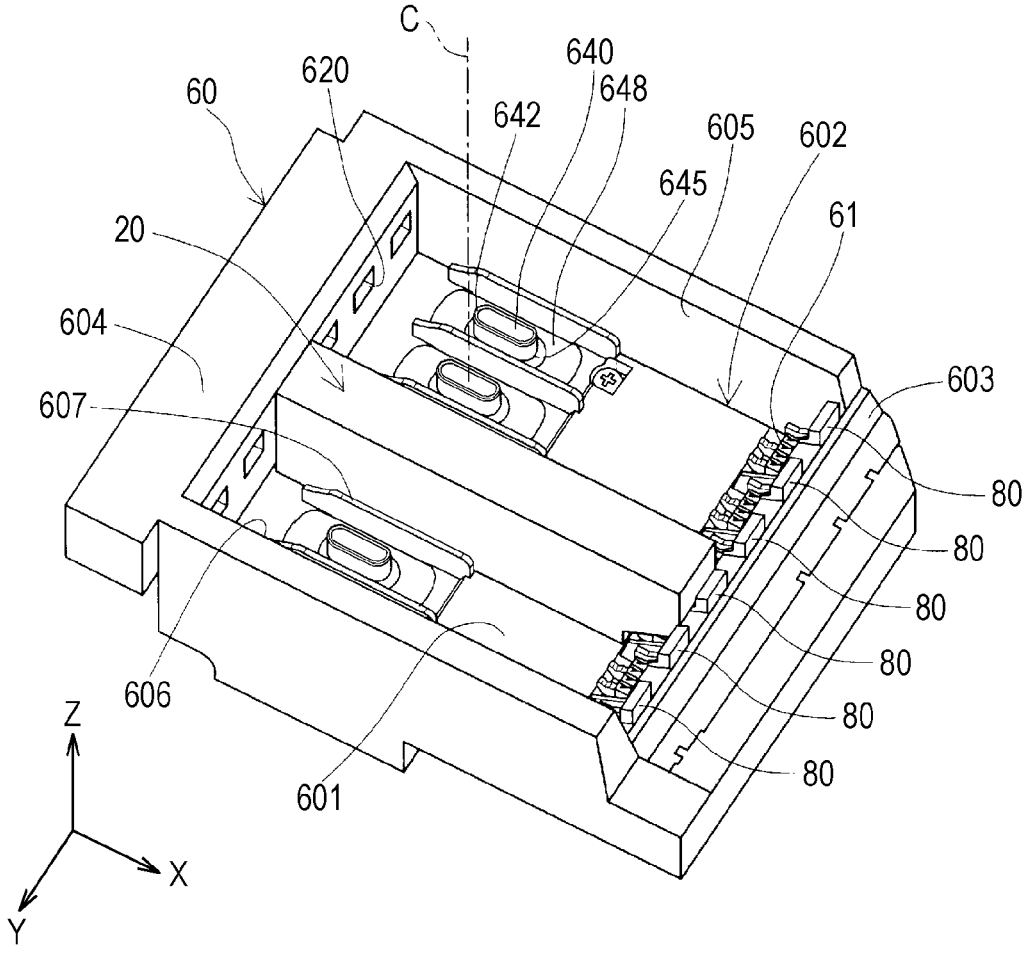
FIG. 14 is a second perspective view showing the holder to which the cartridge is mounted.

FIG. 13 is a first perspective view showing the holder 60 to which the cartridge 20 is mounted. FIG. 14 is a second perspective view showing the holder 60 to which the cartridge 20 is mounted. FIG. 13 and FIG. 14 depict a state in which one of the cartridges 20 is mounted in the holder 60.

As shown in FIG. 13 and FIG. 14, the holder 60 of the printer 50 has five wall portions 601, 603, 604, 605 and 606. The concave portion formed by these five wall portions is a cartridge accommodation chamber 602 (also referred to as the "cartridge mounting portion 602"). In addition, the cartridge accommodation chamber 602 is divided by a partition wall 607 into a plurality of slots (mounting spaces) capable of accepting each of the cartridges 20. The partitioning wall 607 functions as a guide when the cartridge 20 is inserted into the slot. Each of the slots is provided with a printing material supply tube 640, a connection mechanism 61, a lever 80 and a second apparatus-side restricting portion 620 (FIG. 14). One side of each of the slots (the +Z axis direction side; the upper plane) is open and the cartridge 20 is attached and detached via this open side (the upper surface) in relation to the holder 60. The printing material supply tube 640 is provided so as to be interposed by two of the partitioning walls 607.

The cartridge 20 is locked in by the lever 80 and the second apparatus-side restricting portion 620, and is mounted to the holder 60 due to the printing material supply port described below being connected to the printing material supply tube 640. This state is referred to as "a state in which the cartridge 20 is mounted in the holder 60" or "a mounted state". The printing material supply tube 640 causes the ink accommodated in the cartridge 20 to flow to the head 540 due to being connected to the printing material supply port of the cartridge 20. The printing material supply tube 640 has a distal end portion (also referred to as the "connecting end portion") 642 positioned on the +Z axis side and a base end portion 645 positioned on the −Z axis side. The base end portion 645 is provided on a base wall portion 601. The distal end portion 642 is connected to the printing material supply port of the cartridge 20. The central axis C of the printing material supply tube 640 is parallel with the Z axis. The direction along the central axis C from the base end portion 645 toward the distal end portion 642 is the +Z axis direction.

As shown in FIG. 13 and FIG. 14, an elastic member 648 is provided on the periphery of the printing material supply tube 640. In a mounted state, the elastic member 648 seals the periphery of the printing material supply port of the cartridge 20. Accordingly, the elastic member 648 prevents the ink from leaking out from the printing material supply port to the periphery. In the mounted state, the elastic member 648 applies a force containing a component in the +Z axis direction to the cartridge 20.

In addition, in the mounted state, due to the terminal group provided on the circuit board described below of the cartridge 20 and the connection mechanism 61 being connected to one another electrically, propagation of various types of information between the cartridge 20 and the printer 50 is performed.

In addition, while not shown in the drawings, in order to optically detect the presence of the ink using the detection unit 57, a through hole is formed in the wall portion 601 so that light can pass through.

D-3. Configuration of External Appearance of Cartridge

Figure 15:
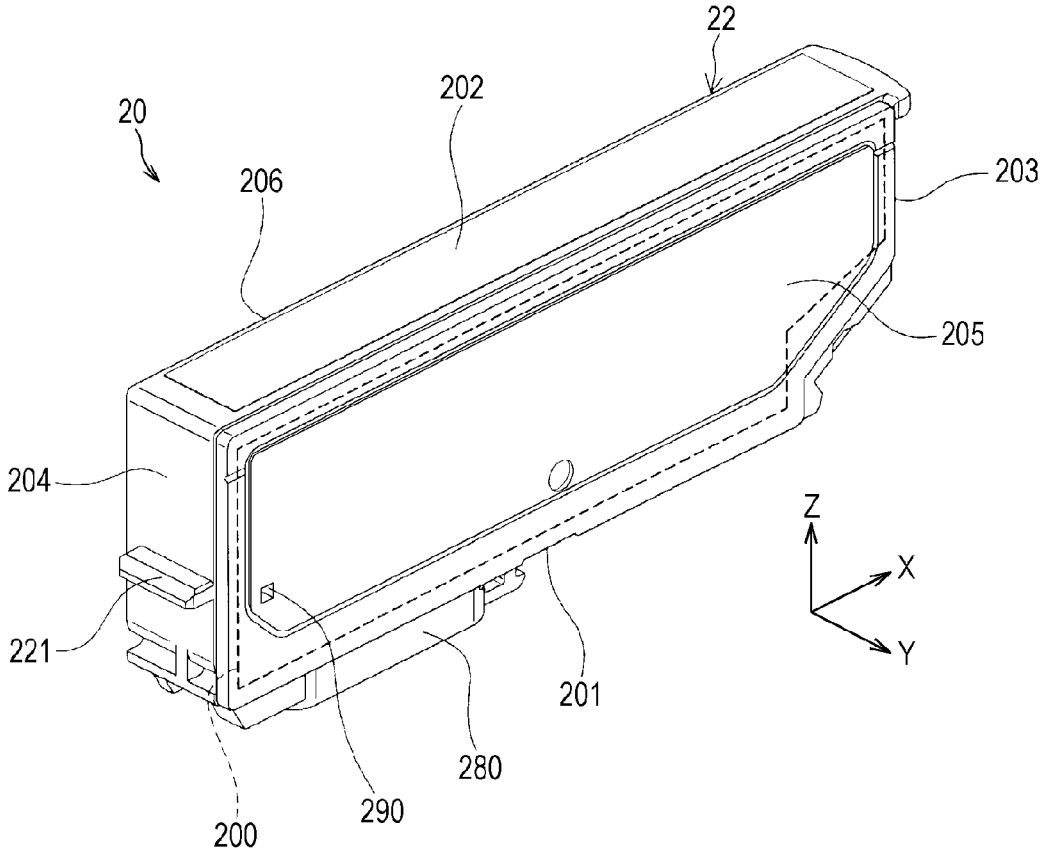
FIG. 15 is a first perspective view of the external appearance of the cartridge.
Figure 16:
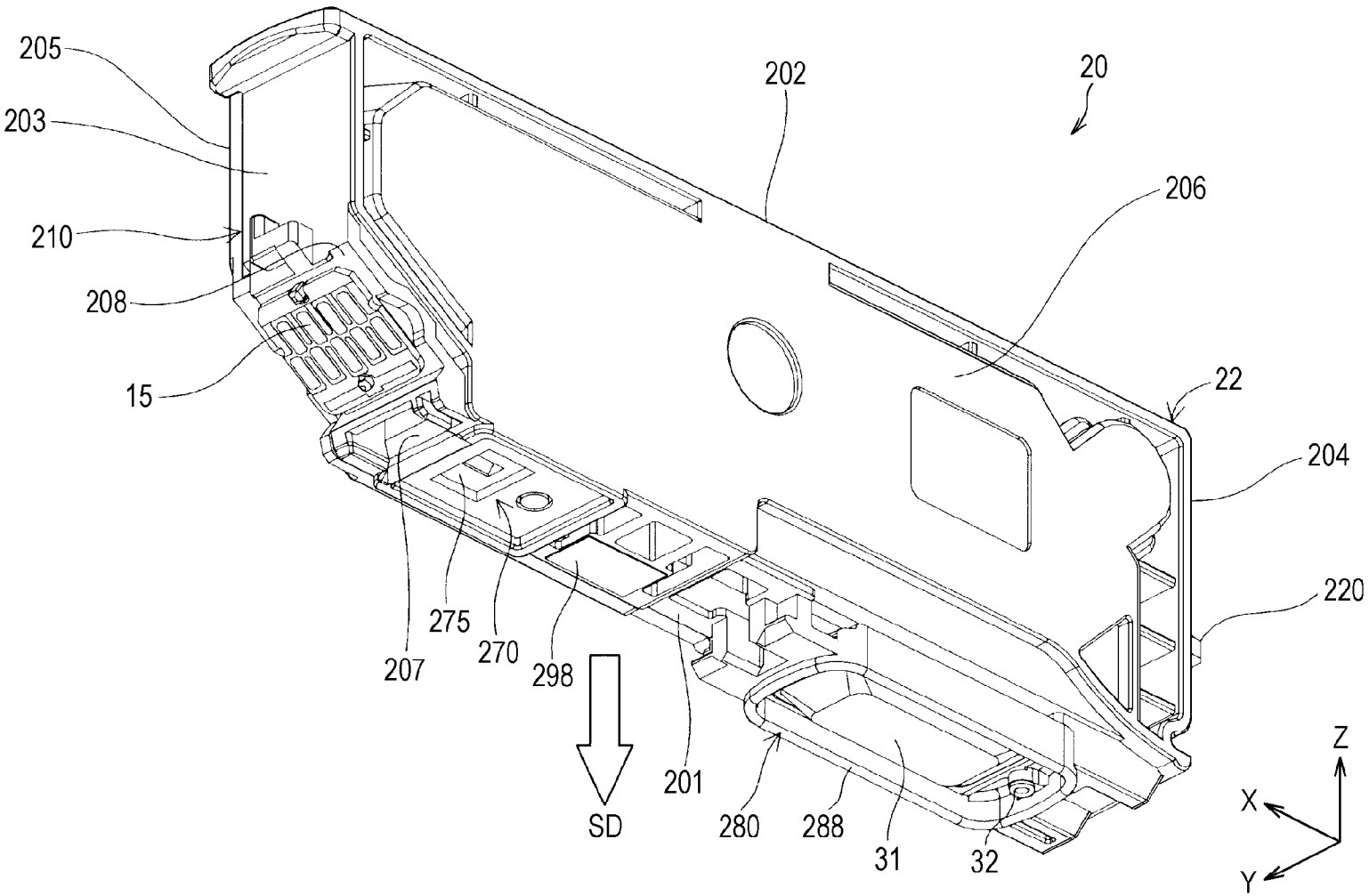
FIG. 16 is a second perspective view of the external appearance of the cartridge.
Figure 17:
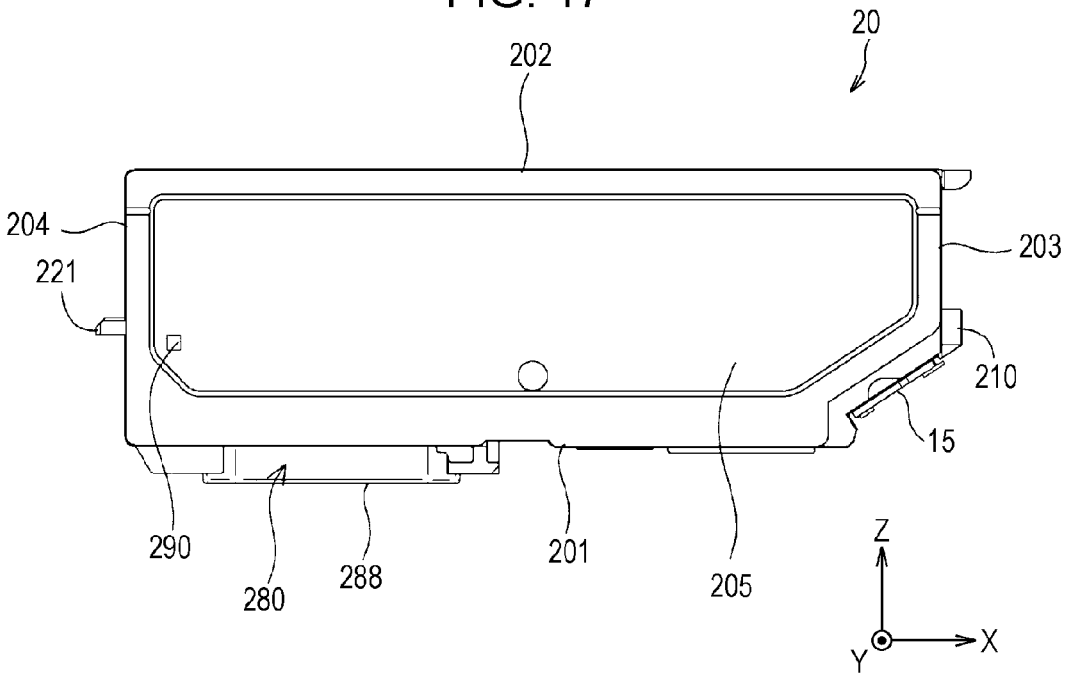
FIG. 17 is a view of the left side plane of the cartridge.
Figure 18:
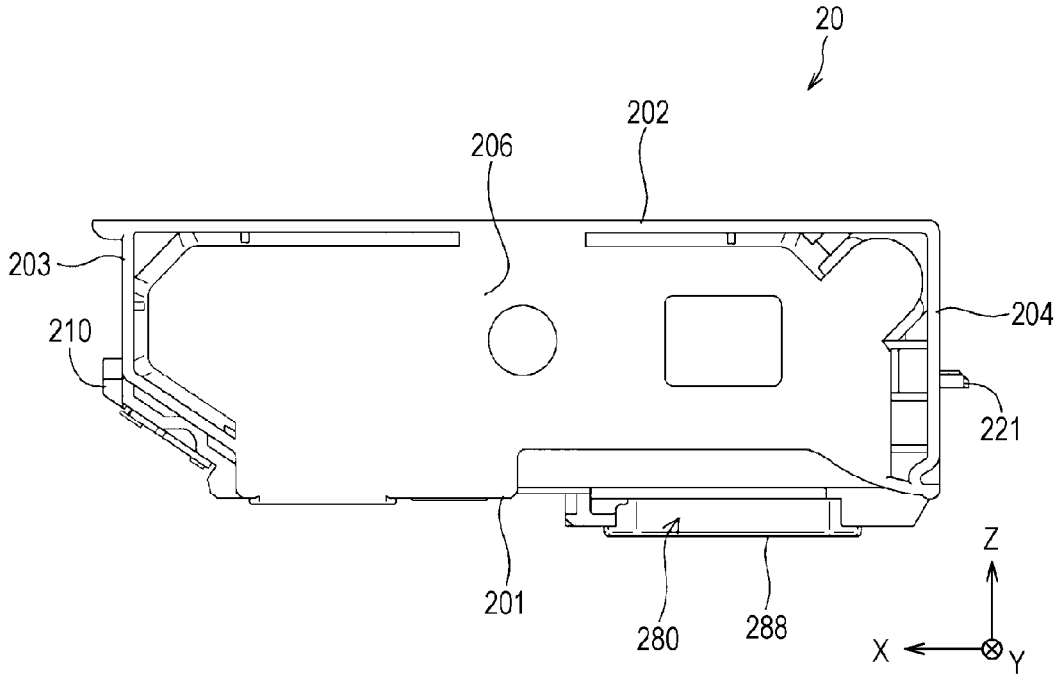
FIG. 18 is a view of the right side plane of the cartridge.
Figure 19:
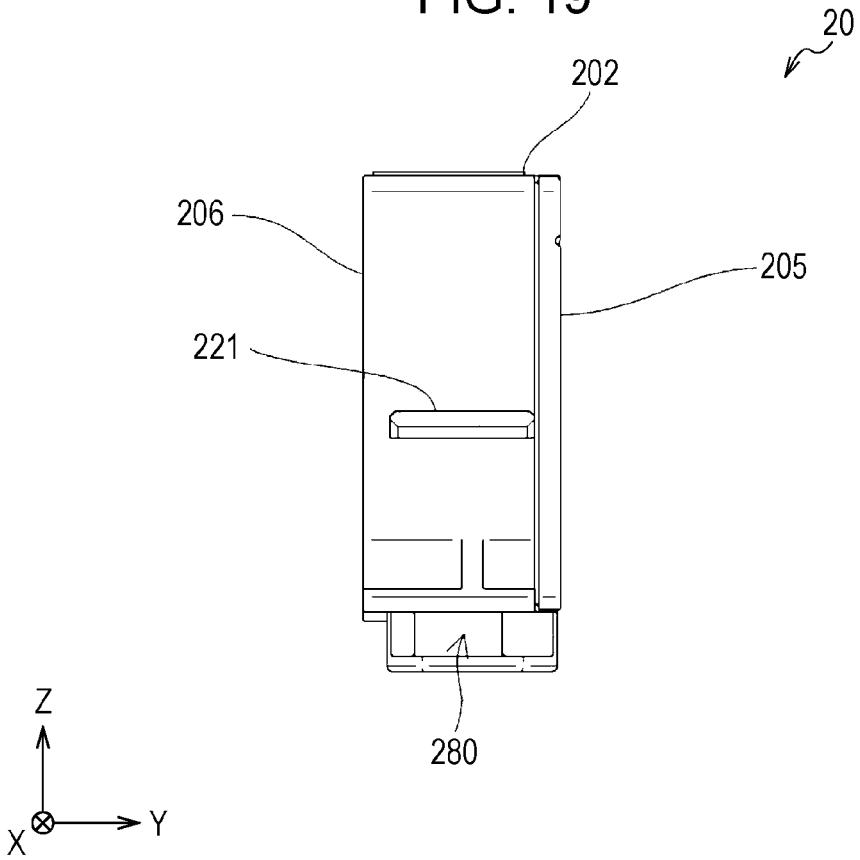
FIG. 19 is a view of the rear plane of the cartridge.
Figure 20:
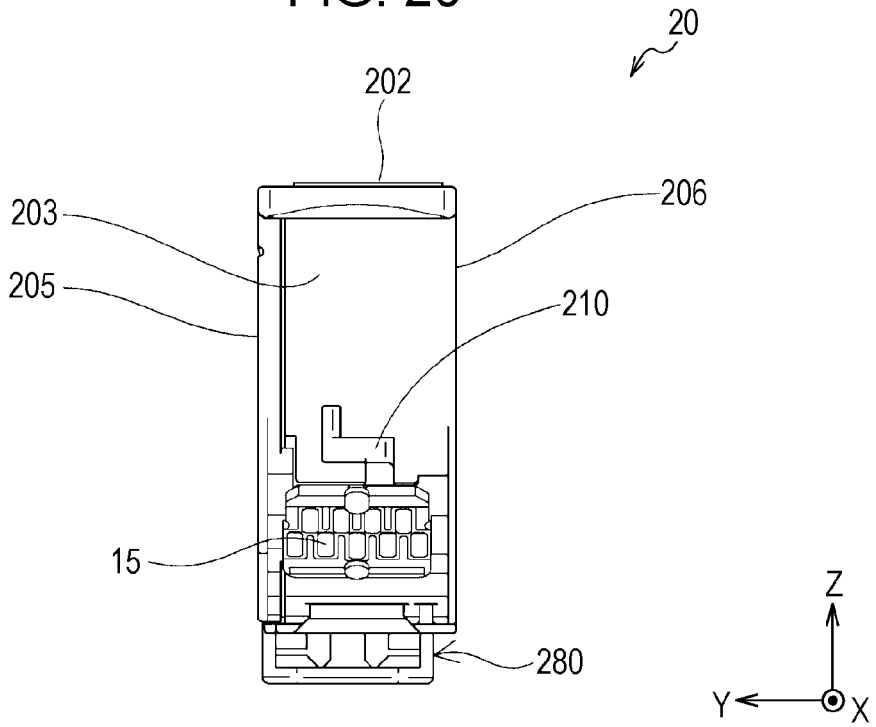
FIG. 20 is a view of the front plane of the cartridge.
Figure 21:
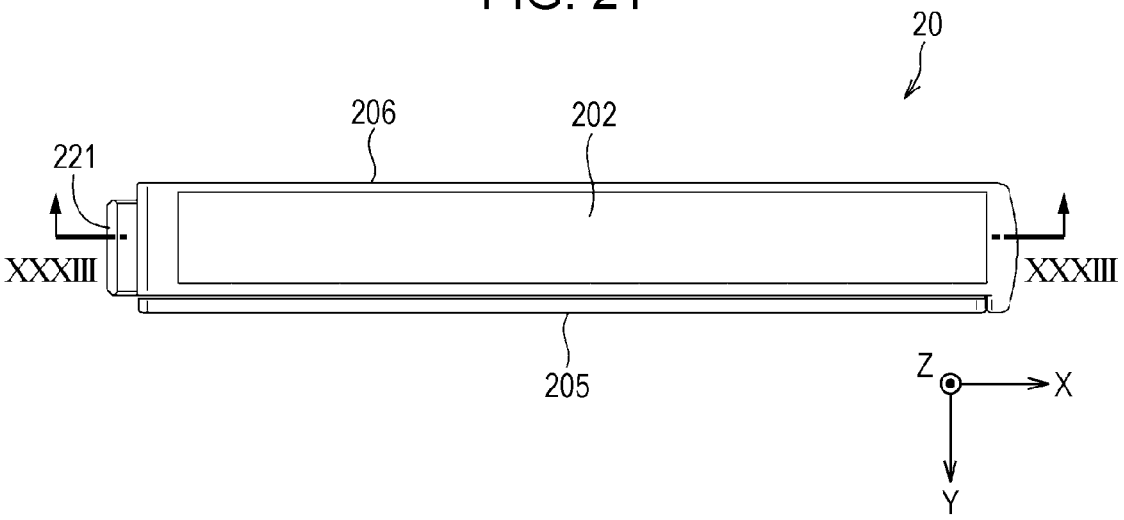
FIG. 21 is a view of the upper plane of the cartridge.
Figure 22:
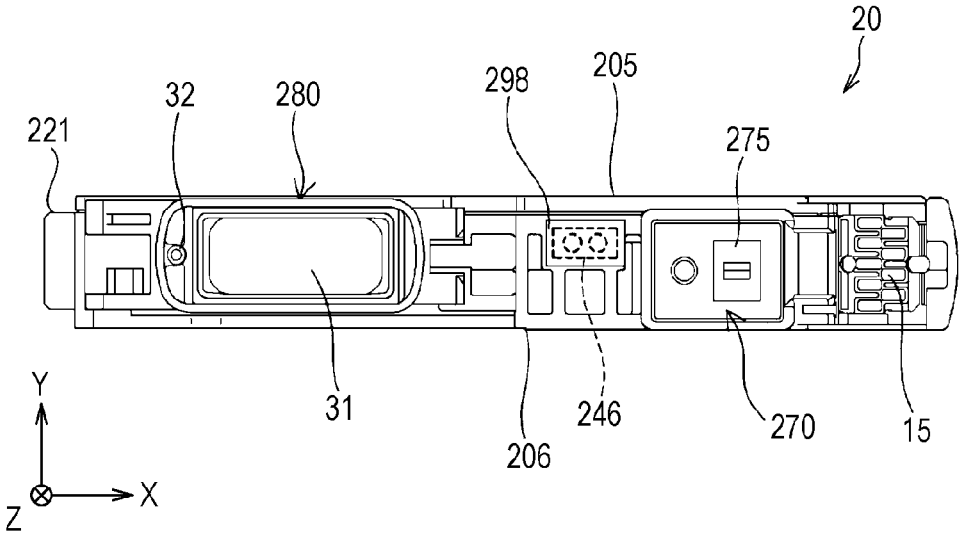
FIG. 22 is a view of the lower plane of the cartridge.

FIG. 15 is a first perspective view of the external appearance of the cartridge 20. FIG. 16 is a second perspective view of the external appearance of the cartridge 20. FIG. 17 is a view of the left side plane of the cartridge 20. FIG. 18 is a view of the right side plane of the cartridge 20. FIG. 19 is a view of the rear plane of the cartridge 20. FIG. 20 is a view of the front plane of the cartridge 20. FIG. 21 is a view of the upper plane of the cartridge 20. FIG. 22 is a view of the lower plane of the cartridge 20. The cartridge 20 of the present example is a so-called half-sealed type of the cartridge 20 which intermittently introduces the air of the outside to the printing material accommodation chamber 200 with the consumption of the ink.

As shown in FIG. 15, the cartridge 20 is provided with a printing material accommodation chamber 200 for accommodating the ink in the inner portion, and a printing material supply port 280 for causing the ink of the printing material accommodation chamber 200 to flow to the printer 50 of the outside.

As shown in FIG. 15 and FIG. 16, the cartridge 20 has a substantially cube shaped outer shell 22. The cartridge 20 has six planes 201 to 206 as the six wall portions which configure the outer shell 22. The six planes are a first plane 201 (a lower plane 201), a second plane 202 (an upper plane 202), a third plane 203 (a front plane 203), a fourth plane 204 (a rear plane 204), a fifth plane 205 (a left side plane 205) and a sixth plane 206 (a right side plane 206). In addition, as shown in FIG. 16, the cartridge 20 has, as well as the six planes, a seventh plane 207 and an eighth plane 208. Each of the planes 201 to 208 is substantially flat. The term "substantially flat" includes a case in which the entire region of the plane is completely flat, and a case in which a portion of the plane has irregularities. That is, this includes a case in which the plane can be understood to be a plane or a wall configuring the outer shell 22 of the cartridge 20, even when a portion of the plane has some irregularities. The exterior shapes of the first to eighth planes 201 to 208 from a plan view are all rectangles. In the present example, the first plane 201 to the eighth plane 208 may also be the outer surface of an assembled body that is assembled of a plurality of members. In the present example, the first plane 201 to the eighth plane 208 are formed by plate-shaped members. In the other examples, a portion of the first plane 201 to the eighth plane 208 may also be formed by film-shaped (thin film-shaped) members. The first plane 201 to the eighth plane 208, for example, are formed by a synthetic resin such as a polyacetal (POM).

In the present example, when arranged in order from the largest, the length (the length of the X axis direction), the width (the length of the Y axis direction) and the height (the length of the Z axis direction) of the cartridge 20 are in the order of length, height, width. The magnitude relationship between the length, the width and the height of the cartridge 20 may be arbitrarily changed, and for example, may be in the order of height, length, width, and the height, length and the width may also be equal, respectively.

As shown in FIG. 15 and FIG. 16, the first plane 201 and the second plane 202 are planes which are parallel on the X axis and the Y axis. The first plane 201 and the second plane 202 oppose one another in the Z axis direction. The first plane 201 is positioned on the −Z axis direction side, and the second plane 202 is positioned on the +Z axis direction side. The first plane 201 and the second plane 202 are in an orthogonal positional relationship with the third plane 203, the fourth plane 204, the fifth plane 205 and the sixth plane 206. The third plane 203 and the fourth plane 204 are planes which are parallel on the Y axis and the Z axis. The third plane 203 and the fourth plane 204 oppose one another in the X axis direction. The third plane 203 is positioned on the +X axis direction side, and the fourth plane 204 is positioned on the −X axis direction side. The fifth plane 205 and the sixth plane 206 are planes which are parallel on the X axis and the Z axis. The fifth plane 205 and the sixth plane 206 oppose one another in the Y axis direction. Furthermore, in the present specification, two planes being "orthogonal" means any one of a state in which two continual planes are orthogonal to one another, a state in which the extending plane of one plane is orthogonal to the other plane, and a state in which the respective extending planes are orthogonal to one another. In the present example, in a state in which the cartridge 20 is mounted in the holder 60, the first plane 201 configures the lower plane of the cartridge 20 and the second plane 202 configures the upper plane of the cartridge 20. As shown in FIG. 16, the seventh plane 207 and the eighth plane 208 are planes which are continuous with the first plane 201 and the third plane 203. The seventh plane 207 is connected to the first plane 201, and the eighth plane 208 is connected to the third plane 203.

As shown in FIG. 15 and FIG. 16, the printing material supply port 280 is provided to protrude from the first plane 201. The printing material supply port 280 extends from the first plane 201 along the −Z axis direction. The printing material supply port 280 has an open end 288 that forms an opening in the end portion. The opening formed by the open end 288 is positioned on a flat plane perpendicular to the direction (the −Z axis direction) in which the printing material supply port 280 protrudes. That is, the opening formed by the open end 288 is formed along a plane parallel to the X axis and the Y axis.

As shown in FIG. 16 and FIG. 22, a printing material outlet 31, where the ink that flows from the printing material accommodation chamber 200 into the printing material supply port 280 flows out to the outside, is provided within the printing material supply port 280. The printing material outlet 31 makes contact with the distal end portion 642 side of the printing material supply tube 640 in the mounted state. Accordingly, the ink flows to the printing material supply tube 640 via the printing material outlet 31. The printing material outlet 31 is formed of a porous sheet member through which the ink can flow.

As shown in FIG. 16 and FIG. 22, a communication port 32 is formed within the printing material supply port 280 as an opening for communicating the inside of the printing material supply port 280 and the outside. The communication port 32 is provided further to the downstream side than the printing material outlet 31 in the flow direction (the −Z axis direction) of the ink of the printing material supply port 280. In addition, in a case in which the cartridge 20 is projected perpendicularly onto the first plane 201, the communication port 32 is provided in a position that does not overlap the printing material outlet 31. A region (the inner portion space) in which the air is present within the printing material supply port 280 communicates with the outside (the outside air) via the communication port 32, and it is possible to maintain the pressure difference between the inner portion space and the outside in a substantially fixed manner.

As shown in FIG. 16 and FIG. 22, a prism unit 270 is arranged on the first plane 201. The prism unit 270 is provided with a so-called rectangular prism 275. The rectangular prism 275 of the prism unit 270 has two surfaces (not shown) which are orthogonal to one another at a substantially right angle. The two surfaces are positioned within the printing material accommodation chamber 200. In the present example, the presence of the ink is determined by the control unit 510 of the printer 50 shown in FIG. 12. This determination is performed as follows on the basis of an optical transaction between the detection unit 57 of the printer 50 shown in FIG. 12 and the prism 275 of the cartridge 20 shown in FIG. 16 and FIG. 22. First, light is emitted from the light emitting portion of the detection portion 57 toward one surface of the two surfaces of the prism 275. At this time, in a case in which the periphery of the prism 275 is saturated with the ink, the majority of the light emitted from the light emitting portion of the detection unit 57 passes through the one surface and does not reach the light receiving portion of the detection unit 57. Meanwhile, in a case in which the ink is not present in the periphery of the prism 275, the majority of the light emitted from the light emitting portion is reflected by the one surface of the prism 275. The reflected light is reflected toward the detection unit 57 by another surface of the prism 275, and reaches the light receiving portion of the detection unit 57. In this manner, in a case in which the light receiving portion of the detection unit 57 does not detect a fixed level or more of the light, the control unit 510 of the printer 50 determines "ink present", and when the fixed level or more of the light is detected, determines "ink not present". Furthermore, the term "ink not present" includes a state in which a small amount of the ink remains.

In addition, as shown in FIG. 16 and FIG. 22, within the first plane 201, a sheet member 298 is bonded to a position between the printing material supply port 280 and the prism unit 270. The sheet member 298 is a member for forming a portion 246 (also referred to as "the connecting path 246", FIG. 22) of the flow path within the printing material accommodation chamber 200. The connecting path 246 is positioned between the prism unit 270 and the printing material supply port 280 in the flow direction toward the printing material supply port 280 within the printing material accommodation chamber 200.

As shown in FIG. 16 and FIG. 20, a protruding first cartridge-side restricting portion 210 is formed on the third plane 203. The first cartridge-side restricting portion 210 is locked into the lever 80 in the mounted state. As shown in FIG. 15 and FIG. 19, a protruding second cartridge-side restricting portion 221 is formed on the fourth plane 204. In the mounted state, the second cartridge-side restricting portion 221 is inserted into the second apparatus-side restricting portion 620 (FIG. 14), which is a through hole formed in the wall portion 604 (FIG. 2), and is locked therein. That is, in the mounted state, the cartridge 20 is positioned in relation to the holder 60 by being locked in both sides in the X axis direction by the lever 80 of the holder 60 and the second apparatus-side restricting portion 620.

As shown in FIG. 15, a circuit board 15 is provided on the eighth plane 208. In the mounted state, a plurality of terminals in contact with the connection mechanism 61 are formed on the surface of the circuit board 15. In addition, a memory device which stores each type of information (the presence of the ink, the ink color and the like) of the cartridge 20 is provided on the rear of the circuit board 15.

As shown in FIG. 15, a ventilation port 290 for introducing the air into the inner portion of the cartridge 20 is formed on the fifth plane 205.

D-4. Outline and Operation of Inner Portion Configuration of Cartridge

Figure 23:
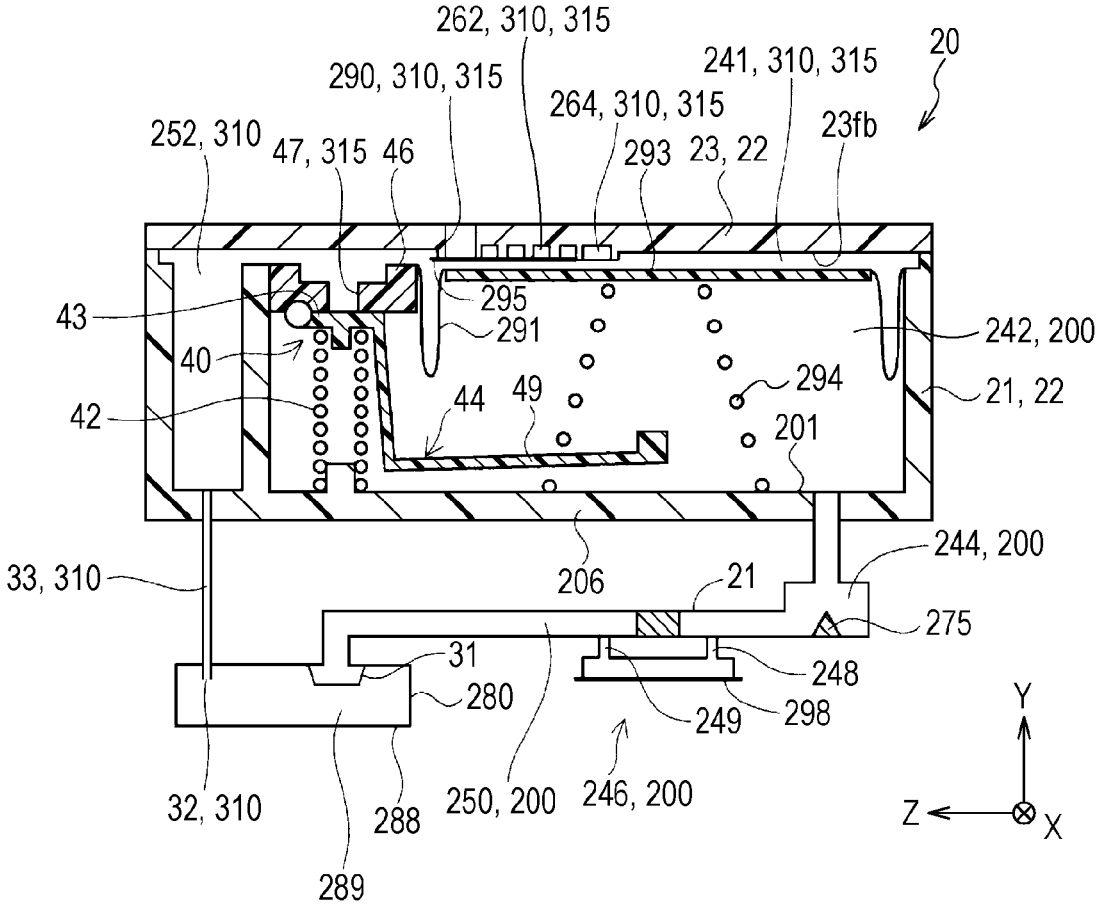
FIG. 23 is a first view for illustrating the cartridge.
Figure 24:
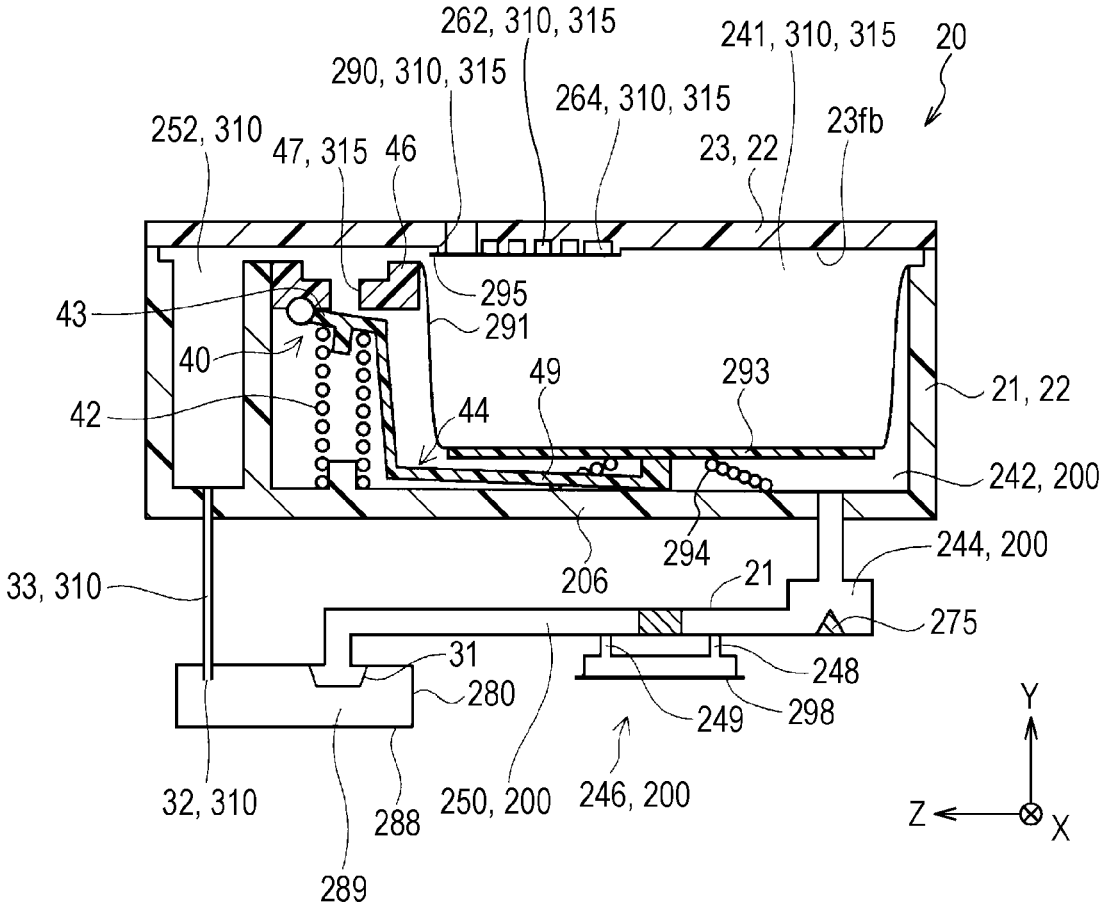
FIG. 24 is a second view for illustrating the cartridge.
Figure 25:
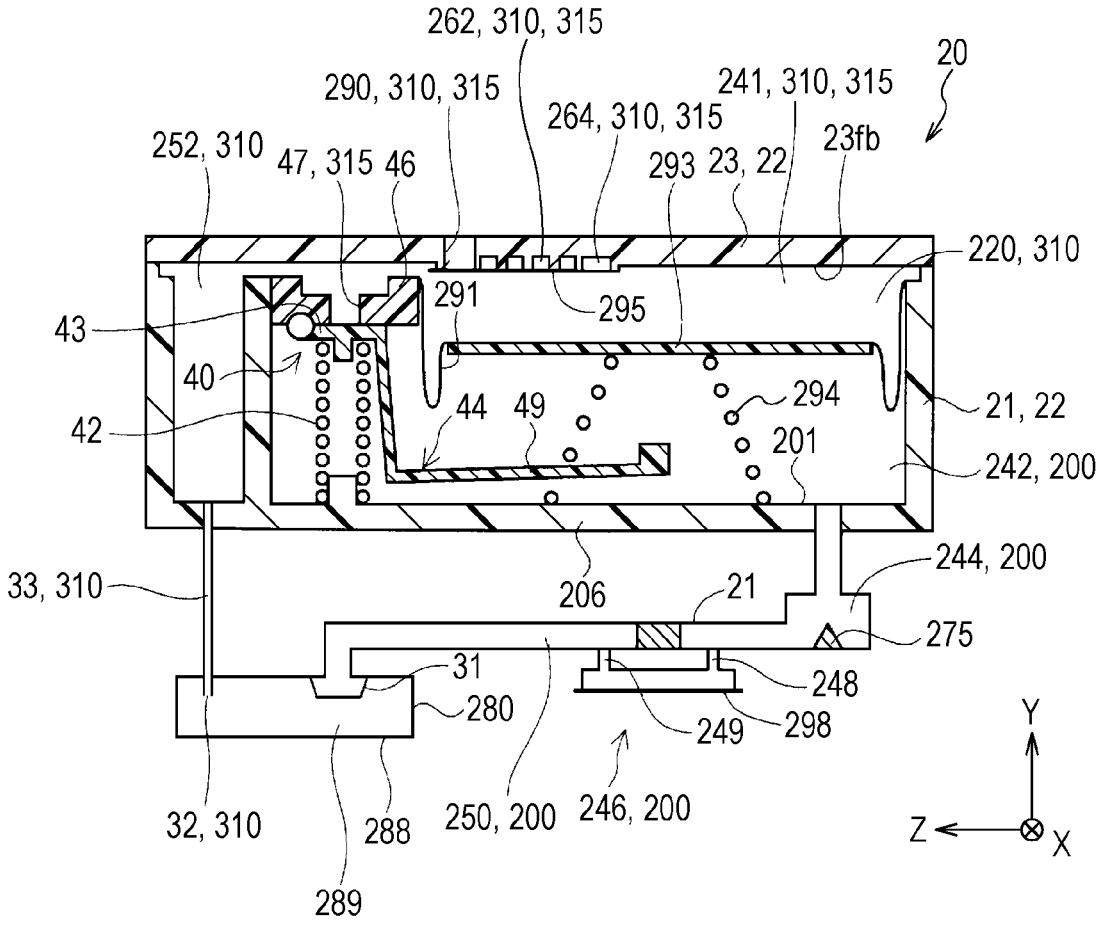
FIG. 25 is a third view for illustrating the cartridge.

FIG. 23 is a first view for illustrating the cartridge 20. FIG. 24 is a second view for illustrating the cartridge 20. FIG. 25 is a third view for illustrating the cartridge 20. Furthermore, FIGS. 23 to 25 are schematic views for illustrating the state of the inner portion of the cartridge 20.

As shown in FIG. 23, the outer shell 22 of the cartridge 20 has an container main body member 21 and a lid member 23. An inner portion space is formed by the lid member 23 being attached so as to cover the opening of the container main body member 21. The cartridge 20 is provided with a first communication path 310 and a second communication path 315. The first communication path 310 and the second communication path 315 are both flow paths through which the atmosphere flows. In addition, the cartridge 20 is provided with a printing material accommodation chamber 200. The printing material accommodation chamber 200 is partitioned by the container main body member 21 and the first sheet member 291. The sheet member 291 is a member having flexibility. The atmosphere is introduced to the printing material accommodation chamber 200 at a predetermined timing via the first communication path 310. The inlet of the atmosphere to the printing material accommodation chamber 200 is an air introduction port 47. The cartridge 20 is provided with a valve mechanism 40 for performing the opening and closing of the air introduction port 47.

A pressure plate 293, the surface (the plane of the +Y axis direction side) of which makes contact with the first sheet member 291 is arranged within the printing material accommodation chamber 200. In addition, within the printing material accommodation chamber 200 is arranged a coil spring 294 as the first energizing member that applies a force to the first sheet member 291 in the direction in which the volume within the printing material accommodation chamber 200 expands from the rear (the plane of the −Y axis direction side) of the pressure plate 293. Accordingly, the pressure within the printing material accommodation chamber 200 is maintained at a lower pressure than the atmospheric pressure (a negative pressure). In a case in which the cartridge 20 is projected perpendicularly onto the opposing wall 206, the center of gravity of the pressure plate 293 is positioned on the inside of a region in which the coil spring 294 makes contact with the pressure plate 293.

The printing material accommodation chamber 200 is provided with a main chamber 242, a detection chamber 244, a connecting path 246 and a buffer chamber 250. The ink flows from the main chamber 242 of the upstream side, through the detection chamber 244, the connecting path 246 and the buffer chamber 250, in this order, and reaches the printing material supply port 280 of the downstream side. The main chamber 242 is a portion in which the coil spring 294 is arranged. The detection chamber 244 is a portion in which the surface 271 of the prism 275 (FIG. 16 and FIG. 22) is arranged. The connecting path 246 is a flow path connecting the buffer chamber 250 and the detection chamber 244 to one another. The connecting path 246 is a flow path formed by the wall forming the first plane 201, and the sheet member 298 (FIG. 22). The connecting path 246 is a flow path for suppressing a reflux of the ink from the connecting path 246 to the upstream side flow paths (for example, the detection chamber 244). The connecting path 246 has holding flow paths 248 and 249 which are capable of holding the ink by forming a meniscus. The holding flow paths 248 and 249 are a shape having no corner portions when viewed from a cross-section of the flow path. Accordingly, using the capillary force, it is possible to reduce the likelihood of the ink of the buffer chamber 250 refluxing to the upstream side. For example, a case is considered in which a trace amount of the ink within the printing material accommodation chamber 200 remains, and the ink is only present in the buffer chamber 250. In this case, when the ink refluxes from the buffer chamber 250 to the detection chamber 244, this causes an erroneous detection of the ink presence. In addition, when the ink refluxes from the buffer chamber 250 to the detection chamber 244, bubbles enter the buffer chamber 250, which can cause the bubbles to flow to the printer 50 side. However, since the reflux of the ink can be prevented by the holding flow paths 248 and 249, it is possible to reduce the occurrence of the problems described above. In the present example, the holding flow paths 248 and 249 are cylindrical flow paths. The buffer chamber 250 is a flow path connected to the printing material supply port 280.

The first communication path 310 communicates the space 289 with the outside of the cartridge 20 via the inner portion space of the cartridge. The space 289 is located in the printing material supply port 280 at a position further downstream than the printing material outlet 31, and is where the communication port 32 is arranged. When the printing material supply port 280 is sealed by a cap or other member, the space 289 is partitioned by the printing material supply port 280 and the cap (or other member). Because a closed off space is formed within the supply port 280 when the supply port 280 is sealed by the cap (or other member), the space 289 is also referred to as the inner chamber 289. Here, in addition to the cap, examples of other members that seal the supply port 280 include an elastic member 648 (FIG. 14) of the holder 60 which makes contact with the circumferential portion of the open end 288 of the supply port 280 in the mounted state.

An end portion of the first communication path 310 is the communication port 290 provided in the inner chamber 289, and the other end portion is the communication port 32 formed to penetrate the lid member 23. In the flow direction of the fluid (the air) from the communication port 32 toward the communication port 290, the first communication path 310 is provided with the communication port 32, a through path 33, a flow path chamber 252, an air chamber 241, a connecting portion 264, an inner portion communication path 262 and the communication port 290. The terms "upstream" and "downstream" used when describing the configuration of the first communication path 310 are used on the basis of the flow direction of the fluid (the air) from the communication port 32 toward the communication port 290.

The through path 33 is a flow path which penetrates the wall between the printing material supply port 280 and the flow path chamber 22. The upstream end portion of the through path 33 forms the communication port 32. The flow path chamber 252 is a space formed in the container main body member 21. The upstream end portion of the flow path chamber 252 is connected to the through path 33, and the downstream end portion is connected to the air chamber 241. The through path 33 is a path which connects the printing material supply port 280 and the air chamber 241 via the flow path chamber 252.

The inner portion communication path 262 is a flow path in which one end portion is connected to the ventilation port 290 and the other end portion is connected to the connection portion 264. The inner portion communication path 262 is a flow path formed on a confronting surface 23*fb* of the lid member 23 that faces the first sheet member 291. The inner portion communication path 262 is configured by a groove portion formed on the confronting surface 23*fb* and a sheet member 295 (also referred to as "a second sheet member 295") attached to the confronting surface 23*fb* so as to cover the groove portion. The second sheet member 295 is arranged such that at least a portion thereof is positioned opposite the first sheet member 291. In addition, the inner portion communication path 262 is a meandering path.

The connection portion 264 is connected to the upstream end portion of the inner portion communication path 262. The flow of the air between the inner portion communication path 262 and the air chamber 241 is performed via the connection portion 264. The connection portion 264 is provided in a concave manner on the confronting surface 23*fb* at a position of the lid member 23 that confronts the first sheet member 291. That is, the connection portion 264 is a concave portion formed on the confronting surface 23*fb*. The air chamber 241 is a space formed between the lid member 23 and the first sheet member 291. In other words, the air chamber 241 is the space interposed by the lid member 23 and the first sheet member 291.

Even in a case in which the supply port 280 is sealed by another member, the first communication path 310 enables the pressure of the space 289 to be maintained substantially constant at ambient air pressure. Accordingly, it is possible to reduce the occurrence of ink leakage from the printing material supply port 280, which occurs with the pressure fluctuations of the space 289.

For example, when the cartridge 20 is mounted into the printer 50 (during the mounting operation), the elastic member 648 (FIG. 2) of the holder 60 seals the periphery of the open end 288 of the printing material supply port 280. Here, when the periphery of open end 288 is sealed, the volume within the printing material supply port 280 decreases and the pressure within the printing material supply port 280 rises due to a portion of the elastic member 648 working into the printing material supply port 280. Generally, the flow path from the printing material accommodation chamber 200 to the printing material outlet 31 has a portion in which the flow path resistance is high in order to prevent the ink from leaking out to the outside of the printing material outlet 31. In the present example, the flow path resistance is high due to a sheet member provided within the printing material supply port 280 or the foam described below. Accordingly, the periphery of the open end 288 is sealed, and in a state directly after the volume within the printing material supply port 280 decreases, the air corresponding to the volume decrease does not sufficiently flow through the printing material accommodation chamber 200. However, it is possible to cause the air corresponding to the volume decrease to escape using the first communication path 310, and it is possible to maintain the pressure within the printing material supply port 280 to that of the outside in a substantially fixed manner.

Hypothetically, in a case in which the first communication path 310 is not provided in the cartridge 20, for example, the compressed air within the printing material supply port 280 gradually flows into the printing material accommodation chamber 200 after the mounting of the cartridge 20. Accordingly, the air which is not intended to do so flows into the printing material accommodation chamber 200, and there is a concern that an appropriate pressure range may not be maintained within the printing material accommodation chamber 200. In addition, for example, when the air within the printing material supply port 280 flows into the printing material accommodation chamber 200 until the elevated pressure within the printing material supply port 280 and the pressure within the printing material accommodation chamber 200 reach equilibrium, the pressure within the printing material accommodation chamber 200 is elevated in comparison with a state before the air flowed in. In a case in which the user detaches the cartridge 20 from the holder 60 in this state, the pressure within the printing material supply port 280 is the atmospheric pressure. In other words, the pressure within the printing material supply port 280 decreases, and the ink leaks out to the outside through the printing material supply port 280 from the printing material accommodation chamber 200 that has a high pressure.

The second communication path 315 is a flow path for introducing the air from the outside to the printing material accommodation chamber 200. In the second communication path 315, the communication port 290 (also referred to as "the outside air introduction port 290") is formed on one end portion, and an air introduction port 47 (also referred to as "the inner portion air introduction port 47") is formed on the other end portion. The ventilation port 290 is an opening formed to penetrate the lid member 23. The air introduction port 47 is an opening for taking the air into the printing material accommodation chamber 200. The air introduction port 47 is an opening formed in a cover valve 46 of the valve mechanism 40, and is opened and closed by the valve mechanism 40. The valve mechanism 40 will be described below in detail.

The second communication path 315, when the ventilation port 290 is on the upstream side and the air introduction port 47 is on the downstream side, is provided with the ventilation port 290, an inner portion communication path 262, a connection portion 264, an air chamber 241 and the air introduction port 47, in this order from the upstream side. Furthermore, the terms "upstream" and "downstream" used when describing the configuration of the second communication path 315 are used on the basis of the flow direction of the air from the ventilation port 290 toward the air introduction port 47. Among these elements, the portions of the air chamber 241, the connection portion 264, the inner portion communication path 262 and the ventilation port 290 are common with the elements which configure the first connection path 310. That is, the portion of the downstream side of the first communication path 310 is common with the portion of the upstream side of the second communication path 315. The air chamber 241, the connection portion 264, the inner portion communication path 262 and the ventilation port 290 function as a flow path in which the air is introduced from the outside of the cartridge to the inner portion in the second communication path 315, and function as a flow path in which the air is exhausted from the inner portion of the cartridge to the outside in the first communication path 310.

The valve mechanism 40 is provided with a cover valve 46, a lever valve 44, and a coil spring 42 as an energizing member. The lever valve 44 is pressed onto the cover valve 46 by the coil spring 42 and blocks the air introduction port 47 which is a through hole. The lever valve 44 is provided with a lever portion 49 that makes contact with the pressure plate 293 by the displacement thereof, and a valve portion 43 for sealing the air introduction port 47.

Next, the operation of the cartridge 20 will be described. In the initial state of the cartridge 20 (the unused state), as shown in FIG. 23, the printing material accommodation chamber 200 is filled with the ink.

As shown in FIG. 24, when the ink of the printing material accommodation chamber 200 is consumed and the pressure plate 293 approaches the sixth plane 206, the pressure plate 293 presses the lever portion 49 to the sixth plane 206 side. Accordingly, the valve portion 43 separates from the air introduction port 47, and the air of the outside and the printing material accommodation chamber 200 are temporarily communicated. That is, the lever valve 44 is in an open valve state. Furthermore, the air of the outside flows through the second communication path 315 to the printing material accommodation chamber 200. Accordingly, as shown in FIG. 25, the volume of the printing material accommodation chamber 200 increases by the amount of the air introduced. At the same time, the negative pressure within the printing material accommodation chamber 200 lowers a little (approaches the atmospheric pressure). Furthermore, as shown in FIG. 25, when a certain amount of the air is introduced to the printing material accommodation chamber 200, the pressure plate 293 separates from the lever portion 49. Accordingly, the valve portion 43 seals the air introduction port 47 again. That is, the lever valve 44 is in a closed valve state. In this manner, the pressure within the printing material accommodation chamber 200 can be maintained within an appropriate pressure range due to the lever valve 44 temporarily entering an open state when the negative pressure within the printing material accommodation chamber 200 increases with the consumption of the ink of the printing material accommodation chamber 200.

D-5. Detailed Configuration of Cartridge

Figure 26:
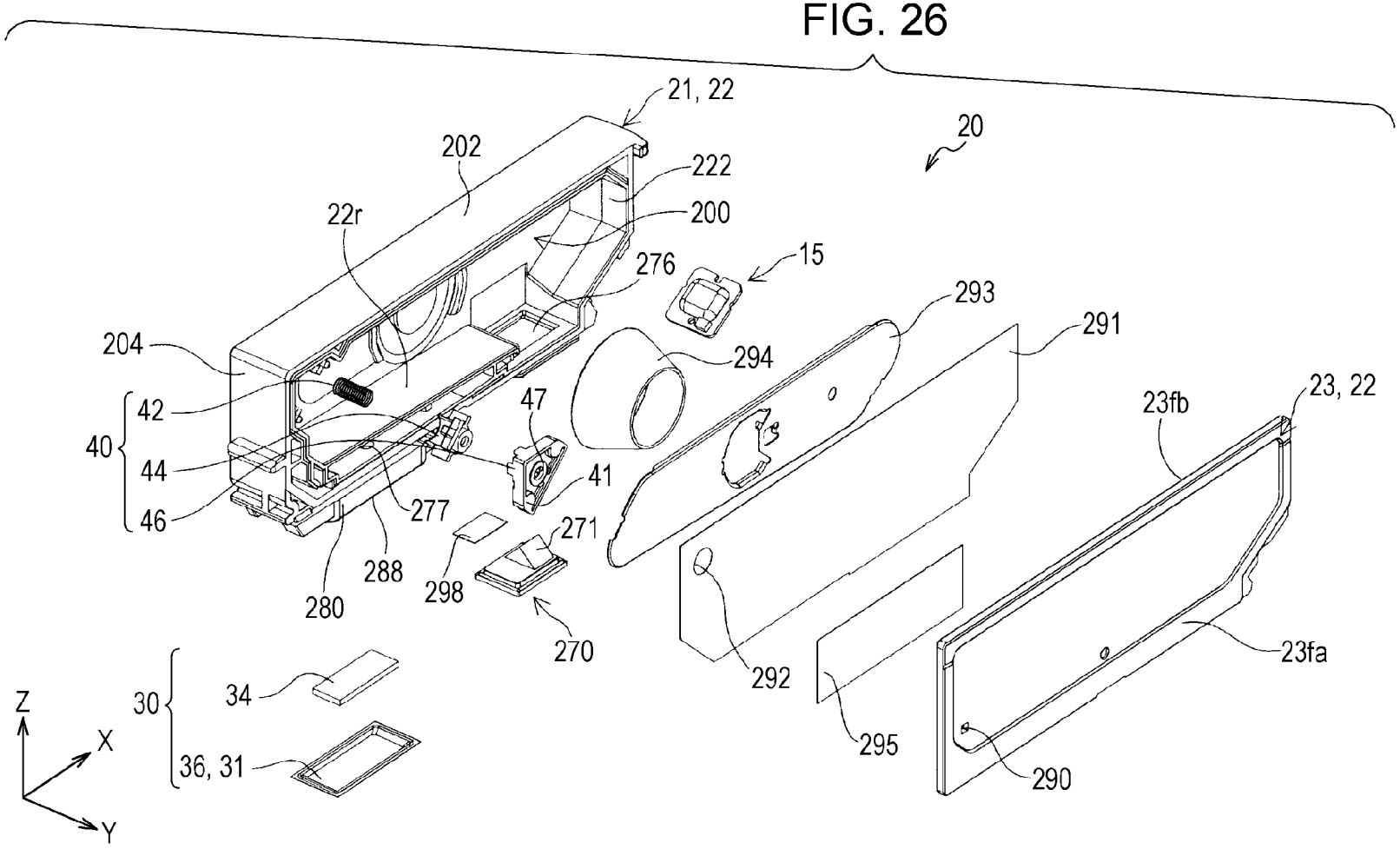
FIG. 26 is a first exploded perspective view of the cartridge.
Figure 27:
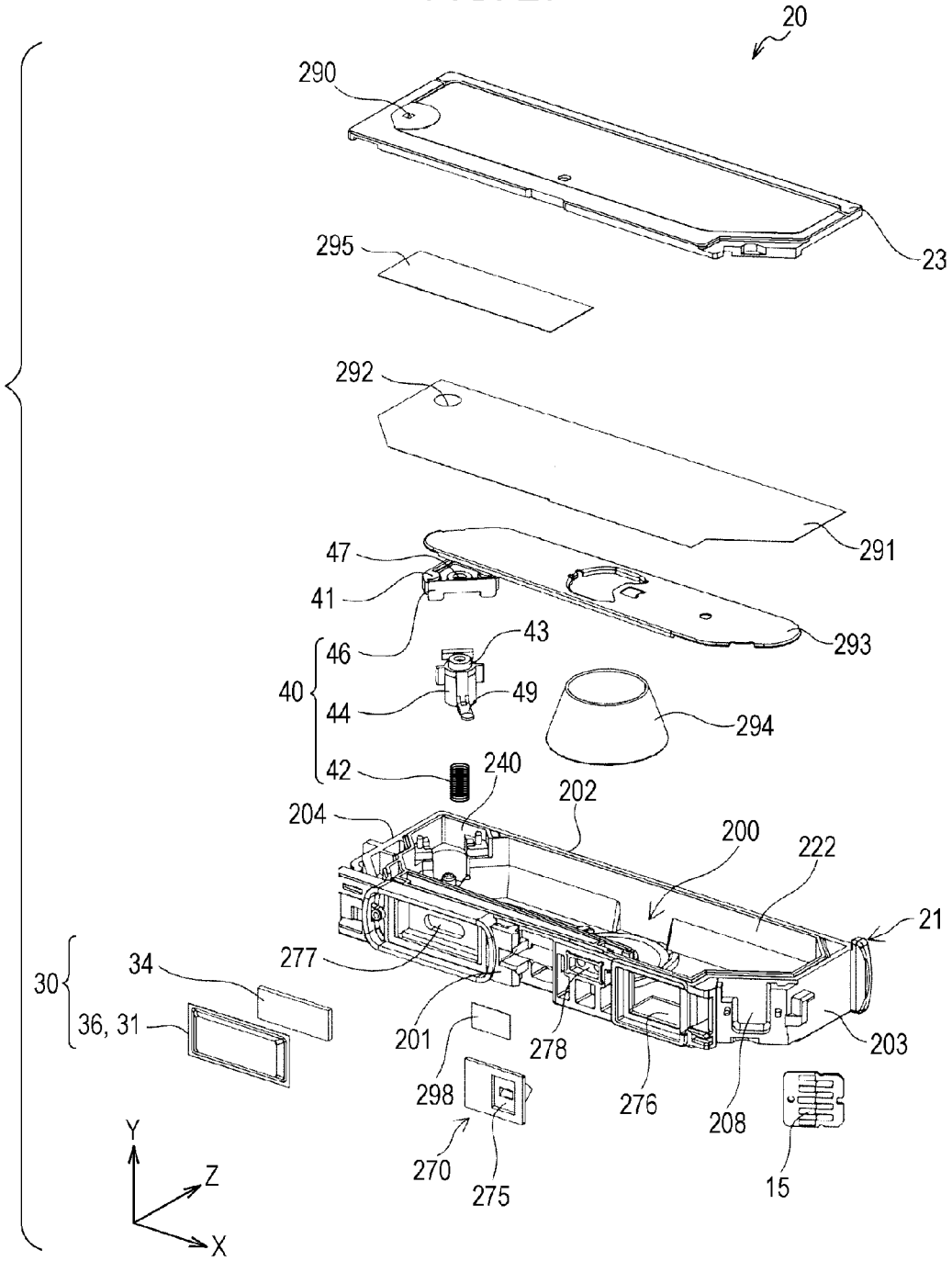
FIG. 27 is a second exploded perspective view of the cartridge.
Figure 28:
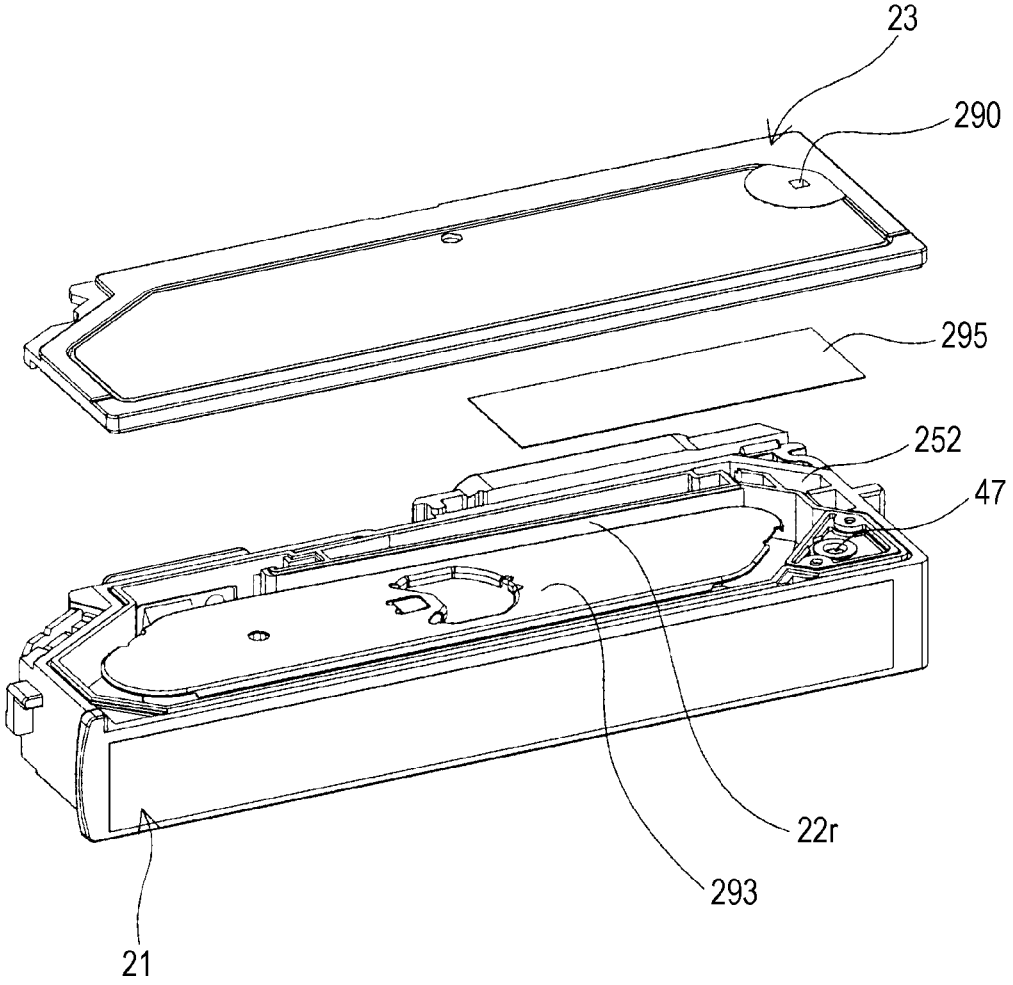
FIG. 28 is a third exploded perspective view of the cartridge.
Figure 29:
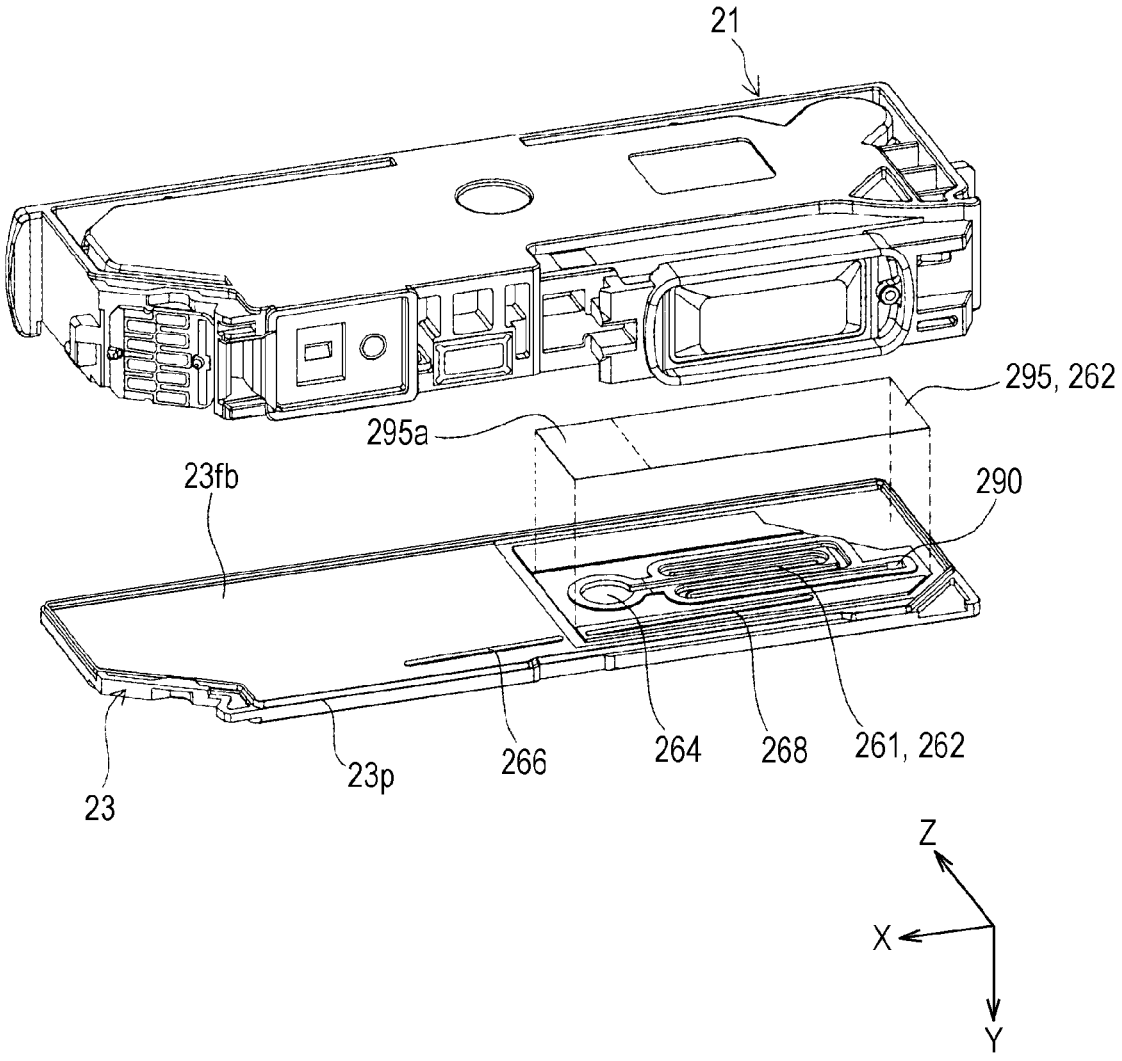
FIG. 29 is a fourth exploded perspective view of the cartridge.
Figure 30:
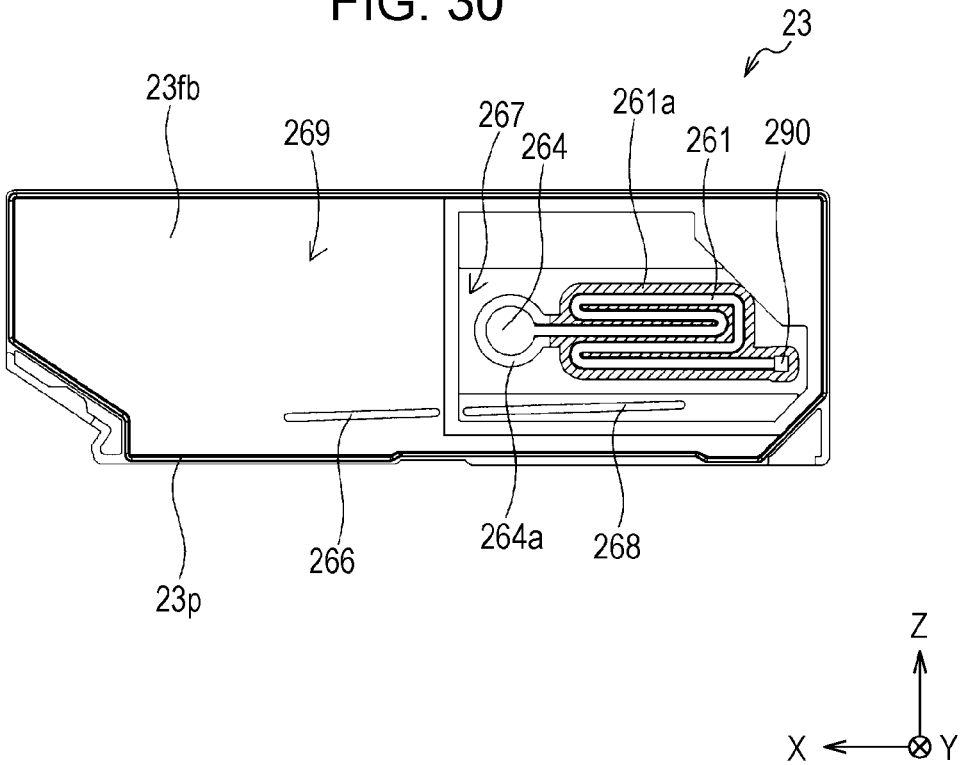
FIG. 30 is a view showing a confronting surface of a lid member.
Figure 31:
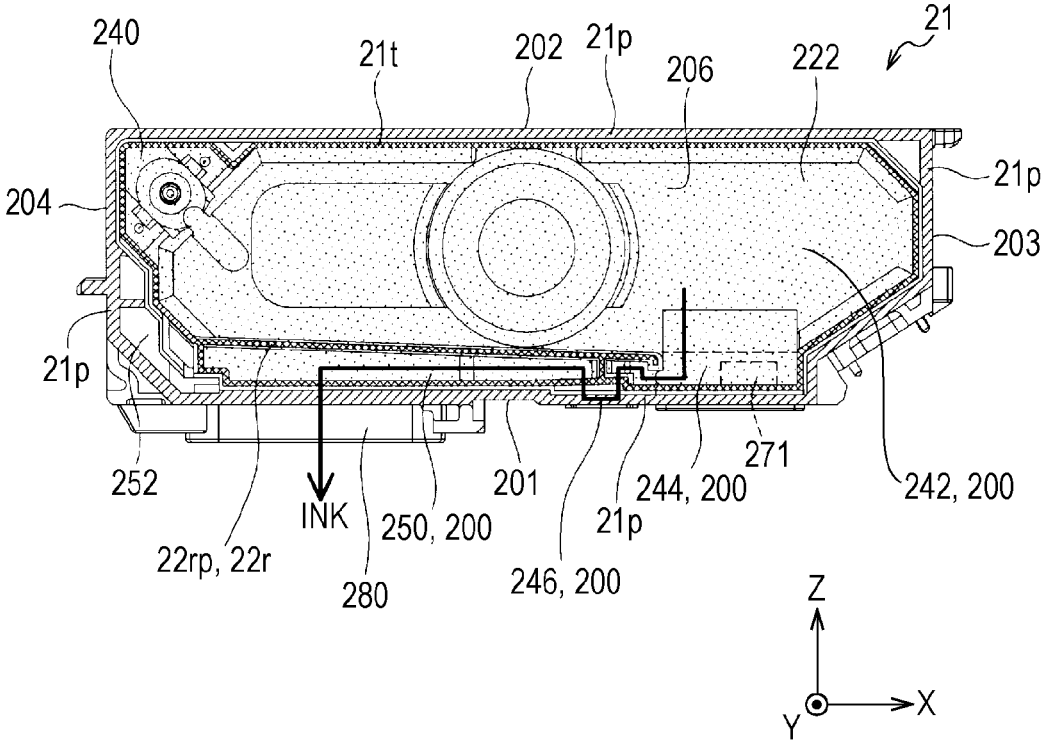
FIG. 31 is a view showing a container main body member.
Figure 32:
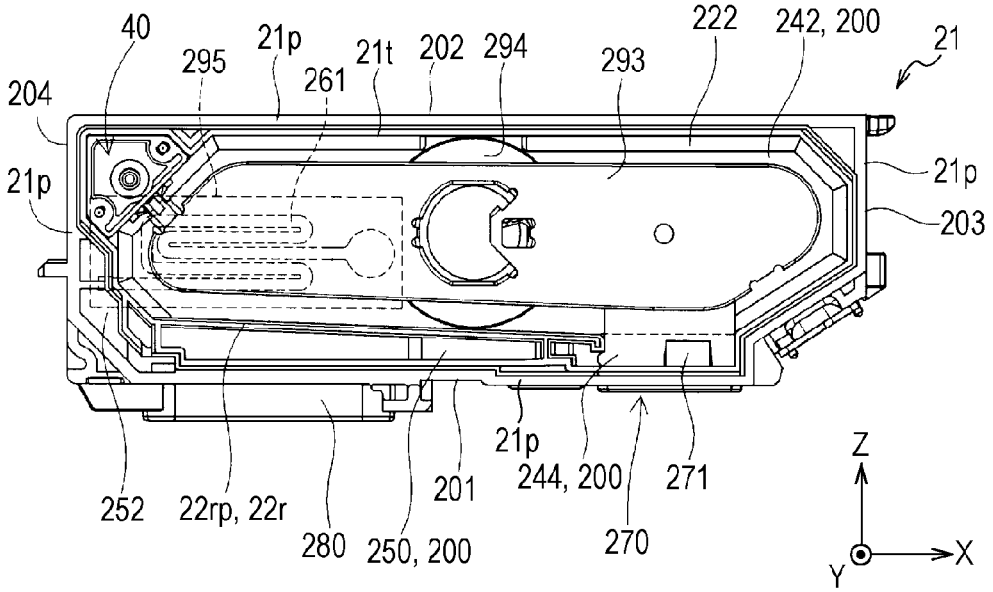
FIG. 32 is a view showing the cartridge before attaching the lid member.

FIG. 26 is a first exploded perspective view of the cartridge 20. FIG. 27 is a second exploded perspective view of the cartridge 20. FIG. 28 is a third exploded perspective view of the cartridge 20. FIG. 29 is a fourth exploded perspective view of the cartridge 20. FIG. 30 shows the confronting surface 23*fb* of the lid member 23. FIG. 31 shows the container main body member 21. FIG. 32 shows the cartridge 20 before attaching the lid member 23. In FIG. 31, the flow of the ink of the printing material accommodation chamber 200 through the printing material supply port 280 to the outside is shown using an arrow. In addition, in FIG. 31, the surface 271 of the prism 275 is depicted by a dotted line. In FIG. 32, a groove portion 261 and the second sheet member 295 of the lid member 23 are depicted by a dotted line.

As shown in FIG. 26 and FIG. 27, the cartridge 20 is provided with the container main body member 21, the lid member 23 and the first sheet member 291. The container main body member 21 is a substantially cuboid shape. The container main body member 21 is a concave shape having an opening 222 on a wall of one side (the wall of the +Y axis direction side). The first sheet member 291 is adhered or welded to the container main body member 21 and partitions the printing material accommodation chamber 200 with the container main body member 21. The first sheet member 291 has flexibility. That is, a portion of the circumferential wall of the printing material accommodation chamber 200 is formed by the first sheet member 291. The through hole 292 which communicates the air chamber 241 with the air introduction port 47 is formed in the first sheet member 291.

The lid member 23 is attached to the container main body member 21 so as to cover the first sheet member 291. The container main body member 21 and the lid member 23 are formed from a synthetic resin such as polypropylene. In addition, the first sheet member 291 is formed from a synthetic resin such as a material containing nylon or polypropylene. The plate-shaped lid member 23 has the confronting surface 23*fb* that faces the first sheet member 291, and a surface 23*fa* which is on the opposite side of the lid member 23 than the confronting surface 23*fb*. The confronting surface 32*fb* is the inner plane of the cartridge 20 and the surface 23*fa* is the outer surface of the cartridge 20.

The pressure plate 293 is formed from a synthetic resin such as polypropylene. The pressure plate 293 is arranged to contact the first sheet member 291. The coil spring 294 is arranged within the main chamber 242 within the printing material accommodation chamber 200. The coil spring 294 makes contact with the pressure plate 293 and the plane (the confronting surface) opposite the pressure plate 293 among the planes of the container main body member 21. The pressure plate 293 moves within the printing material accommodation chamber 200 with the consumption of the ink of the printing material accommodation chamber 200. The movement direction of the pressure plate 293 is the Y axis direction (the direction perpendicular to the confronting surface 23*fb* and the surface 23*fa*).

As shown in FIG. 26, the valve mechanism 40 is provided with the spring member 42, the lever valve 44 and the cover valve 46. The cover valve 46 is attached to the container main body member 21 by being accommodated in a corner portion 240 (FIG. 31) at which the second plane 202 and the fourth plane 204 are orthogonal to one another within the container main body member 21. The cover valve 46, for example, is formed from a synthetic resin such as polypropylene. As shown in FIG. 26 and FIG. 27, the cover valve 46 is a concave shape, and the first sheet member 291 is bonded in an airtight manner to the end plane 41 forming the opening. The concave portion of the cover valve 46 communicates with the through hole 292 of the first sheet member 291. In addition, the air introduction portion 47 which penetrates to the rear side of the cover valve 46 is formed on the lower portion of the concave portion of the cover valve 46.

The lever valve 44 is pushed against the cover valve 46 by the spring member 42 and seals the air introduction port 47. The lever valve 44 has a lever portion 49 (FIG. 27) that makes contact with the pressure plate 293 by the displacement thereof. The lever valve 44, for example, may be formed from a synthetic resin such as polypropylene. In addition, the lever valve 44, may also be formed by two-shot molding using an elastic member such as an elastomer and a synthetic resin such as polypropylene.

The printing material supply port 280 communicates with the printing material accommodation chamber 200. As shown in FIG. 27, the printing material accommodation chamber 200 and the printing material supply port 280 are communicated by the printing material communication hole 277. As shown in FIG. 26 and FIG. 27, a supply member 30 is provided in the inner portion of the printing material supply port 280. The supply member 30 is provided with a foam (a porous member) 34 and a sheet member (a filter member) 36. Arranged in order from closest to the open end 288 of the printing material supply port 280 are the sheet member 36 and the foam 34. The foam 34 and the sheet member 36, for example, are formed from a synthetic resin such as polyethylene terephthalate. In the mounted state, the sheet member 36 makes contact with the printing material supply tube 640 (FIG. 2) and causes the ink to flow to the printer 50 side. That is, the sheet member 36 forms the printing material outlet 31.

As shown in FIG. 27, an opening portion 278 which penetrates the first plane 201 is formed in the first plane 201. The connecting path 246 is formed due to the sheet member 298 being bonded to the first plane 201 so as to cover the opening portion 278.

As shown in FIG. 30 and FIG. 31, a peripheral portion 23*p* of the lid member 23 is joined to the container-side peripheral portion 21*p*, which is shaded with single hatching among the end portions of the opening side (the +Y axis direction side) of the container main body member 21, using adhesion or welding. In addition, of the end portions (end planes) of the opening side (the +Y axis direction side) of the container main body member 21, the first sheet member 291 is bonded in an airtight manner to inside end portions 21*t* and 22*rp* positioned further to the inside than the container-side peripheral portion 21*p*. A flow path chamber 252 is formed outside of the region to which the first sheet member 291 is bonded within the container main body member 21 (FIG. 31). Furthermore, in order to facilitate understanding, the inside end portions 21*t* and 22*rp* are shaded with cross hatching. In addition, in FIG. 31, the region shaded with dots is the printing material accommodation chamber 200.

As shown in FIG. 26, FIG. 31 and FIG. 32, the printing material accommodation chamber 200 has a partitioning wall 22*r* which extends from the opposing wall 206 (the sixth plane 206) opposite the opening 222 toward the opening 222 side. The partitioning wall 22*r* partitions the main chamber 242 and the buffer chamber 250. In FIGS. 12 to 14, the detection chamber 244 was depicted as a room isolated from the main chamber 242, however, as shown in FIG. 20 and FIG. 21, the detection chamber 244 is actually configured as a portion of the main chamber 242. The printing material accommodation chamber 200 is partitioned, by the partitioning wall 22*r*, into the main chamber 242 which has a large volume and the buffer chamber 250 which has a small volume. The buffer chamber 250 has a smaller volume than the main chamber 242. In the present embodiment, the volume of the main chamber 242 is approximately 10 times the volume of the buffer chamber 250. As shown by the arrow in FIG. 31, the ink of the main chamber 242 flows through the detection chamber 244, the connecting path 246 and the buffer chamber 250 into the printing material supply port 280. Furthermore, in FIG. 31 and FIG. 32, the boundary portion between the main chamber 242 and the detection chamber 244 is depicted by a dotted line.

Here, the relationship between the volumes of the main chamber 242 and the buffer chamber 250 will be described. In the present embodiment, according to the optical detection using the prism 250 within the detection chamber, the printing is not stopped instantly after determining "ink not present". At the point in time that "ink not present" is determined by the optical detection, this only means that there is no ink in the main chamber 242 (including the detection chamber 244) and there is still ink remaining in the buffer chamber 250. Therefore, at this point in time, the printer 50 firstly performs a display or the like which urges the user to prepare a new cartridge 20. Furthermore, the printer 50 subsequently enables the continuation of the printing using the ink within the buffer chamber 250. The control unit 510 of the printer 50 managing how much of the ink within the buffer chamber 250 has been consumed on the basis of predetermined data, and the timing at which to finally stop the printing is determined on the basis of this management information. The management of the ink consumption amount on the basis of such management information is performed for each of various operations of the printer 50 on the basis of the data of the ink consumption amount which is set in advance, and is not performed by actually measuring the ink consumption amount. Actually detecting the presence of the ink using the prism 250 is more precise than the management of the ink consumption amount on the basis of the data. Accordingly, making the volume of the buffer chamber 250, where the ink consumption amount is managed on the basis of the data, as small as possible in relation to the main chamber 242, where the ink consumption state is managed by actually detecting the presence of the ink, can be said to improve the management precision of the ink amount overall. When the overall management precision of the ink amount is high, it is possible to reduce the amount of the ink which remains within the cartridge 20 when the printing is finally stopped. Accordingly, the volume of the main chamber 242 is set to 3 or more times the volume of the buffer chamber 250, and preferably to 5 or more times. Meanwhile, when the volume of the buffer chamber 250 is too small in relation to the volume of the main chamber 242, after the ink of the main chamber 242 (including the detection chamber 244) runs out, a period within which to finally stop the printing may not be sufficiently secured. Accordingly, the volume of the main chamber 242 is set to 20 or less times the volume of the buffer chamber 250, and preferably to 15 or less times. To summarize, the volume of the main chamber 242 is preferably set to 3 or more times and 20 or less times the volume of the buffer chamber 250, and more preferably to 5 or more times and 15 or less times.

As shown in FIG. 29 and FIG. 30, the groove portion 261, the connection portion 264 and convex portions 266 and 268 are formed on the confronting surface 23*fb* of the lid member 23. The groove portion 261, the connection portion 264 and the convex portions 266 and 268 are formed further to the inside than the peripheral portion 23*p*. As described above, the peripheral portion 23*p* is a joint portion with the container main body member 21.

In addition, as shown in FIG. 30, the lid member 23 has a portion 267 which is thicker than another portion 269. The other portion 269 is referred to as "the thin portion 269", and the thicker portion 267 as "the thick portion 267". The thick portion 267 protrudes further to the first sheet member 291 side than the thin portion 269. The groove portion 261, the ventilation port 290, the connection portion 264 and the convex portion 268 are formed on the thick portion 267.

The groove portion 261 has a meandering shape. The groove portion 261 has a portion in at least one location which is curved by 180°. The upstream side end portion of the groove portion 261 is connected to the ventilation port 290. In addition, the downstream side end portion of the groove portion 261 is connected to the connection portion 264. The connection portion 264 is provided as a concave portion on the confronting surface 23*fb*. As shown in FIG. 29, the second sheet member 295 is attached to the confronting surface 23*fb* so as to cover the ventilation port 290 and the groove portion 261. The second sheet member 295 is attached by adhesion or welding to a bank 261*a* of the periphery of the ventilation port 290 and the groove portion 261 shown in FIG. 19 shaded with single hatching within the confronting surface 23*fb*. Accordingly, the inner portion communication path 262 is configured by the groove portion 261 and the second sheet member 295. The inner portion communication path 262 is a meandering path, at least a portion of which is curved by 180° corresponding to the shape of the groove portion 261. In addition, as shown in FIG. 29, the second sheet member 295 is provided with a portion 295*a* (also referred to as "an extending portion 295*a*") which extends to a position that overlaps (a position that opposes) the connection portion 264. The extending portion 295*a* opposes the connection portion 264 so as to cover the entirety of the connection portion 264. The extending portion 295*a* is not attached to the confronting surface 23*fb*. As can be understood from FIG. 30, the second sheet member 295 is welded or adhered to the bank 261*a* (the portion shaded with single hatching in FIG. 30) of the periphery of the ventilation port 290 and the groove portion 261, however, is not welded or adhered to the bank 264*a* of the periphery of the connection portion 264. That is, within the second sheet member 295, the extending portion 295*a* only covers the connection portion 264. The connection portion 264 is not sealed by the sheet member 295. In FIG. 29, to facilitate understanding, within the second sheet member 295, the boundary between the extending portion 295*a* and the other portions is depicted by a dotted line. Here, the flow path cross-sectional area of the connection portion 264 is larger than the flow path cross-sectional area of the inner portion communication path 262. In addition, the flow path cross-sectional area of the inner portion communication path 262 is smaller than the flow path cross-sectional area of the flow path chamber 252 or the air chamber 241. The term "flow path cross-sectional area" refers to the area of a plane which is perpendicular to the flow direction of the fluid within the flow path.

The convex portions 266 and 268 each extend in a straight line shape. In addition, the convex portions 266 and 268 are positioned on the same straight line shape. The convex portions 266 and 268 protrude from the confronting surface 23*fb* toward the inside of the cartridge 20, that is, toward the printing material accommodation chamber 200 side. The convex portions 266 and 268 oppose the partitioning wall 22*r* (FIG. 31, FIG. 32) that partitions the main chamber 242 and the buffer chamber 250. The convex portions 266 and 268 oppose the end portion 22*rp* (the end plane 22*rp*) of the opening 222 side of the partitioning wall 22*r*.

In addition, as shown in FIG. 32, a portion of the bank 261*a* (FIG. 30) of the groove portion 261 opposes a portion of the peripheral wall which partitions the printing material accommodation chamber 200. Specifically, a portion of the bank 261*a* (refer to FIG. 19) of the groove portion 261 opposes the inside end portion 21*t* of the peripheral wall which partitions the printing material accommodation chamber 200. The inside end portion 21*t* is an end portion (an end plane) positioned on the opening 222 side of the peripheral wall which partitions the printing material accommodation chamber 200.

Figure 33:
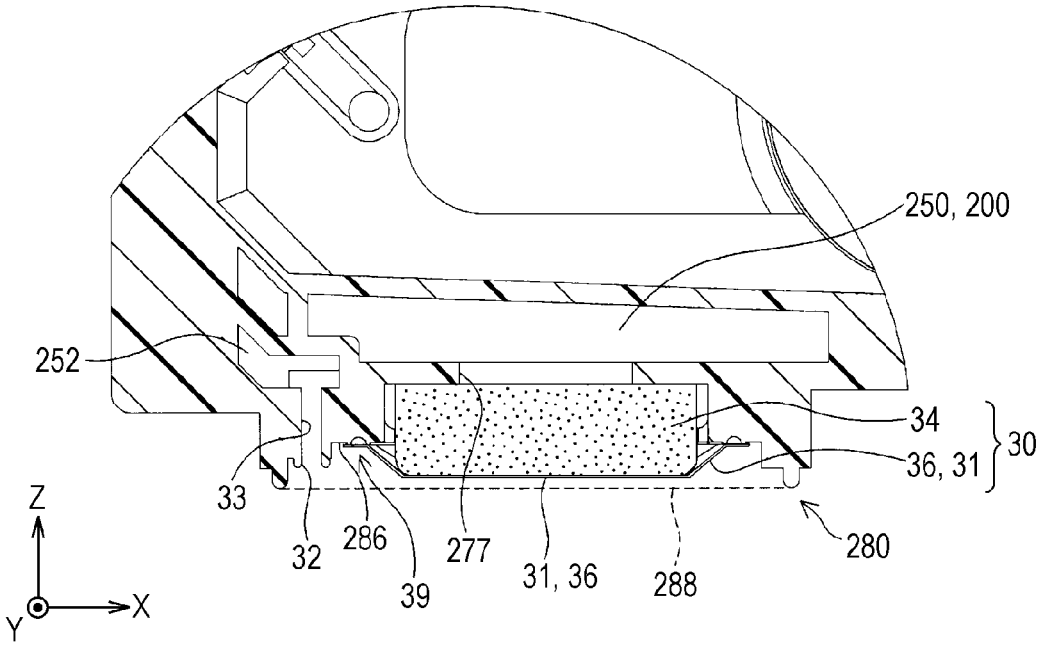
FIG. 33 is a partial cross-section view along the line XXXIII-XXXIII of FIG. 21.

FIG. 33 is a partial cross-section view along the line XXXIII-XXXIII of FIG. 21. As shown in FIG. 33, the printing material supply port 280 has on one end portion thereof, a through path 33 that forms a communication port 32. The through path 33 penetrates the member which forms the printing material supply port 280 and communicates with the flow path chamber 252. The through path 33 extends along the Z axis direction.

D-6. Ink Injection Method

Figure 34:
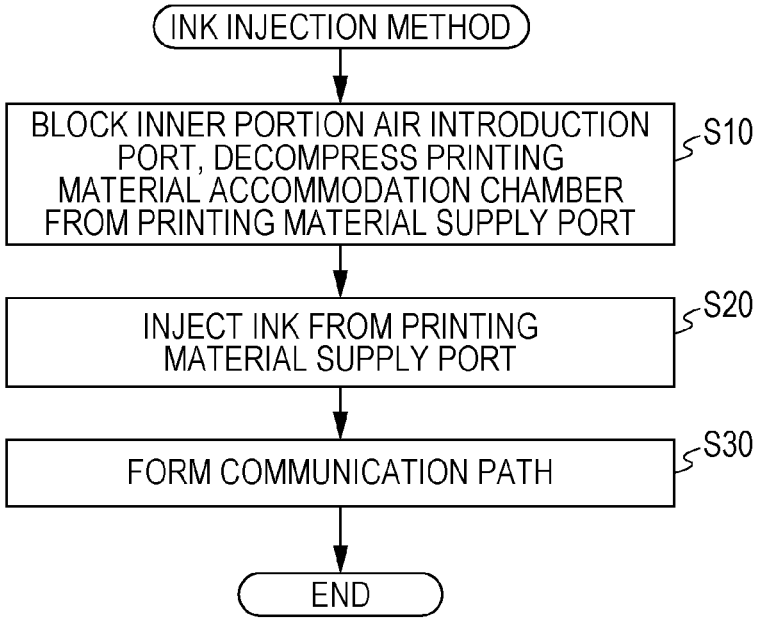
FIG. 34 is a flow chart of an ink injection method.
Figure 35:
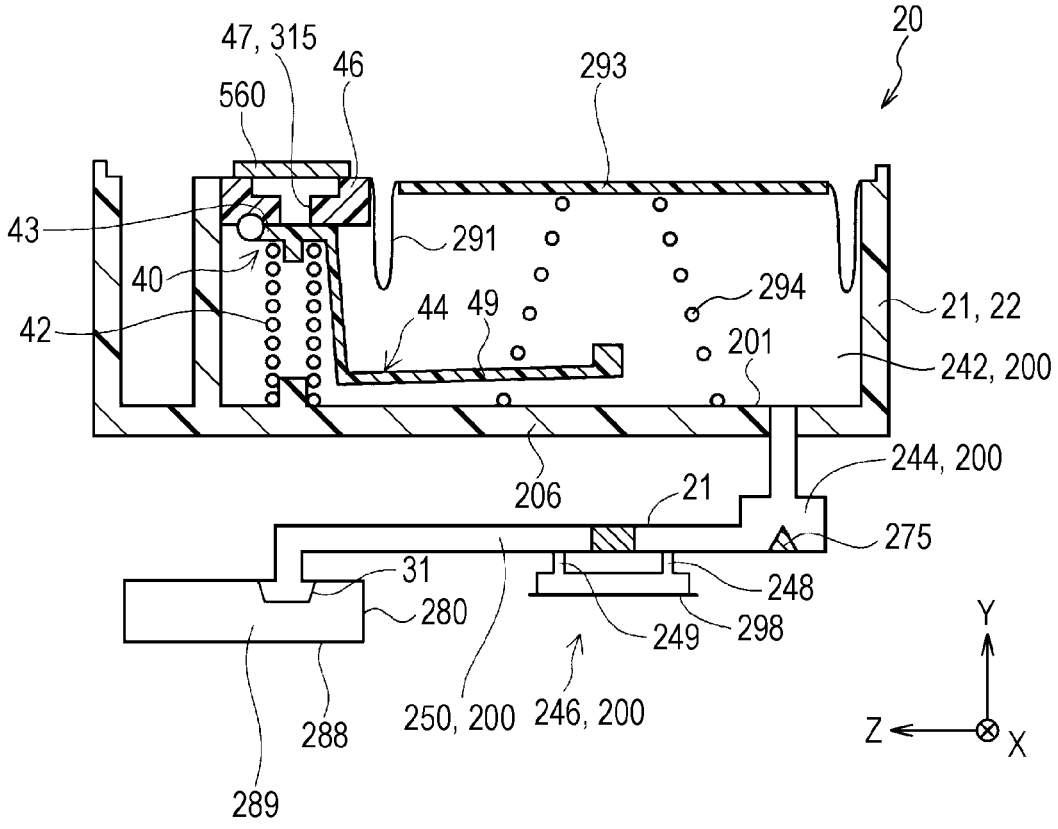
FIG. 35 is a first view for illustrating the ink injection method.
Figure 36:
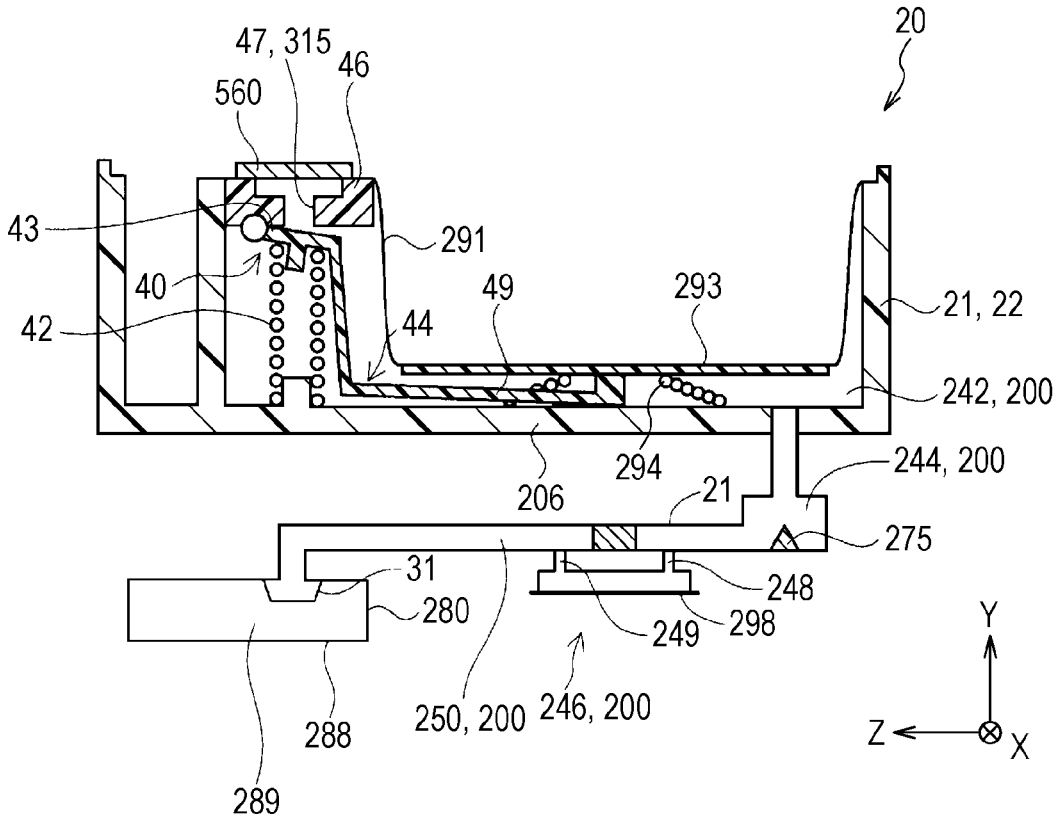
FIG. 36 is a second view for illustrating the ink injection method.

Next, a method of injecting the ink into the printing material accommodation chamber 200 will be described. FIG. 34 is a flow chart of the ink injection method. FIG. 35 is the first view for illustrating the ink injection method. FIG. 36 is the second view for illustrating the ink injection method.

In the present example, as shown in FIG. 35 and FIG. 36, the injection of the ink into the printing material accommodation chamber 200 is performed in a state in which the lid member 23 is removed. In addition, in the present embodiment, the injection of the ink into the printing material accommodation chamber 200 is performed in a state in which the through path 33 does not penetrate the flow path chamber 252. That is, before injecting the ink, there is no penetration between the through path 33 and the flow path chamber 252 shown in FIG. 22 which are in a state of being partitioned by a wall, and the injection of the ink is performed in this state. By doing so, it is possible to reduce the likelihood of the ink leaking out to the outside via the first communication path 310 when injecting the ink into the printing material accommodation chamber 200. Furthermore, in a case in which the ink is injected in a state in which there is penetration between the through path 33 and the flow path chamber 252, the communication port 32 may be sealed using a plug, a seal or the like.

As shown in FIG. 34 and FIG. 35, in a state in which the air introduction port 47 is sealed by the seal member 560, the air of the printing material accommodation chamber 200 is sucked in from the printing material supply port 280 to decompress the inside of the printing material accommodation chamber 200 (step S10). For example, a suction apparatus (not shown) is arranged so as to seal the open end 288, and the inside of the printing material accommodation chamber 200 is suctioned from the printing material supply port 280.

After step S10, a predetermined amount of the ink is injected from the printing material supply port 280 into the printing material accommodation chamber 200 (step S20). The step S20 is, for example, performed by connecting the tank accommodating the ink with the printing material supply port 280, and causing the ink to flow from the tank into the printing material supply port 280 using a pump or the like. The ink injection apparatus and the suction apparatus may also be integrated as a unit apparatus.

As shown in FIG. 34, after step S20, the first communication path 310 is formed (step S30). It is possible, for example, to produce the first communication path 310 by breaking through the wall partitioning the through path 33 and the flow path chamber 252 using a needle-shaped member. Furthermore, after step S20 or step S30, the seal member 560 is removed and the lid member 23 is attached to the container main body member 21. Accordingly, it is possible to manufacture the cartridge 20 in which the ink is accommodated in the printing material accommodation chamber 200.

D-7. Effects

In the example described above, since the inner chamber 289 communicates with the outside due to the communication path 310 which passes from the communication port 32 provided in the inner chamber 289, through the air chamber 241, and reaches the ventilation port 290, it is possible for the air of the inner chamber to flow out to the outside even when the open end 288 of the printing material supply port 280 is sealed by the cap or the like. Accordingly, since the air of the inner chamber 289 is no longer compressed, it is possible to prevent the air from flowing into the printing material accommodation chamber 200, and the ink from leaking out due to pressure fluctuation of the inner chamber 289. In addition, since the communication path 310 does not pass through the printing material accommodation chamber 200, this configuration is suitable for the half-sealed type of cartridge described in the present embodiment. In addition, this configuration is also favorably applicable in a sealed type of cartridge (a cartridge in which the printing material accommodation chamber 200 does not communicate with the atmosphere) such as that disclosed in US-A-2012-0133713. Naturally, this configuration is also applicable in an open type of cartridge (a cartridge in which the printing material accommodation chamber 200 is always in communication with the atmosphere) such as that disclosed in JP-A-2012-35479.

In the example described above, it is possible to suppress damage to the aesthetics of the exterior of the cartridge 20 since it is possible to form the inner portion communication path 262 on the confronting surface 23*fb* of the lid member 23.

In the example described above, the second sheet member 295 is arranged between the first sheet member 291 for forming the printing material accommodation chamber 200 and the lid member 23 (FIG. 26 and FIG. 27). In other words, at least a portion of the second sheet member 295 is provided in a position opposite the first sheet member 291. Accordingly, even in a case in which the first sheet member 291 moves with the pressure plate 293 to the lid member 23 side due to an external force, it is possible to reduce the likelihood of the first sheet member 291 directly making contact with the lid member 23. Accordingly, it is possible to reduce the likelihood of the first sheet member 291 being broken. In addition, even in a case in which the first sheet member 291 makes contact with the lid member 23, the second sheet member 295 acts as a buffer material and it is possible to reduce the likelihood of the first sheet member 291 being broken. In addition, the second sheet member 295 can serve two roles by providing a portion of the second communication path 315, which is for introducing the air into the printing material accommodation chamber 200, in a position opposite the first sheet member 291 within the lid member 23. That is, the second sheet member 295 serves the two roles of the role of a buffer material for preventing the first sheet member 291 from being broken, and the role of a member for forming the second communication path 315. Accordingly, it is not necessary to provide the sheet members separately.

Here, within the confronting surface 23*fb* of the lid member 23, the groove portion 261 is formed in a portion to which the second sheet member 295 is bonded (FIG. 29). Within the confronting surface 23*fb*, the portion in which the groove portion 261 is formed is of an irregular shape. Therefore, in particular, when the first sheet member 291 makes contact with the region in which the groove portion 261 is formed, the first sheet member 291 is easily broken by the corner of the groove portion 261. However, in the present example, since the second sheet member is bonded so as to cover the groove portion 261, it is possible to reduce the likelihood of the first sheet member 291 making contact with the groove portion 261 and being broken.

Here, the first sheet member 291 has a tendency to move together with the movement of the pressure plate 293. Accordingly, the portion positioned at the peripheral portion of the pressure plate 293 within the first sheet member 291 is displaced greatly, makes contact with the lid member 23 and is easily broken. Accordingly, it is preferable that the second sheet member 295 be arranged in a position opposite at least a portion of the peripheral portion of the pressure plate 293. Furthermore, it is preferable that the second sheet member 295 be arranged in a position opposite all of the portions of the peripheral portion of the pressure plate 293.

In addition, in the example described above, within the lid member 23, the thick portion 267 in which the groove portion 261 is positioned has a greater thickness than the other portions (the thin portion) 269 (FIG. 29). Therefore, it is possible to suppress the water or the solvent (hereinafter described as "the water or the like") within the ink which infiltrates the inside of the groove portion 261 from passing through the lid member in the thickness direction and leaking out to the outside. The reason for this is described in detail below using FIG. 37 and FIG. 38.

Figure 37:
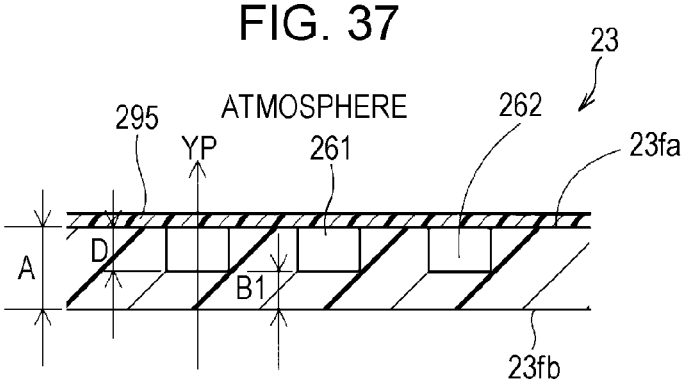
FIG. 37 is a first view for illustrating an effect.
Figure 38:
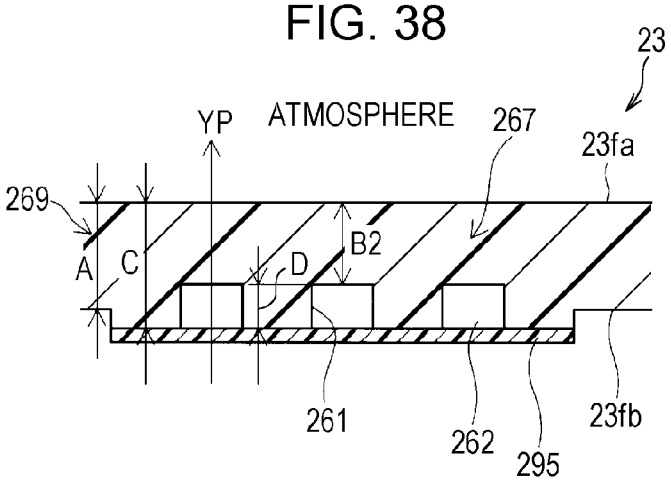
FIG. 38 is a second view for illustrating the effect.

FIG. 37 is a first view for illustrating an effect. FIG. 38 is a second view for illustrating an effect. FIG. 37 is a comparative example, and unlike in the present example, is a form in which the second sheet member 295 is bonded to the surface 23*fa*. FIG. 38 is, as in the present example, a form in which the second sheet member 295 is bonded to the rear 23*fb*. In addition, the thickness of the lid member 23 shown in FIG. 37 is fixed, and has a thickness A. In addition, in the lid member 23 shown in FIG. 37, the groove portion 261 has a depth D. In addition, the distance from the lower portion of the groove portion 261 of the lid member 23 to the plane of the lid member 23 opposing the lower portion is a distance B1.

As shown in the arrow YP of FIG. 37 and FIG. 38, the water content or the like which becomes vapor due to the ink within the printing material accommodation chamber 200 evaporating disperses within the air chamber 241 by permeating the first sheet member 295 from within the accommodation chamber 200, or via the air introduction port 47. The vapor dispersed within the air chamber 241 does not just leave from the ventilation port 291 through the inner portion communication path 262, but also escapes from the inner portion communication path 262 in the thickness direction of the lid member 23. Here, in a case in which the second sheet member 295 is bonded to the surface 23*fa*, even when the vapor is to escape from the inner portion communication path 262 in the thickness direction of the lid member 23, the vapor is sealed by the second sheet member 295.

Conversely, as shown in FIG. 38, in a case in which the second sheet member 295 is bonded to the confronting surface 23*fb*, it is possible for the vapor to escape from the inner portion communication path 262 in the thickness direction of the lid member 23. Therefore, in the present example, by setting the thickness of the lid member 23 in which the groove portion 261 is positioned to a greater thickness than that of the thin portion 269, it is difficult for the vapor to escape from the inner portion communication path 262 in the thickness direction of the lid member 23. For example, in FIG. 38, the thickness of the thick portion 267 is the thickness C, and the distance from the lower plane of the groove portion 261 to the confronting surface (the surface 23*fa*) is the distance B2. Here, the relationship B2>B1 is satisfied. By adopting this configuration, it is possible to suppress the flowing out of the vapor to the outside, and it is possible to suppress the evaporation of the water or the like within the ink. Accordingly, it is possible to suppress the concentration fluctuations of the ink of the printing material accommodation chamber 200.

In addition, in the present example, the extending portion 295*a* of the second sheet member 295 is arranged in a position overlapping with the connection portion 264 (FIG. 29). That is, the extending portion 295*a* opposes the connection portion 264 so as to cover the connection portion 264. The extending portion 295*a* is not attached to the confronting surface 23*fb*. Accordingly, while it is possible to cause the air to flow smoothly via the connection portion 264, it is also possible to reduce the likelihood of the ink flowing from the connection portion 264 through the inner portion communication path 262 and out to the outside.

In addition, in the present example, the flow path cross-sectional area of the connection portion 264 is larger than the flow path cross-sectional area of the inner portion communication path 262 (FIG. 29). Accordingly, the flow of the air with the outside can be performed more smoothly.

In addition, in the present example, the inner portion communication path 262 is a meandering path having a portion which is curved by 180° (FIG. 29). Accordingly, it is possible to lengthen the distance of the inner portion communication path 262 within a narrow region. Therefore, it is possible to suppress the flowing out of the ink to the outside through the inner portion communication path 262.

In addition, in the present example, the convex portions 266 and 268 which oppose the partitioning wall 22*r* arranged within the printing material accommodation chamber 200 are provided on the confronting surface 23*fb* of the lid member 23 (FIG. 30). Accordingly, even in a case in which the lid member 23 is to deform to the inside of the cartridge 20 due to an external force, it is possible to suppress the deformation of the lid member 23 due to the convex portions 266 and 268 making contact with the end portion 22*rp* of the partitioning wall 22*r*.

Figure 39:
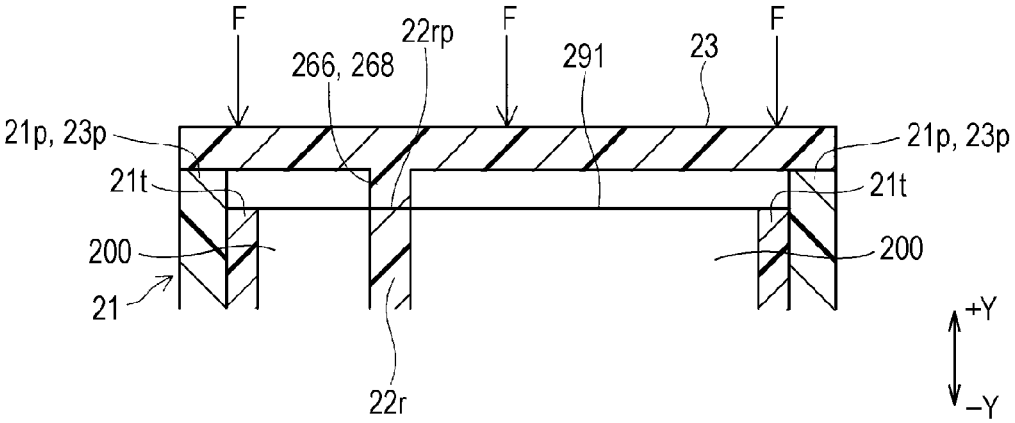
FIG. 39 is a view for illustrating an effect of the convex portions.

FIG. 39 is a view for illustrating an effect of the convex portions 266 and 268. The container-side peripheral portion 21*p* of the container main body member 21 to which the peripheral portion 23*p* of the lid member 23 is adhered is positioned further to the +Y axis direction side than the inside end portion 21*t* to which the first sheet member 291 is adhered or than the end portion 22*rp* of the partitioning wall 22*r*. This is to provide a predetermined interval between the first sheet member 291 and the lid member 23 in order to prevent the first sheet member 291 from being broken by the lid member 23 and the first sheet member 291 rubbing against one another. In particular, within the first sheet member 291, when a portion which is adhered to the inside end portion 21*t* is broken, the likelihood of the ink leaking out from the broken portion to the outside of the printing material accommodation chamber 200 increases.

Here, in a case in which another object is placed on the lid member 23 of the cartridge 20, or in a case in which the cartridge 20 is accommodated within decompressed packaging, an external force F is applied which deforms the lid member 23 to the inside of the cartridge 20. In the present example, the lid member 23 has the convex portions 266 and 268 which are positioned further to the inside than the peripheral portion 23*p* of the lid member 23 and oppose the partitioning wall 22*r*. Accordingly, even in a case in which an external force F is applied to the lid member 23, it is possible to suppress the deformation of the lid member 23 due to the convex portions 266 and 268 making contact with the end portion 22*rp* of the partitioning wall 22*r*.

In addition, in the present example, as can be understood from FIG. 30 and FIG. 32, a portion of the bank 261*a* of the groove portion 261 of the lid member 23 opposes a portion of the peripheral wall which partitions the printing material accommodation chamber 200. Specifically, a portion of the bank 261*a* (refer to FIG. 30) of the groove portion 261 opposes the inside end portion 21*t* of the peripheral wall which partitions the printing material accommodation chamber 200. That is, it is possible increase the location capable of supporting the lid member 23 at the portion further to the inside than the peripheral portion 23*p* of the lid member 23. Accordingly, even in a case in which an external force F is applied which causes the lid member 23 to deform to the inside of the cartridge 20, it is possible to suppress the deformation of the lid member 23 due to the bank 261*a* of the groove portion 261 making contact with the inside end portion 21*t* of the peripheral wall of the printing material accommodation chamber 200.

In addition, the inner portion communication path 262 is formed on the confronting surface 23*fb* side of the lid member 23. Accordingly, it is possible to suppress the damage to the aesthetics of the exterior of the cartridge 20. In particular, it is not necessary to bond the second sheet member 295 to the outer surface of the cartridge 20. Accordingly, it is possible to further suppress the damage to the aesthetics of the cartridge 20.

In the fourth example, the correlations with the disclosures in the application examples will be described below. That is, the cartridge 20 corresponds to "the liquid accommodation body", the printing material accommodation camber 200 corresponds to "the liquid accommodation portion", the printing material supply port 280 corresponds to "the liquid supply portion" and the container main body member 21 and the first sheet member 291 correspond to "the accommodation body main body". In addition, the communication port 32, the through path 33 and the flow path chamber 252 correspond to "the first portion", and the air chamber 241, the connection portion 264, the inner portion communication path 262 and the ventilation port 290 correspond to "the second portion". In addition, the inner portion communication path 262 corresponds to "the narrow flow path".

E. Cartridge with Cap Attached to Printing Material Supply Port

Figure 40:
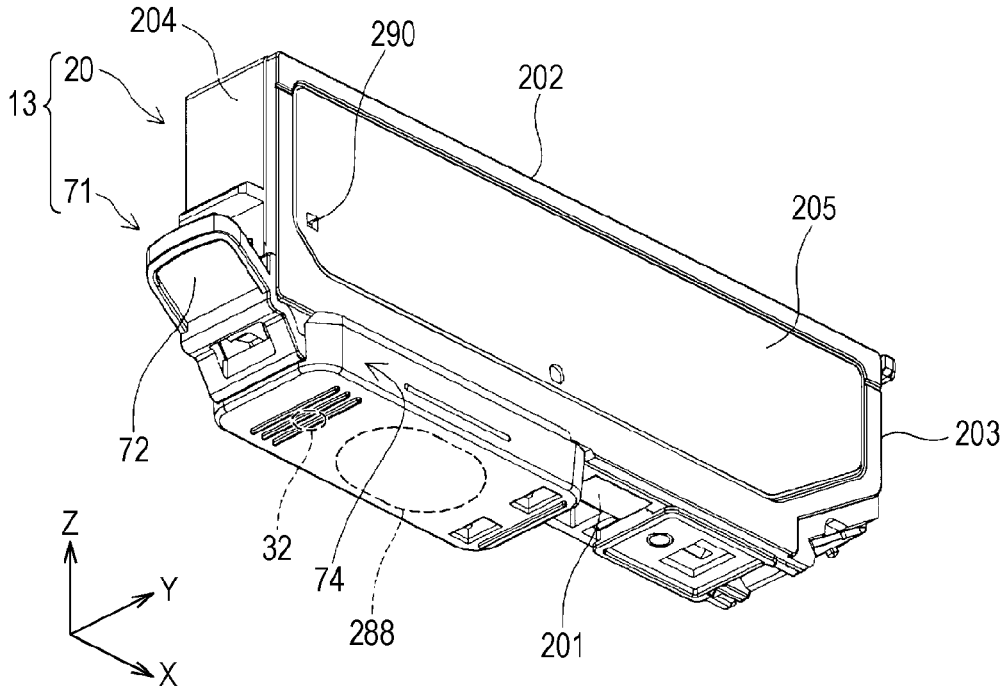
FIG. 40 is a perspective view of a capped cartridge.

FIG. 40 is a perspective view of a capped cartridge 13. The cartridge main body 20 and the cap 71 are provided in FIG. 40. The cartridge 20 is of the same configuration as the cartridge 20 of the fourth example. The cap 71 is attached to the cartridge 20 (in the case of a capped cartridge, also referred to as "the cartridge main body 20") in a detachable manner. In addition, the cap 71 is attached so as to seal the opening of the open end 288. When the cartridge 20 is not mounted in the printer 50, for example, during transportation, during sales, when the cartridge 20 is temporarily removed in order to use the holder 60, and the like, the cap 71 is for preventing the leaking out of the ink from the printing material supply port 280 (FIG. 4 or the like). When the cartridge 20 is mounted in the printer 50, the cap 71 is removed by the user. The cap 71 is provided with a lever 72 and a cap main body 74. The lever 72 is used when removing the cap 71 from the cartridge main body 20. That is, the user can remove the cap by pinching the lever 72. The cap main body 74 has an elastic member (not shown) accommodated inside thereof and the opening of the open end 288 is sealed by the elastic member.

According to the capped cartridge 13, it is possible to reduce the likelihood of the leaking out of the ink from the open end 288 when the cartridge 20 is not mounted in the printer 50.

F. Packaged Cartridge

Figure 41:
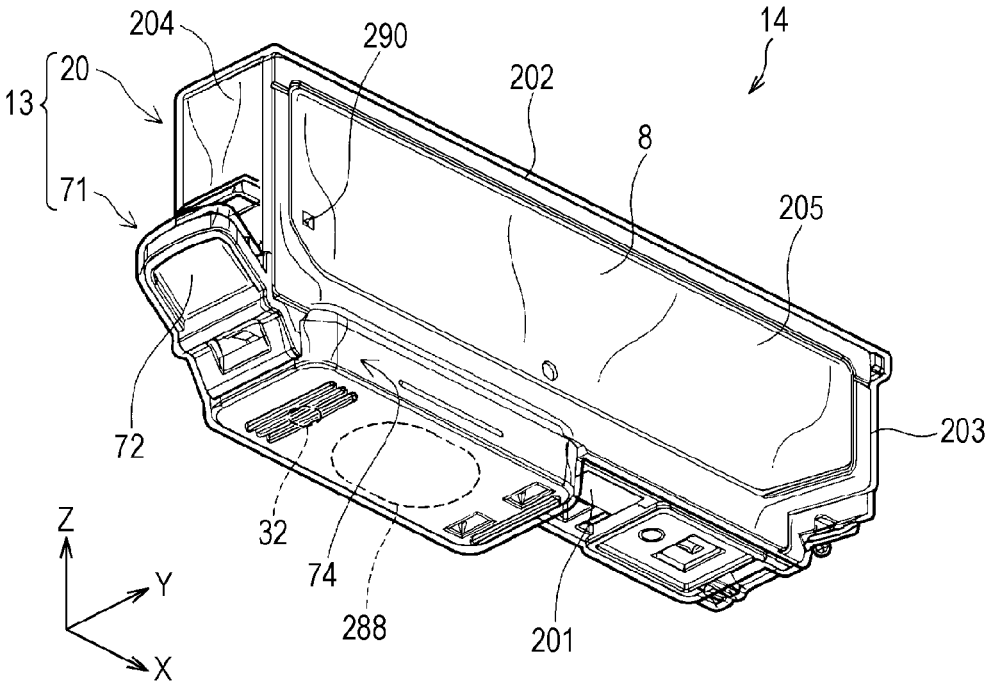
FIG. 41 is a perspective view of a packaged cartridge.

FIG. 41 is a perspective view showing the capped cartridge 13 of FIG. 40 in a state of being packaged by the packaging material 8. The pressure of the inner portion of the packaging material 8 is in a state which is decompressed to a pressure significantly lower than the atmospheric pressure. That is, the capped cartridge 13 is subjected to reduced pressure packaging by the packaging material 8. It is possible to form such a reduce pressure pack by, after arranging the cartridge 100 inside the packaging material 8, a portion of which is open, decompressing the packaging material 8 by removing the air of the inner portion thereof from the opening, and closing the opening of the packaging material 8 while maintaining this state. The packaging material 8 is fabricated, for example, from a synthetic resin such as polyethylene or nylon.

As described above, in the packaged cartridge 14 of the present embodiment, since the inner portion of the packaging material 8 is decompressed to a lower pressure than the atmospheric pressure, it is possible to obtain a reduction in the amount of dissolved gas in the ink of the inner portion of the cartridge 20.

G. Modification Examples

An example of the invention is described above, however, the invention is not limited to such examples and may adopt various configurations without departing from the spirit of the invention. For example, modifications such as the following are possible.

G-1. First Modification Example

Figure 42:
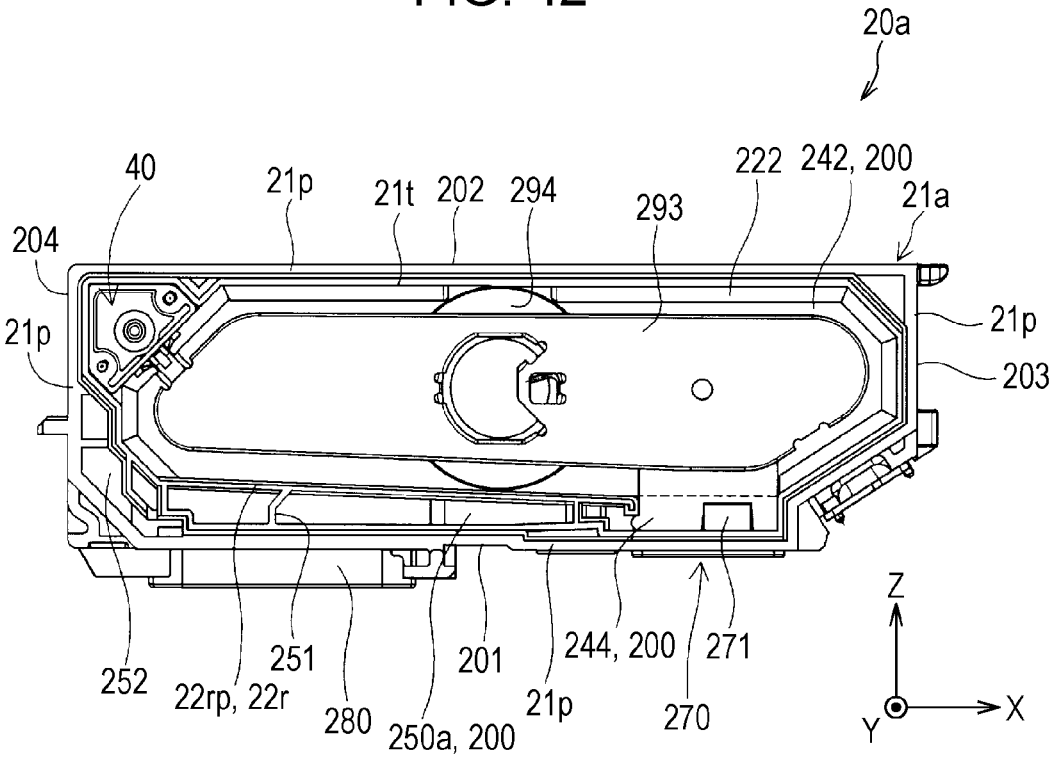
FIG. 42 is a view for illustrating a cartridge of the first modification example.

FIG. 42 is a view for illustrating a cartridge 20*a* of the first modification example. The differences to the cartridge 20 (FIG. 31) of the fourth example are that the volume of the buffer chamber 250*a* is smaller, and that a partitioning wall 251 is newly provided in order to provide the buffer chamber 250*a*. Since the configuration of the other elements is the same as in the first example, the configurations which are the same as in the first example will be given the same reference numerals and description thereof will be omitted.

As in FIG. 42, it is easy to change the size of the buffer chamber 250*a* by providing the partitioning wall 251. That is, it is possible to form the container main body member 21*a* having a buffer chamber 250*a*, which has a different volume to that of the fourth example, in an integrated manner by combining a nested box for forming the partitioning wall 251 in the mold for forming the container main body member 21 of the cartridge 20 of the fourth example. As described earlier with reference to FIG. 40 and FIG. 41, it is also possible to attach a cap 71 to the cartridge 20*a* of the first modification example, or to subject the cartridge 20*a* to reduced pressure packaging using the packaging material 8.

G-2. Second Modification Example

Figure 43A:
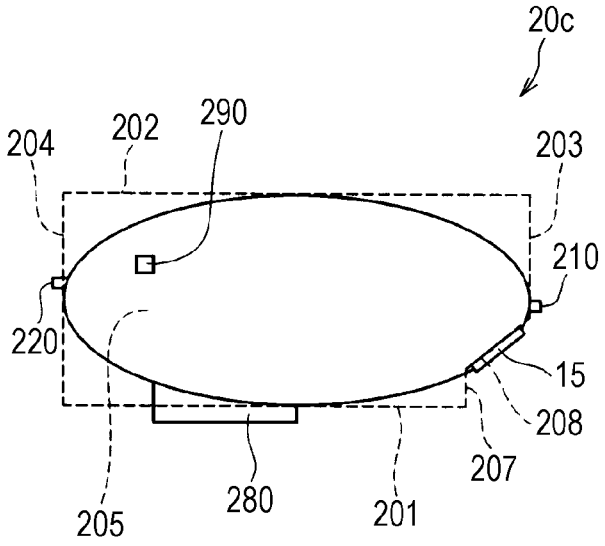
FIG. 43A is a view for illustrating a cartridge.
Figure 43B:
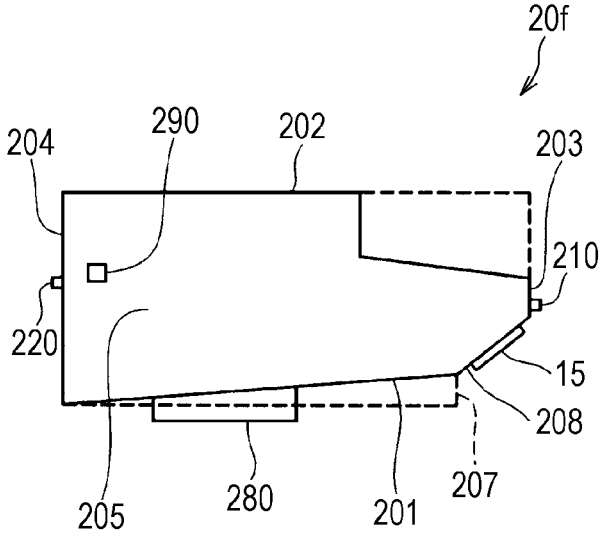
FIG. 43B is a view for illustrating a cartridge.

FIG. 43A and FIG. 43B schematically show the various modification examples of the shape of cartridges 20*c* to 20*h*. FIG. 42A to FIG. 42F depict the fifth plane 205 side of the various cartridges 20*c* to 20*h*.

The outer shell 22*c* of the cartridge 20*c* shown in FIG. 43A has an elliptical or an oval side. In addition, the cartridge 20*c* has the first cartridge-side restricting portion 210 and the circuit board 15 on the front side thereof. In addition, the printing material supply port 280 is formed on the lower plane side of the cartridge 20*c* and the second cartridge-side restricting portion 220 is formed on the rear side of the cartridge 20*c*. Even with the cartridge 20*c*, as long as the first and second cartridge-side restricting portions 210 and 220, the circuit board 15 and the printing material supply port 280 are configured to connect with the corresponding members of the printer 50, it is possible to maintain compatibility with the cartridges 20 and 20*a* described above.

The cartridge 20*f* shown in FIG. 43B is different from the cartridges 20 and 20*a* in that it does not have a seventh plane, and in that the cartridge 20*f* is of a shape as though the corner portion at which the second plane and the third plane are orthogonal to one another is cut off. Even with the cartridges 20*c* to 20*g*, the first and second cartridge-side restricting portions 210 and 220, the circuit board 15 and the printing material supply port 280 are configured to connect with the corresponding members of the printer 50, and it is possible to maintain compatibility with the cartridges 20 and 20*a* described above.

As can be understood from the examples shown in FIG. 43A and FIG. 43B, various modification examples may be considered for the exterior shape of the cartridge. Even in a case in which the cartridge has an exterior shape other than a substantially cube shape, for example, as depicted by the dotted lines in FIG. 43A and FIG. 43B, it is possible to virtually consider the six planes of the substantial cube, that is, the lower plane 201 (the first plane 201), the upper plane 202 (the second plane 202), the front plane 203 (the third plane 203), the rear plane 204 (the fourth plane 204), the left side plane 205 (the fifth plane 205) and the right side plane 206 (the sixth plane 206) shown in FIGS. 4 to 22. In the present specification, the term "plane" (plane) may be used to include both meanings of such a virtual plane (also referred to as a nonexistent plane) and an existing plane as disclosed in FIGS. 4 to 22 and the like. In addition, the term "plane" is used to include both meanings of a flat plane and a curved plane.

G-3. Third Modification Example

In the examples described above, description was given using a so-called half-sealed type of the ink cartridge 20, 20*a*, 100*w* and 100*aw*, however, the invention may also be applied to other types of cartridge. For example, the invention may also be applied to a type of the cartridge in which the liquid accommodation portion is always in communication with the outside and a type of the cartridge in which the liquid accommodation portion is always sealed (a so-called ink pack).

G-4. Fourth Modification Example

In the examples described above, in the cartridges 20, 20*a*, 100*w* and 100*aw*, the holder (the cartridge mounting portion) is mounted in a freely detachable manner in an on-carriage type of printing apparatus, which is on a carriage, however, a printing apparatus of a type in which the cartridge 100*w* or 100*aw* is arranged in a place other than the carriage (a so-called off-carriage type of printing apparatus) may also be used.

G-5. Fifth Modification Example

The invention is not limited to an ink jet printer and the ink cartridge thereof, and may also be applied to an arbitrary liquid ejecting apparatus which consumes a liquid other than the ink, and the liquid accommodation body used in such a liquid ejecting apparatus. For example, it is possible to apply the invention to a liquid accommodation body used in various types of liquid ejecting apparatus such as those described below.

(1) An image recording apparatus such as a facsimile device
(2) A color material ejecting apparatus used in the manufacture of color filters for image display apparatuses such as liquid crystal displays
(3) An electrode material ejecting apparatus used in electrode formation for organic EL (Electro Luminescence) displays, surface emission displays (Field Emission Display, FED) and the like
(4) A liquid ejecting apparatus which ejects a liquid containing biological organic matter used in the manufacture of biochips
(5) A sample ejecting apparatus as a precision pipette
(6) A lubricating oil ejecting apparatus
(7) A resin liquid ejecting apparatus
(8) A liquid ejecting apparatus which ejects lubricating oil at pinpoint precision into precision machinery such as clocks and cameras
(9) A liquid ejecting apparatus which ejects a transparent resin liquid such as an ultraviolet curing resin liquid onto a substrate in order to form a micro-hemispherical lens (an optical lens) used in optical communication devices and the like
(10) A liquid ejecting apparatus which ejects an acidic or alkaline etching liquid in order to etch a substrate or the like
(11) A liquid ejecting apparatus provided with a liquid consumption head which discharges minute droplets of another arbitrary liquid Furthermore, the term "droplets" refers to the state of the liquid discharged from the liquid ejecting apparatus and includes particle-shaped droplets, teardrop-shaped droplets and droplets with a trailing tail. In addition, the term "liquid" here may be a material which the liquid ejecting apparatus can consume. For example, the term "liquid" also includes a material in which the physical properties thereof are in a liquid phase state, a material of a liquid state with a high or a low viscosity, and materials of a liquid state such as sol, gel water, other inorganic solvents, organic solvents, solutions, liquid resins and liquid metals (melted metals). In addition, not only liquids as a state of physical property, but the term "liquid" also includes particles of a functional material formed from solids such as a pigment or metallic particles which are dissolved, dispersed or mixed into a solvent. In addition, representative examples of the liquid include the ink and the liquid crystal described in the examples above. Here, the term "ink" includes general water based ink and oil based ink, as well as various types of liquid composition such as jell ink and hot melt ink.

G-6. Sixth Modification Example

In addition, the invention may also be applied as the following form.

Form 1

A liquid accommodation body includes an accommodation body main body provided with a liquid accommodation portion for accommodating a liquid in an inner portion and a liquid supply portion which communicates with the liquid accommodation portion and has an opening for causing the liquid of the liquid accommodation portion to flow to the outside; a cap member which is mounted on the accommodation body main body in a detachable manner so as to seal the opening of the liquid supply portion and, together with the liquid supply portion, forms an inner chamber by partitioning; and a first communication path which for connecting the inner chamber to the ambient atmosphere.

In this case, since the inner chamber communicates with the outside via the first communication path, when the cap member is mounted to the accommodation body main body so as to seal the opening of the liquid supply portion, the air of the inner chamber may flow through the first communication path out to the outside. Accordingly, since the air of the inner chamber is not compressed, it is possible to prevent the air from flowing into the liquid accommodation portion.

What is claimed is:

1. A liquid container configured to supply a liquid to a liquid ejecting apparatus when the liquid container is mounted in the liquid ejecting apparatus, the liquid container comprising:

a liquid accommodation portion adapted to accommodate the liquid;

a liquid supply portion which is in communication with the liquid accommodation portion and which has an opening adapted to supply the liquid of the liquid accommodation portion to the liquid ejecting apparatus when the liquid container is mounted in the liquid ejecting apparatus;

a cap member adapted to detachably seal the opening of the liquid supply portion and which forms an inner chamber before the liquid container is mounted in the liquid ejecting apparatus; and a first communication path adapted to brings the inner chamber into communication with ambient atmosphere outside of the liquid container before the liquid container is mounted in the liquid ejecting apparatus.

2. The liquid container according to claim 1, further comprising:

a second communication path adapted to brings the liquid accommodation portion into communication with the ambient atmosphere outside of the liquid container in order to introduce air to the liquid accommodation portion;

wherein the first communication path includes a first portion connected to the inner chamber, and a second portion which is adapted to communicates the first portion with ambient atmosphere outside of the liquid container when the liquid supply portion is sealed by the cap member, the second portion being positioned further toward an outside air side along a flow path of the first communication path than the first portion when the liquid supply portion is sealed by the cap member, and configuring a portion of the second communication path.

3. A container unit, comprising: the liquid container according to claim 2; and packaging material which accommodates the liquid container in an inner portion at a lower pressure than the atmospheric pressure.

4. The liquid container according to claim 1, wherein the first communication path is formed in the cap member.

5. A container unit, comprising: the liquid container according to claim 4; and packaging material which accommodates the liquid container in an inner portion at a lower pressure than the atmospheric pressure.

6. The liquid container according to claim 1, wherein the first communication path has a narrow flow path which has a smaller flow path cross-sectional area than other portions of the first communication path.

7. A container unit, comprising: the liquid container according to claim 6; and packaging material which accommodates the liquid container in an inner portion at a lower pressure than the atmospheric pressure.

8. The liquid container according to claim 1, further comprising:

a container main body member of a concave shape having an opening in a wall on one side;

a lid member attached to the container main body so as to cover the opening of the container main body member;

a sheet member attached to the container main body so as to form the liquid accommodation portion;

wherein the sheet member is attached to a surface of the lid member and the lid member is formed with a portion of the first communication path at a side thereof that faces the sheet member.

9. A container unit, comprising: the liquid container according to claim 8; and packaging material which accommodates the liquid container in an inner portion at a lower pressure than the atmospheric pressure.

10. The liquid container according to claim 1, wherein the first communication path is formed after the liquid accommodation portion is filled with the liquid.

11. A container unit, comprising: the liquid container according to claim 1; and packaging material which accommodates the liquid container in an inner portion at a lower pressure than the atmospheric pressure.

12. A liquid container configured to supply a liquid to a liquid ejecting apparatus when the liquid container is mounted in the liquid ejecting apparatus, the liquid container comprising:

an outer shell;

a liquid accommodation portion provided internal of the outer shell and adapted to accommodate the liquid;

an air chamber provided internal to the outer shell and external from the liquid accommodation portion;

a liquid supply portion located at a surface of the outer shell, the liquid supply portion having an opening adapted to supply the liquid of the liquid accommodation portion to the liquid ejecting apparatus when the liquid container is mounted in the liquid ejecting apparatus; and a ventilation port provided on a surface of the outer shell;

wherein, when an inner chamber is defined in the liquid supply portion by sealing the opening of the liquid supply portion before the liquid container is mounted in the liquid ejecting apparatus, the inner chamber is adapted to communicates with ambient atmosphere outside of the liquid container through a communication path which passes from a communication port provided in the inner chamber, through the air chamber, and to the ventilation port.

13. The liquid container according to claim 12, wherein the outer shell includes a container main body member of a concave shape having an opening in a wall on one side; and a lid member attached to the container main body member so as to cover the opening of the container main body member;

wherein the ventilation port is formed in the lid member, and wherein an inner portion communication path is formed on confronting surface of the lid member that faces the liquid accommodation portion, one end of the inner portion communication path communicates with the ventilation port and the other end communicates with the air chamber.

14. The liquid container according to claim 13, wherein the liquid accommodation portion is configured by attaching a first sheet member having flexibility to the container main body member;

wherein the lid member is attached to the container main body member so as to cover the first sheet member;

wherein the inner portion communication path is configured by a groove portion and a second sheet member which is attached to the confronting surface so as to cover the groove portion; and wherein at least a portion of the second sheet member is provided in a position opposite the first sheet member.

15. The liquid container according to claim 14, wherein, a connection portion configured by a concave portion provided on the confronting surface is provided at the other end of the inner portion communication path;

wherein the second sheet member extends to a position that confronts the connection portion; and wherein the portion of the second sheet member that confronts the connection portion is not attached to the confronting surface.

16. The liquid container according to claim 15, wherein a flow path cross-sectional area of the connection portion is greater than the flow path cross-sectional area of the inner portion communication path.

17. The liquid container according to claim 13, wherein the inner portion communication path is a meandering path having a portion which is curved by 180.degree.

18. The liquid container according to claim 12, wherein a path connecting a communication port provided in the inner chamber with the air chamber is formed after the liquid accommodation portion is filled with the liquid.

19. The liquid container according to claim 12, wherein the liquid accommodation portion includes an air introduction port adapted to introduce air from the ambient atmosphere outside of the liquid container and a valve mechanism urged so as to close the air introduction port; and wherein the valve mechanism is configured so as to temporarily open the air introduction port at a predetermined timing with consumption of the liquid within the liquid accommodation portion.

20. The liquid container according to claim 12, wherein the liquid accommodation portion is a sealed space not in communication with an atmosphere.

* * * * *